US007354210B2

(12) United States Patent
Seo et al.

(10) Patent No.: US 7,354,210 B2
(45) Date of Patent: Apr. 8, 2008

(54) LABEL PRINTER

(75) Inventors: Keiji Seo, Nagoya (JP); Akira Sago, Seto (JP); Atsushi Kasugai, Nagoya (JP); Kiyoshi Sugimoto, Kuwana (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 374 days.

(21) Appl. No.: 11/039,894

(22) Filed: Jan. 24, 2005

(65) Prior Publication Data

US 2005/0162501 A1 Jul. 28, 2005

(30) Foreign Application Priority Data

| | | |
|---|---|---|
| Jan. 27, 2004 | (JP) | 2004-018386 |
| Mar. 17, 2004 | (JP) | 2004-076263 |
| Apr. 23, 2004 | (JP) | 2004-128267 |
| Nov. 24, 2004 | (JP) | 2004-339332 |

(51) Int. Cl.
*B41J 11/70* (2006.01)
*B41J 11/68* (2006.01)
*B65H 29/52* (2006.01)

(52) U.S. Cl. ..... 400/621; 400/613; 400/693

(58) Field of Classification Search ..... None
See application file for complete search history.

(56) References Cited

U.S. PATENT DOCUMENTS 4,158,977 A * 6/1979 Logan ..... 83/522.16
6,102,596 A * 8/2000 Komori et al. ..... 400/621
6,302,602 B1 * 10/2001 Kiyohara et al. ..... 400/593

FOREIGN PATENT DOCUMENTS

| | | | |
|---|---|---|---|
| EP | 1 193 035 A1 | | 4/2002 |
| EP | 1193035 A1 | * | 4/2002 |
| JP | A 01-308661 | | 12/1989 |
| JP | 03018549 A | * | 1/1991 |
| JP | 03224764 A | * | 10/1991 |
| JP | 2001171877 A | * | 6/2001 |
| JP | 2002072594 A | * | 3/2002 |
| JP | A 2002-068546 | | 3/2002 |
| JP | A 2002-086823 | | 3/2002 |
| JP | 2002219688 A | * | 8/2002 |
| JP | A 2004-291659 | | 10/2004 |

OTHER PUBLICATIONS

Machine translation of JP 2002219688 to Odagiri from Japanese Patent Office website.*

* cited by examiner

*Primary Examiner*—Daniel J. Colilla
(74) *Attorney, Agent, or Firm*—Oliff & Berridge, PLC

(57) ABSTRACT

A cutting edge of a movable blade mounted to a cutter holder is inclined at an oblique cross angle. The cutting edge of the movable blade obliquely intersects a roll sheet placed on a cutter plate in its cutting direction. This ensures that the cutting edge cuts the roll sheet sharply. On this regard, this oblique cross angle has an influence on the number of times that the cutting edge is capable of cutting. An appropriate range of the oblique cross angle is 24° and 34°. The oblique cross angle is an angle formed between an upper surface of the cutter plate and the cutting edge in the cutting direction of the movable blade.

15 Claims, 37 Drawing Sheets

3
20
44
45
36
40
43
42
60
48
35
47
37
55
12
13
56
12A
57
43A
43B
43C
Y
Z
62
10m
20m
30m

| ANGLE | NUMBER OF CUTTING |
|---|---|
| 23° | 8451 |
| 24° | 12050 |
| 29° | 28100 |
| 34° | 17426 |
| 35° | 9035 |

LABEL PRINTER

BACKGROUND OF THE INVENTION

1. Field of the Invention

The present invention relates to a label printer for producing printed labels by sliding a movable blade so as to cut a long printing medium into pieces.

2. Description of Related Art

In a conventional label printer, it is needed to cut a long printing medium at the time of producing printed labels. As one type to be employed in such a cutter unit, for example, there is a sliding type in which a movable blade is slid to cut a printing medium along its width direction into pieces (for example, see Japanese laid-open patent publication No. 2002-86823).

On this regard, in this sliding type, at the time of cutting a printing medium into pieces, a movable blade is slid from its home position. In this sliding operation, the movable blade is moved to across the printing medium from its one side to the other side along the width direction. After this sliding operation is completed, in order to bring the movable blade into a state ready for the next cutting operation, a reverse sliding operation for returning the movable blade to its home position is performed. In the reverse sliding operation, the movable blade moves backward along the same path as of the sliding operation. Thus, there is a fear that, when the movable blade comes to pass across the cut surface of the printing medium, the movable blade is snagged on the cut surface of the printing medium and paper jam and the like of the printing medium occurs.

Further, in the sliding type, in order to cut a printing medium smoothly, a tension is applied to the printing medium. As a result of this application of tension, a thermal head is in press contact with a platen roller. By use of this press-contact state, for example, one end of the printing medium in its longitudinal direction is pinched, whereas the other end of the printing medium in its longitudinal direction is pinched by use of a paper discharge rollers. In this structure, since both ends of the printing medium in its longitudinal direction are held firmly, the printing medium can be cut smoothly by the sliding action of the movable blade. However, at this time, since the printing medium is fixed to be immobile, the cutting point of the movable blade concentrates on one point on the printing medium, causing the durability of the movable blade to degrade.

For the reasons described above, it is difficult to ensure the performance of movable blade in the sliding type.

SUMMARY OF THE INVENTION

The present invention has been made in view of the above circumstances and has an object to overcome the above problems and to provide a label printer with an enhanced performance of a cutter unit.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a label printer comprising: a housing into which a rolled printing medium is to be mounted; a feeding device which feeds the printing medium mounted in the housing; a printing device which makes prints on the printing medium; a cutter unit including a movable blade that is located downstream of a feeding direction of the printing medium by the feeding device of the printing device, and is reciprocated in a width direction of the printing medium so as to cut a free end portion of the printing medium located downstream of the feeding direction than the printing device into a print label, wherein a cutting edge of the movable blade is provided so as to obliquely cross with a direction along which the printing medium is cut.

Specifically, the label printer includes the cutter unit. The cutter unit includes the movable blade of a sliding type where the movable blade is moved against the printing medium mounted in the housing (main body) in a direction of cutting the printing medium so that a part of the printing medium is cut into a print label. The cutting edge of the movable blade in the cutter unit is obliquely crossed with the direction of cutting the printing medium, thereby ensuring the performance of cutting the printing medium (easiness of cutting) in its width direction.

According to another aspect, the present invention provides a label printer comprising: a housing into which a rolled printing medium is to be mounted; a platen roller provided to the housing; a thermal head relatively movable into a state in press contact with the platen roller and into a state apart from the platen roller; a feeding plate provided downstream of the feeding direction of the printing medium with respect to the thermal head; a feeding surface which constitutes a surface of the feeding plate, and on which a printing medium sent out from a clearance between the thermal head and the platen roller is placed and slid when the thermal head is in press contact state; a cutter unit including a movable blade that is located downstream of a feeding direction of the printing medium with respect to the thermal head, and is reciprocated in a width direction of the printing medium so as to cut a free end portion of the printing medium located downstream of the feeding direction than the thermal head into a print label; a curved discharge guide provided in a state of rising obliquely upward and successive to a feeding surface of the feeding plate at the downstream of the feeding direction of the printing medium; a top cover placed on the housing; wherein the printing medium includes an image receiving sheet onto which printing is to be made, and a release sheet attached to the image receiving sheet via an adhesive agent, and a plurality of long printing medium of different widths is mountable in the housing, and any one of the plurality of long printing medium of different widths is mountable in a state where its side end at a specific side is aligned at a common reference, and the cutter unit includes a movable blade having a specific width and formed with a cutting edge at the side of the common reference, and the movable blade is moved with respect to the printing medium mounted in the housing in a cutting direction from one end opposite to the common reference toward the common reference, and is stopped at a turning point at which the cutting edge of the movable blade goes beyond the side edge of the printing medium located at the side of the common reference, whereas the end portion of the cutting edge of the movable blade at the ridge side does not go beyond the side edge of the printing medium at the side of the common reference, and then is moved from the turning point in a direction reverse to the cutting direction, so that a part of the printing medium is cut into a print label, and the movable blade obliquely crosses the cutting direction with an upper portion of the cutting edge inclined rearward with respect to the cutting direction, and the cutting edge obliquely crosses the feeding direction of the printing medium with an upper portion of the cutting edge inclined downward in the cutting direction, and when the cutting edge cuts the printing medium fed with the image receiving sheet face down, the cutting edge reaches the image receiving sheet before it reaches the release sheet, and one end side of a discharge port for discharging the printing medium, the discharge port being located downstream of the feeding direction of the printing medium with respect to the feeding plate, is constituted by an end surface of the top cover, so that the printing medium passing through the discharge port slides on the end surface of the top cover which constitutes one end side of the discharge port.

Specifically, the label printer includes the cutter unit. The cutter unit includes the movable blade of a slide type where the movable blade is moved against the printing medium mounted in the housing in a direction of cutting the printing medium so that a part of the printing medium is cut into a print label. The cutting edge of the movable blade in the cutter unit is obliquely crossed with the direction of cutting the printing medium in such a manner that the upper portion of the cutting edge is inclined rearward, thereby ensuring the performance of cutting the printing medium (easiness of cutting) in its width direction.

Further, in the label printer, at the time of cutting the printing medium residing in a stable state by the cutter unit of the sliding type, the movable blade is reciprocated in a state where it obliquely crosses with the printing medium in a direction of feeding the printing medium. Since a shearing force is exerted onto the printing medium during the cutting operation, it is possible to prevent the occurrence of naps on the cut surface of the printing medium, and to further enhance the performance for cutting the printing medium (easiness of cutting) in its width direction.

Further, in the label printer, when the movable blade of the cutter unit is at the turning point of the movement, a state is established where the cutting edge of the movable blade goes beyond the side edge of the printing medium located at the side of the common reference, whereas the end portion of the cutting edge of the movable blade at the ridge side never goes beyond the side edge of the printing medium at the side of the common reference. Therefore, when the movable blade of the cutter unit advances in the cutting direction and then to reach the turning point from which the movable blade starts to advance in the direction reverse to the cutting direction, the cutting edge of the movable blade of the cutter unit completely passes through the printing medium and cuts a part of the printing medium from the printing medium. On the other hand, the end portion of the cutting edge of the movable blade of the cutter unit at the ridge side stays within the cut surface of the printing medium. Therefore, even when the movable blade of the cutter unit starts to move in the direction reverse to the cutting direction, the movable blade of the sliding type can smoothly slide in a direction reverse to the cutting direction along the cut surface of the printing medium without the movable blade of the cutter unit snapped on the cut surface of the printing medium. As a result, paper jam of the printing medium can be prevented.

Especially, since a specified one side edge of the printing medium which is mountable to any type of housing is located at the common reference of the housing, occurrence of paper jam of the printing medium can be prevented for any long printing medium of any width mounted in the housing.

Further, in the label printer, as a result that the printing medium is fed by the platen roller, the printing medium slides on the cutter plate, and then the printing medium is discharged through the discharge port. At this time, since the printing medium passing through the discharge port slides on the end surface of the top cover which constitutes one end side of the discharge port, the printing medium is curved. In this curved form, the printing medium creates a tension for bringing itself into tightly contact with the cutter plate. The printing medium in this stable state is cut by the cutter unit of the sliding type, so that the occurrence of problems such as the cut end of the printing medium in a curved form or in a snapped form can be prevented. Further, when the top cover is opened, the inside of the discharge port is exposed and is cleaned easily.

Further, in the label printer, as a result that the printing medium is fed by the platen roller, the printing medium slides on the cutter plate. Subsequently, the printing medium slides along the curved surface of the discharge guide which rises obliquely upward, and as a result, the printing medium is curved. In this curved form, the printing medium creates a tension for bringing itself into tightly contact with the cutter plate. The printing medium in this stable state is cut by the cutter unit of the sliding type, so that the occurrence of problems such as the cut end of the printing medium in a curved form or in a snapped form can be prevented. Further, the printing medium can be discharged with the surface carrying the image-printed label face down.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of a preferred embodiment of a label printer embodying the present invention will now be given referring to the accompanying drawings.

The label printer in the present embodiment is a model provided with a cutter unit of a sliding type. Firstly, the schematic structure of the whole label printer will be explained below with reference to FIGS. 1 to 7.

Figure 1:
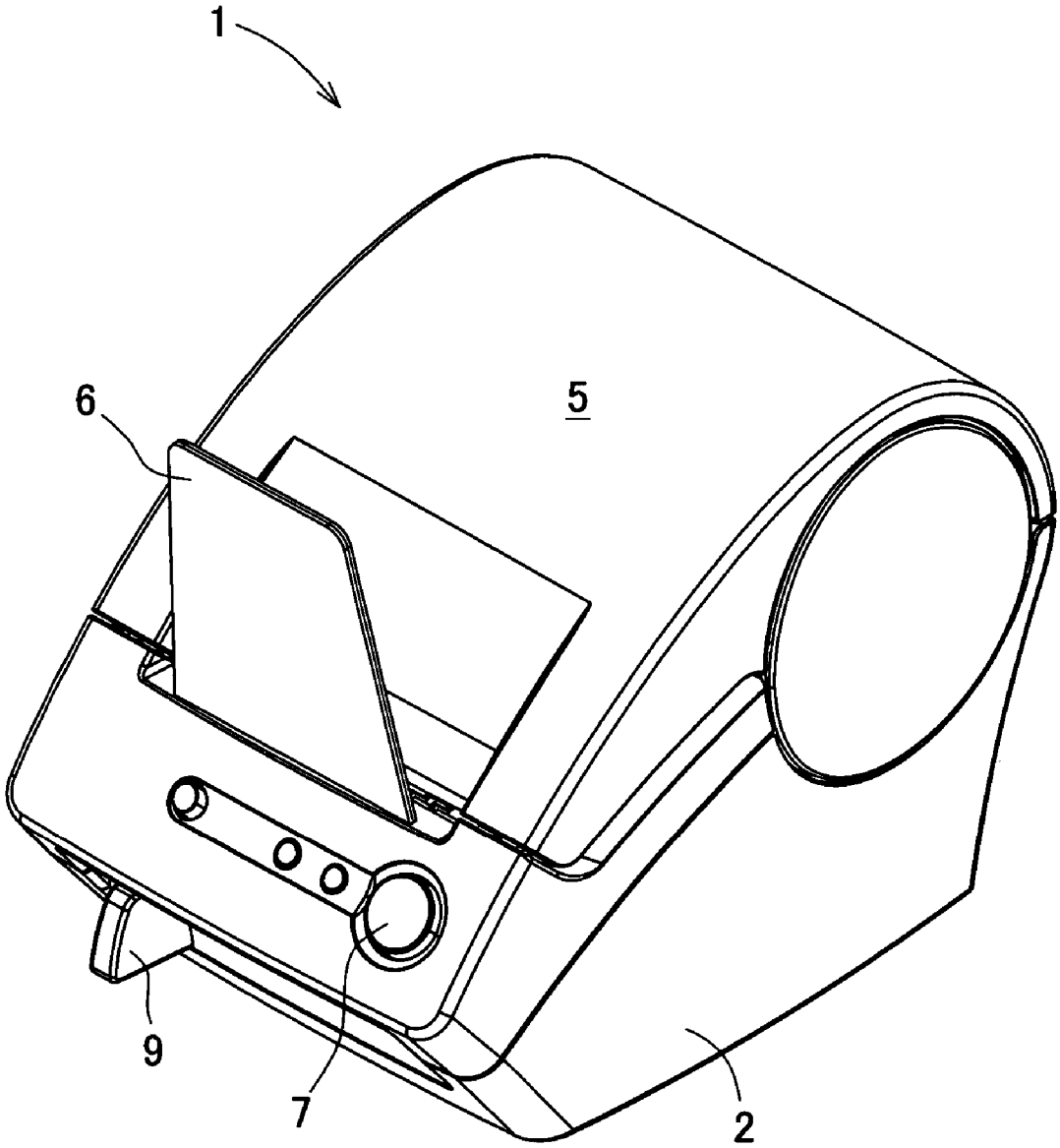
FIG. 1 is a schematic perspective view of a label printer in an embodiment.
Figure 2:
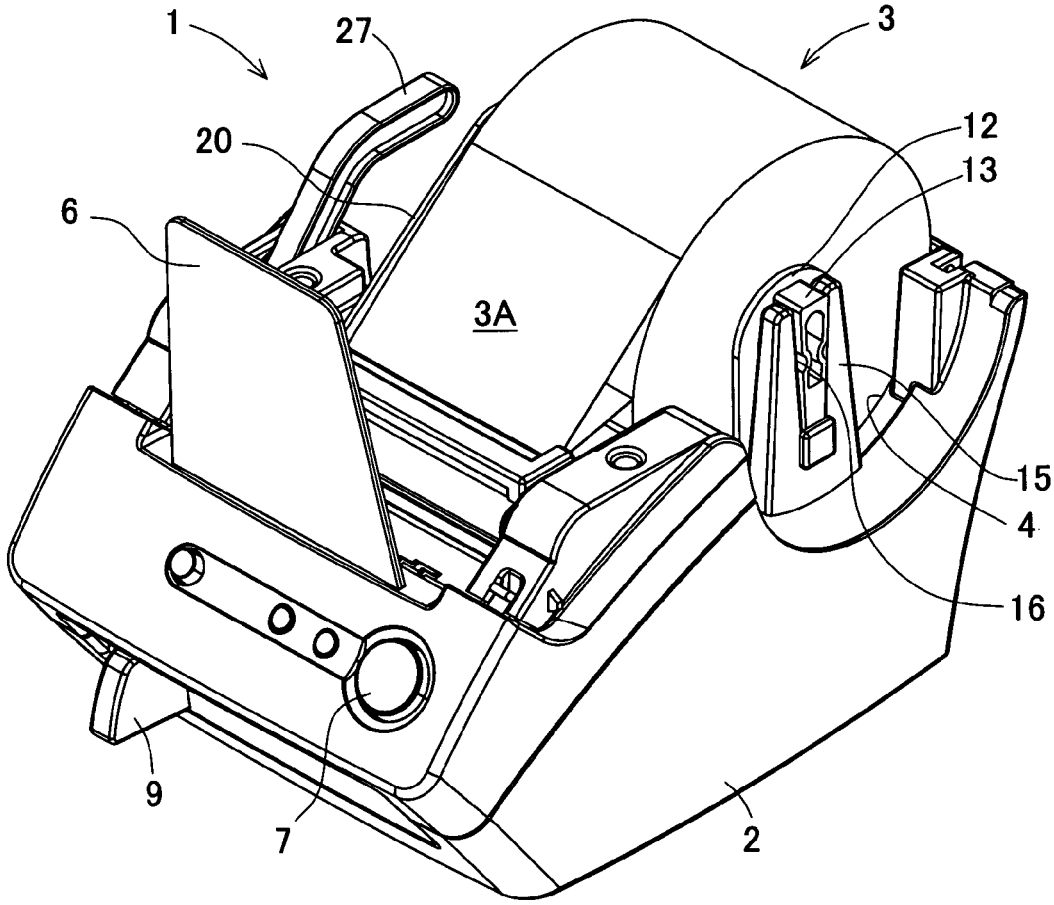
FIG. 2 is a perspective view of the label printer of which a top cover is removed, in which a roll sheet holder holding a roll sheet of a maximum width is mounted.
Figure 3:
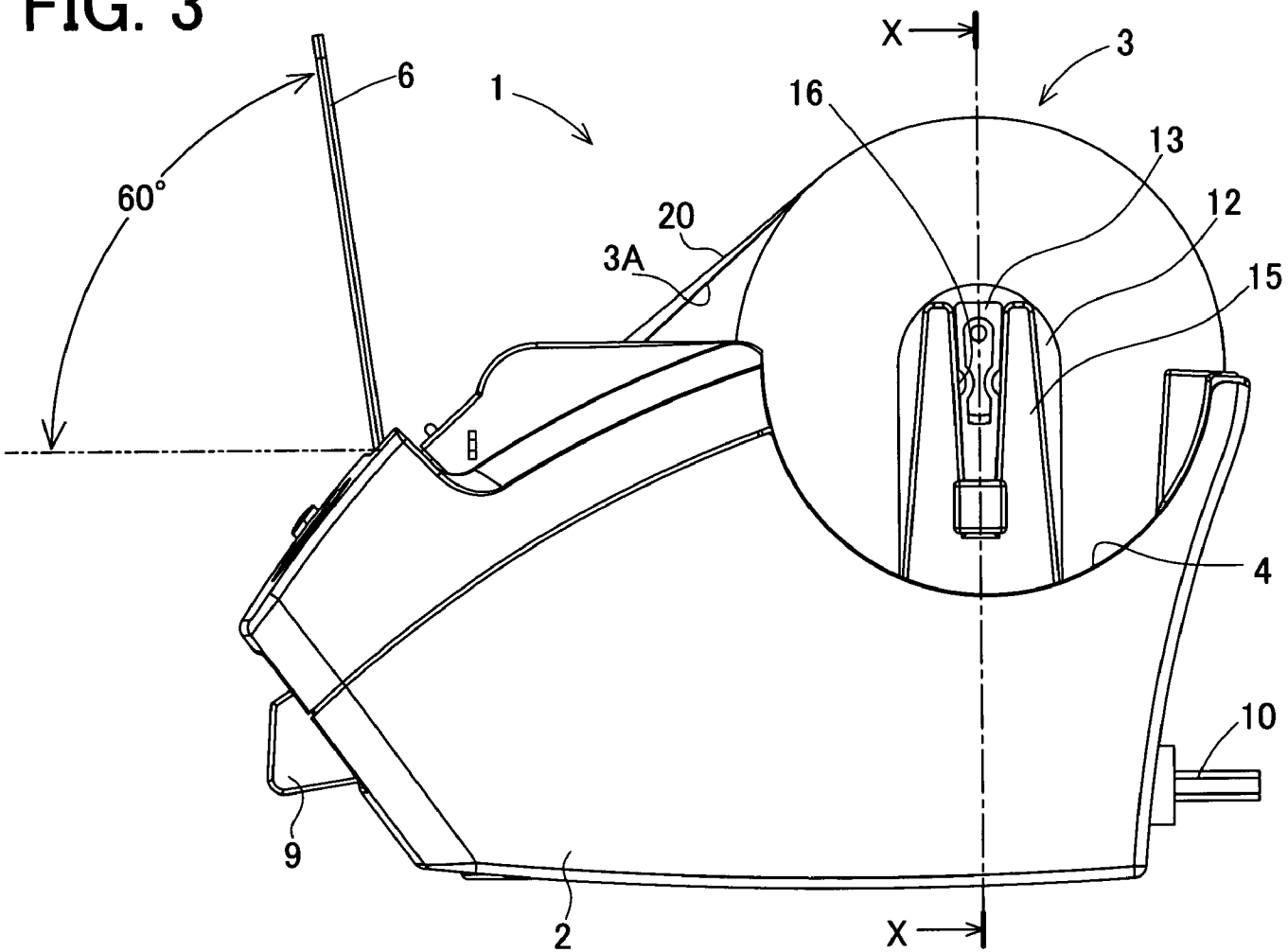
FIG. 3 is a side view of the label printer of FIG. 2.
Figure 4:
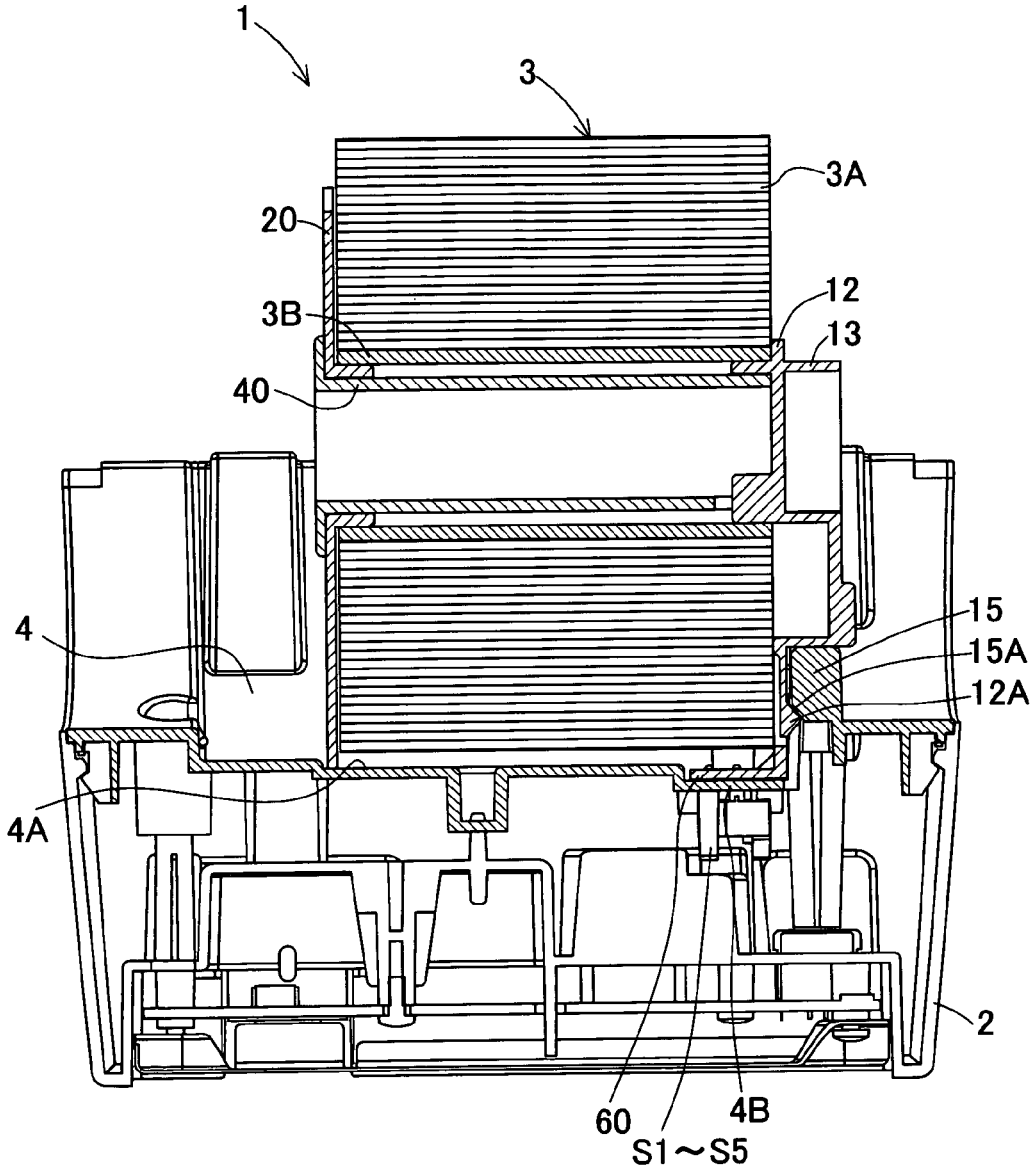
FIG. 4 is a sectional view taken along a line X-X in FIG. 3.
Figure 5:
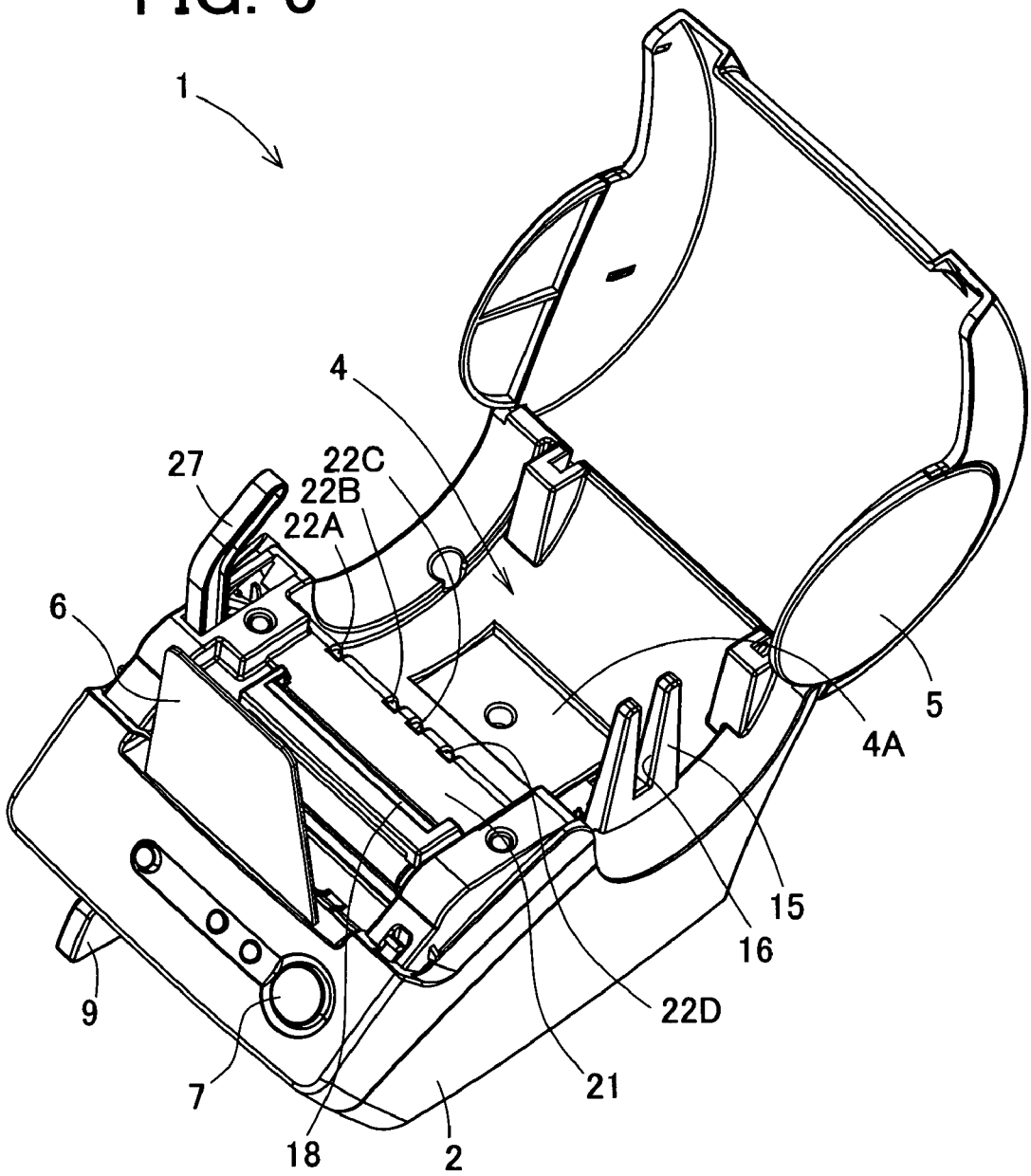
FIG. 5 is a schematic perspective view of the label printer of which the top cover is opened.
Figure 6:
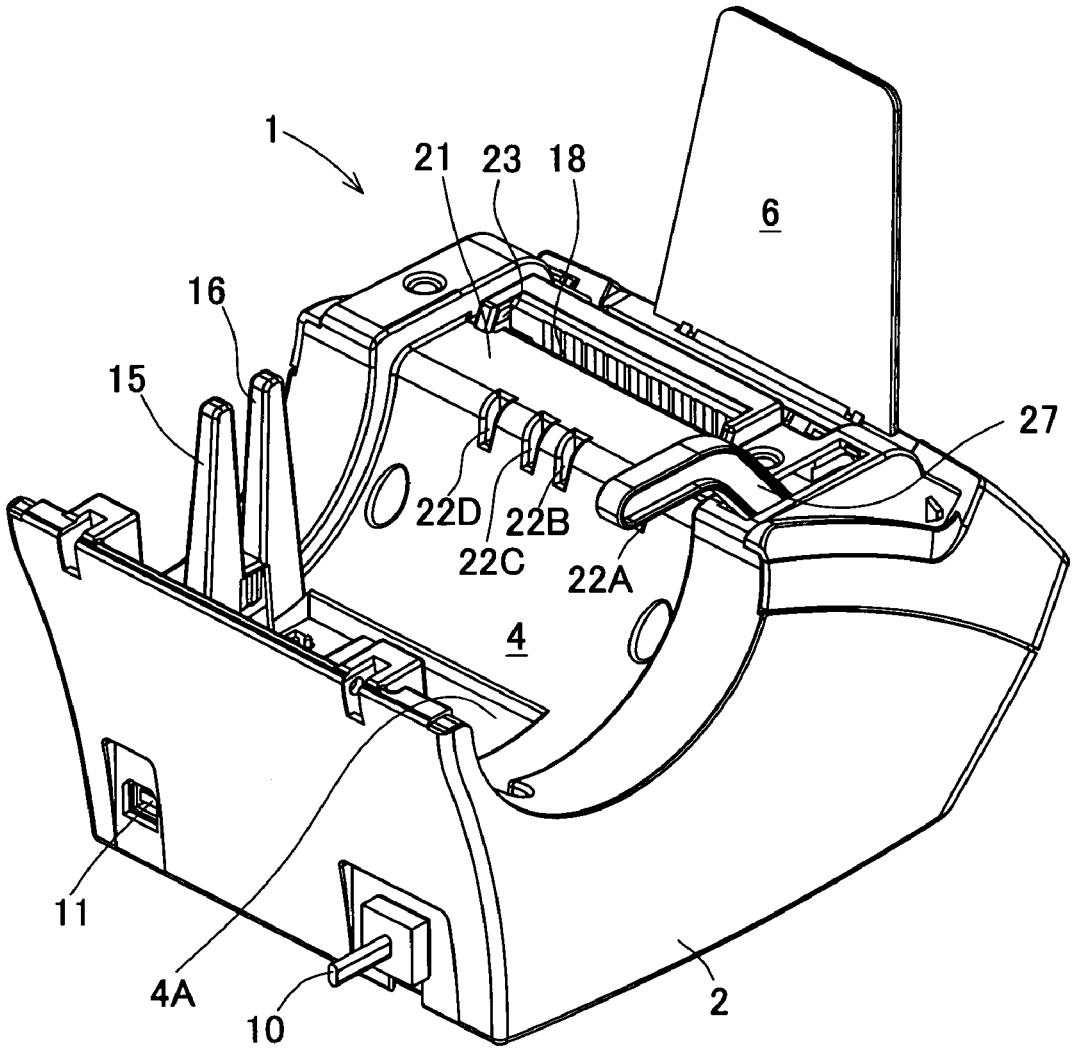
FIG. 6 is a schematic perspective back view of the label printer of which the top cover is removed.
Figure 37A:
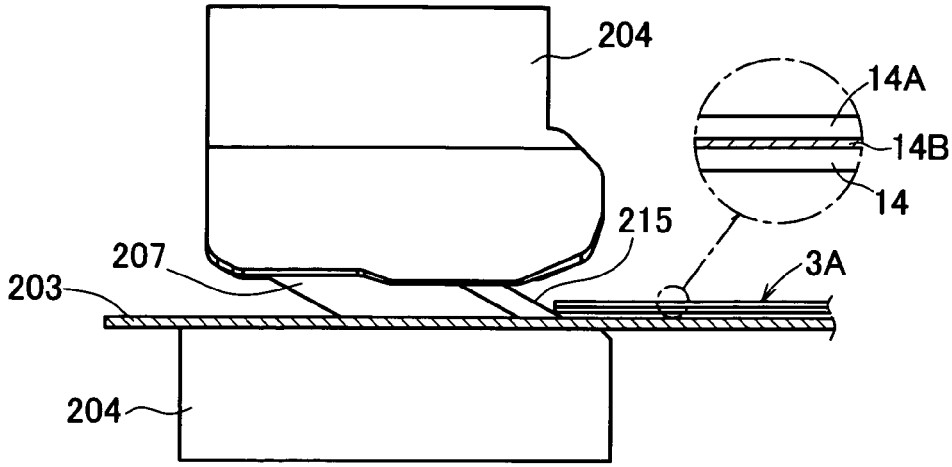
FIGS. 37A to 37C are explanatory views showing movements of an end of a printing medium at the time of cutting by the movable blade of the cutter holder, illustrating a state just after the end of the printing medium contacts with the cutting edge, a state where the end of the printing medium moves along the cutting edge, and a state where the end of the printing medium is in contact with a lower surface of the cutter holder, respectively.

As shown in FIGS. 1 to 3, the label printer 1 includes a housing (a main body) 2, a top cover 5 made of transparent resin attached to the housing 2 at a rear upper edge, a tray 6 made of transparent resin set in a vertical position to face a substantially front center of the top cover 5, a power button 7 placed in front of the tray 6, a cutter lever 9 provided in a front face of the housing 2, and others. The top cover 5 is freely opened and closed, thereby covering an upper part of a roll sheet holder storage part (hereinafter, a "holder storage part") 4 which is a space for receiving a roll sheet holder 3 holding a roll sheet 3A of a predetermined width. The cutter lever 9 is movable side to side to horizontally move a cutter unit 8 (see FIG. 7). A power cord 10 is connected to the housing 2 on a back face near a corner. The housing 2 is provided on the back face near the other corner with a connector part 11 (see FIG. 6) such as a USB (Universal Serial Bus) which is connected to for example a personal computer not shown. The roll sheet 3A is formed of a long thermal sheet (so-called "thermal paper") 14 having a self color development property or a long label sheet formed of the thermal sheet 14 whose one surface is bonded with a release sheet 14A by adhesive 14B, as shown in FIG. 37A mentioned later. The roll sheet 3A is in a wound state around a hollow cylindrical sheet core 3B (see FIG. 4).

As shown in FIG. 3, the tray 6 is provided to stand at an angle of about 60° with respect to a plane, indicated by a chain double-dashed line, parallel to a plane on which the label printer 1 is placed. The angle between the tray 6 and the plane parallel to the plane on which the label printer 1 is placed may be determined in a range of 60° to 90°.

The tray 6 may be made of a U-shaped metallic wire, instead of the transparent resin.

As shown in FIGS. 2 through 6, the label printer 1 is provided with a holder support member 15 in the holder storage part 4 at a side end (a left side end in FIG. 6) in a substantially perpendicular direction to a sheet feeding direction (in which an unwound part of the roll sheet is fed from a rolled portion of the roll sheet to a platen roller mentioned later). The holder support member 15 receives a mounting piece (a positioning rib) 13 of a positioning holding member (hereinafter, a "holding member") 12 constructing the roll sheet holder 3 mentioned later. The mounting piece 13 is provided protruding in a substantially longitudinal rectangular shape on the outer surface of the holding member 12. Specifically, the holder support member 15 is shaped like an angled U-shape as seen in side view of the printer 1, providing a first positioning groove 16 which opens upward in the label printer 1 and toward both side surfaces of the holder support member 15 in a direction of the width of the label printer 1. The holder support member 15 is also formed with a recess 15A which engages an elastic locking piece 12A formed projecting at a lower end of the holding member 12.

Figure 7:
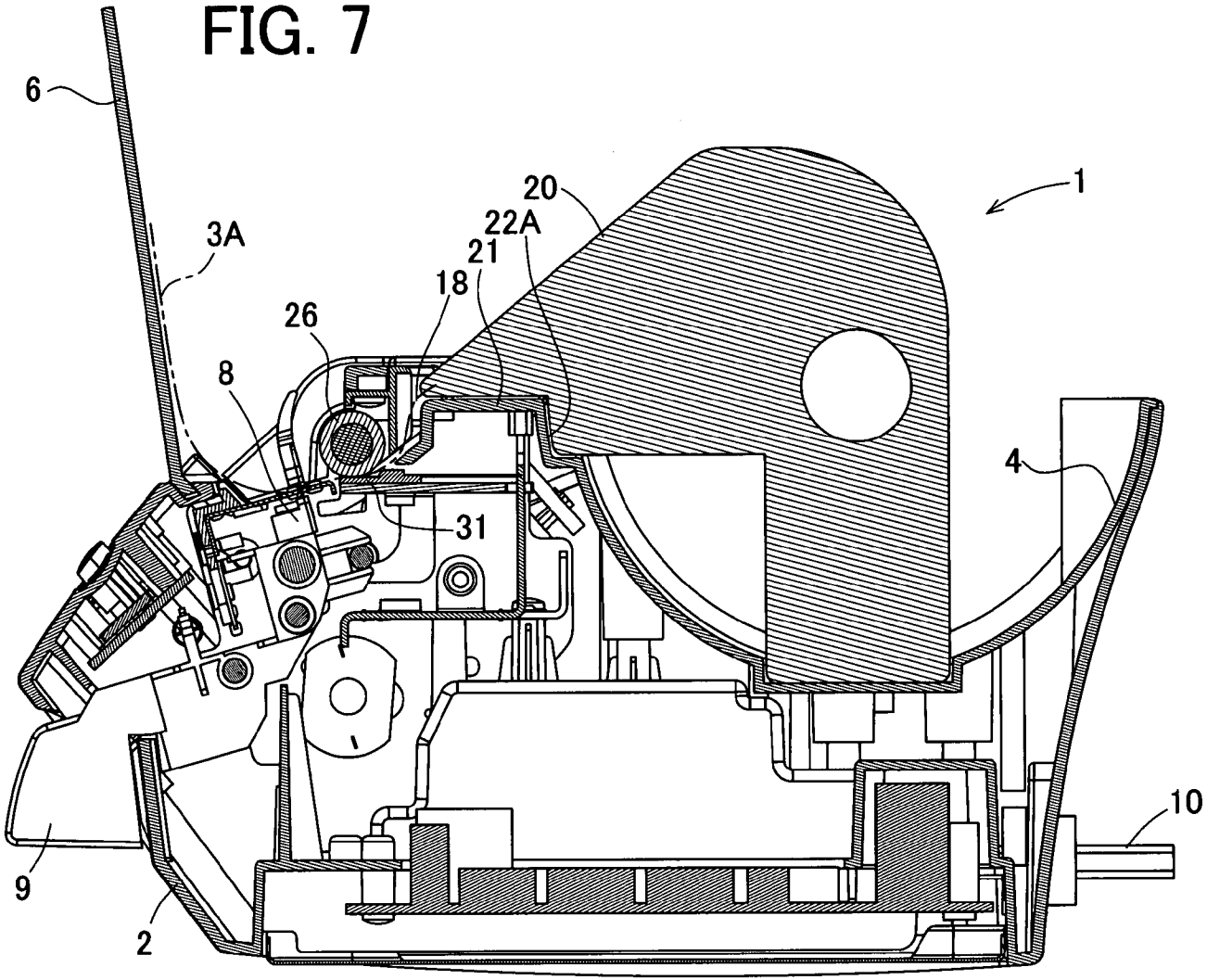
FIG. 7 is a sectional side view of the label printer of which the top cover is removed.

The housing 2 is formed with an insertion port 18 through which a leading end of an unwound part of the roll sheet 3A is inserted into the housing 2. A flat portion 21 is formed substantially horizontal between a rear end (in the feeding direction) of the port 18 and a front upper edge portion of the holder storage part 4. On this flat portion 21, a front end portion of a guide member 20 of the roll sheet holder 3 is placed. The flat portion 21 is provided at a rear corner in the feeding direction with second positioning grooves (four grooves in the present embodiment) 22A to 22D each formed by a substantially L-shaped wall in section and positioned corresponding to each of a plurality of roll sheets 3A of different widths. Each of the second positioning grooves 22A to 22D is configured to fittingly receive a front part of the guide member 20 inserted from above, as shown in FIG. 7. Further, the front end of the guide member 20 of the roll sheet holder 3 extends to the insertion port 18.

Figure 8A:
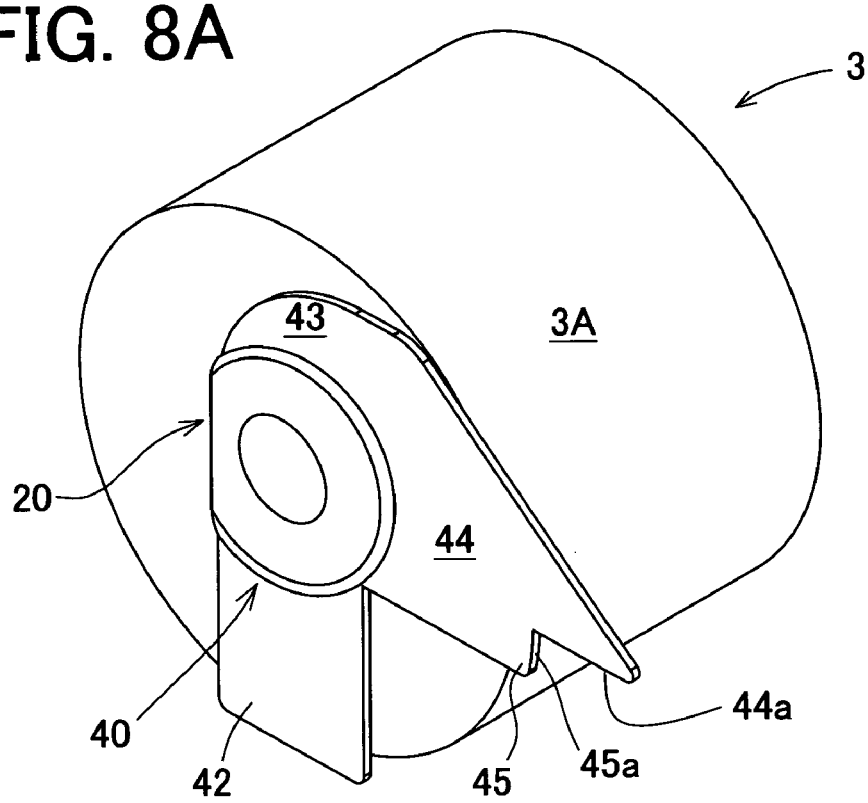
FIG. 8A is a perspective view of a roll sheet holder holding a roll sheet, seen from an obliquely front direction.

A positioning recess 4A is formed in the bottom of the holder storage part 4. The positioning recess 4A is rectangular in plan view and long sideways in a direction substantially perpendicular to the feeding direction, extending from an inner base end of the holder support member 15 to a position corresponding to the second positioning groove 22A. This positioning recess 4A has a predetermined depth (about 1.5 mm to 3.0 mm in the present embodiment). The width of the positioning recess 4A in the feeding direction is determined to be almost equal to the width of each lower end portion of the holding member 12 and the guide member 20. A discrimination recess 4B is provided between the positioning recess 4A and the inner base end of the holder support member 15. This discrimination recess 4B is rectangular in plan view, which is long in the feeding direction, and has a depth larger by a predetermined amount (about 1.5 mm to 3.0 mm in the present embodiment) than the positioning recess 4A. The discrimination recess 4B will receive a sheet discrimination part 60 (see FIG. 8A) mentioned later which extends inward from the lower end of the holding member 12 at a right angle therewith.

In the discrimination recess 4B, there are provided five sheet discrimination sensors S1, S2, S3, S4, and S5 arranged in an L-shaped pattern for distinguishing the kind (e.g., width) of the roll sheet 3A. These sensors S1 to S5 are each constructed of a push type microswitch or the like, specifically, a well known mechanical switch including a plunger and a microswitch. It is detected whether the sheet discrimination part 60 has sensor holes (through holes) 60A (see FIG. 8B), mentioned later, at the positions corresponding to the sheet discrimination sensors S1 to S5 respectively. Based on an ON/OFF signal representing a detection result by the sensors S1 to S5, the kind of the roll sheet 3A held in the roll sheet holder 3 is detected. In the present embodiment, the tape discrimination sensors S1 to S5 are allowed to normally protrude from the bottom surface of the discrimination recess 4B to near the bottom surface of the positioning recess 4A, that is, at the height substantially corresponding to a depth difference between the discrimination recess 4B and the positioning recess 4A. At this time, each microswitch is in an OFF state.

In the case where the sheet discrimination part 60 has some sensor hole(s) 60A to 60E at the positions corresponding to the sheet discrimination sensors S1 to S5, the plunger(s) of the sensor(s) for which the sheet discrimination part 60 has sensor hole(s) is allowed to pass through the associated sensor holes 60A to 60E without depression, leaving the corresponding microswitch(es) in the OFF state, which generates an OFF signal. On the other hand, the plunger(s) of the sensor(s) for which the sheet discrimination part 60 has no sensor hole(s) is depressed, bringing the corresponding microswitch(es) into the ON state, which generates an ON signal.

The insertion port 18 is arranged so that its one side end (a left end in FIG. 6) on the holder support member 15 side in the label printer 1 is positioned substantially in one plane with the inner surface of the holder support member 15 in which the positioning groove 16 opens, more properly, in one plane with the inner surface of the positioning member 12 when engaged in the holder support member 15. In the insertion port 18, a guide rib 23 is formed on the side end near the holder support member 15.

A lever 27 for operating the vertical movement of a thermal head (see FIG. 7) is provided in front of the other side end (a left end in FIG. 5) of the holder storage part 4 in the feeding direction. To be more specific, when the lever 27 is turned up, the thermal head 31 is moved down and separated from a platen roller 26 disposed facing the thermal head 31 (see FIG. 7). When the lever 27 is turned down, to the contrary, the thermal head 31 is moved up, thereby pressing the unwound part of the roll sheet 3A against the platen roller 26. A printable condition is thus developed. Further, below the holder storage part 4, there is provided a control board 32 on which a control circuit is formed to drive and control each mechanism in response to commands from an external personal computer and others.

The roll sheet holder 3 in which the roll sheet 3A wound on the sheet core 3B is removably set in the holder storage part 4 in the following manner. The mounting piece 13 of the positioning member 12 is inserted from above into the first positioning groove 16 of the holder support member 15. The elastic locking piece 12A formed projecting at the lower end of the positioning member 12 is then engaged in the locking recess 15A formed in the inner base end of the holder support member 15. A front lower portion (i.e., a fourth extended portion 45 mentioned later) of the guide member 20 is engaged in appropriate one of the second positioning grooves 22A to 22D and the lower end portion of the guide member 20 is fittingly inserted in the positioning recess 4A. The lever 27 is turned upward and a leading end of an unwound part of the roll sheet 3A is inserted into the insertion port 18 while one side edge of the unwound part of the roll sheet 3A is held in contact with the inner surface of the guide member 20 and the other side edge is held in contact with the guide rib 23 provided at the side end of the insertion port 18. Thereafter, the lever 27 is moved down. Printing is thus enabled.

As shown in FIG. 7, when the lever 27 is moved down, the part of the roll sheet 3A inserted in the insertion port 18 is pressed against the platen roller 26 by means of the thermal head 31 of a line type. The platen roller 26 is driven to rotate by a step motor or the like not shown while the thermal head 31 is drivingly controlled to print image data on a print surface of the roll sheet 3A which is fed sequentially. This printing is made on the printing surface which faces downward and is pressed by the thermal head 31. The printed part of the roll sheet 3A is discharged with the printed surface facing downward onto the tray 6 through between the top cover 5 and the housing 2. The printed part of the roll sheet 3A discharged onto the tray 6 is cut by a cutter unit 8 when the user moves the cut lever 9 rightward.

A schematic structure of the roll sheet holder 3 is explained below with reference to FIGS. 8 through 12.

As shown in FIG. 8 through 12, the roll sheet holder 3 is constructed of the guide member 20, the holding member 12, and a holder shaft 40 of a substantially tube shape. The guide member 20 has a first cylindrical part 35 which is fitted in one open end of the sheet core 3B of the roll sheet 3A so that the guide member 20 is held in contact with one of the end faces of the roll sheet 3A. The holding member 12 has a second cylindrical part 37 which is fitted in the other open end of the sheet core 3B so that the holding member 12 is held in contact with the other end face of the roll sheet 3A. The holder shaft 40 has two open ends 40*a* and 40*b*; the one end 40*a* is fitted in the first cylindrical part 35 of the guide member 20 and formed with a radially extended flange part 36 fixed onto the outer surface of the guide member 20 and the other end 40*b* is fixedly fitted in the second cylindrical part 37 of the holding member 12. The holder shaft 40 may be selected from among a plurality of shafts of different lengths to easily provide many kinds of roll sheet holders 3 holding roll sheets 3A of different widths.

The guide member 20 further includes a first, second, third, and fourth extended portions 41, 42, 43, and 44. The first extended portion 42 is formed extending downward in a predetermined length from a lower periphery of an outer end face of the first cylindrical part 35. This first extended portion 42 is fitted in the positioning recess 4A formed in the bottom of the holder storage part 4 so that the lower end surface of the first extended portion 42 is brought in contact with the bottom surface of the positioning recess 4A. The second extended portion 43 is formed extending upward to cover a front quarter round of the end face of the roll sheet 3A. The third extended portion 44 is formed continuously extending from the second extended portion 43 up to near the insertion port 18 (see FIG. 6) and has an upper edge sloped downward to the front end. This third extended portion 44 further has a lower edge (44*a*) extending horizontally, which is held in contact with the flat portion 21 of the label printer 1 so that one side edge of the unwound part of the roll sheet 3A is guided along the inner surfaces of the second and third extended portions 43 and 44 up to the insertion port 18. The fourth extended portion 45 is formed under the third extended portion 44 between the rear end of the lower edge 44*a* at a predetermined distance from the front end and the first extended portion 42. When the lower edge 44*a* of the third extended portion 44 is held in contact with the flat portion 21, a front edge (45*a*) of the fourth extended portion 45 is inserted in appropriate one of the second positioning grooves 22A to 22D corresponding to the sheet width of the roll sheet 3A set in the sheet holder 3 (see FIG. 7).

The guide member 20 is further formed with slits 47 of a substantially rectangular shape in side view of the guide member 20, at an upper end of the first extended portion 42, i.e., at diametrical opposed positions of the periphery of the outer end face of the first cylindrical part 35. In these slits 47, protrusions 48 formed on the inner surface of the flange part 36 of the holder shaft 40 are engaged for positioning. In the guide member 20, scales 43A, 43B, and 43C are provided in concentric circular lines on the inner surfaces of the extended portions 43, 44, and 45. These scales 43A to 43C indicate the winding lengths of the roll sheet 3A; 10 m, 20 m, and 30 m. In the present embodiment, the maximum winding length of the roll sheet 3A set in the roll sheet holder 3 is about 30 m.

The holder shaft 40 is provided with a slit 51 in the end portion fitted in the second cylindrical part 37 of the holding member 12. The slit 51 has a predetermined length along the long direction of the shaft 40 to engage a rib 50 formed protruding radially inward from the inner lower end of the second cylindrical part 37. Such engagement between the rib 50 of the holding member 12 and the slit 51 of the holder shaft 40 makes it possible to correctly position the holding member 12 and the guide member 20 with respect to each other through the holder shaft 40. The first and second cylindrical parts 35 and 37 serve to rotatably support the sheet core 3B of the roll sheet 3A. The holder shaft 40 may be selected from among a plurality of shafts (four shafts in the present embodiment) of different lengths individually corresponding to the lengths of the sheet cores 3B (i.e., the widths of the roll sheets 3A).

The outer open end of the second cylindrical part 37 is closed by the positioning member 12. A flange 55 is formed around the second cylindrical part 37. An extended portion 56 is continuously formed under the flange 55. Respective inner surfaces of the flange 55 and the extended portion 56 are held in contact with the end face of the roll sheet 3A and the sheet core 3B. On the outer surfaces of the flange 55 and the extended portion 56, the longitudinal mounting piece (positioning rib) 13 is provided protruding outward, at substantially the center of the width of the positioning member 12 in the feeding direction (a lateral direction in FIG. 10A). This mounting piece 13 is of a substantially rectangular section and a width which becomes smaller in a downward direction so that the mounting piece 13 is fitted in the first positioning groove 16 having a narrower width (in the feeding direction) towards the bottom of the holder support member 15 in the label printer 1. The protruding distance of the mounting piece 13 is determined to be almost equal to the width (in a direction of the width of the label printer 1, perpendicular to the feeding direction) of the first positioning groove 16.

The mounting piece 13 of the positioning member 12 is provided, on the lower outer surface, with a guide portion 57 of a square flat plate (about 1.5 mm to 3.0 mm in thickness in the present embodiment) having a larger width than the lower portion of the mounting piece 13 by a predetermined amount (about 1.5 mm to 3.0 mm in the present embodiment) at each side of the lower portion. Accordingly, to mount the roll sheet holder 3 in the label printer 1, the user inserts the mounting piece 13 from above into the first positioning groove 16 by bringing an inner surface of the guide portion 57 into sliding contact with the outer surface of the holder support member 15. Thus, the roll sheet holder 3 can easily be fitted in place.

Figure 8B:
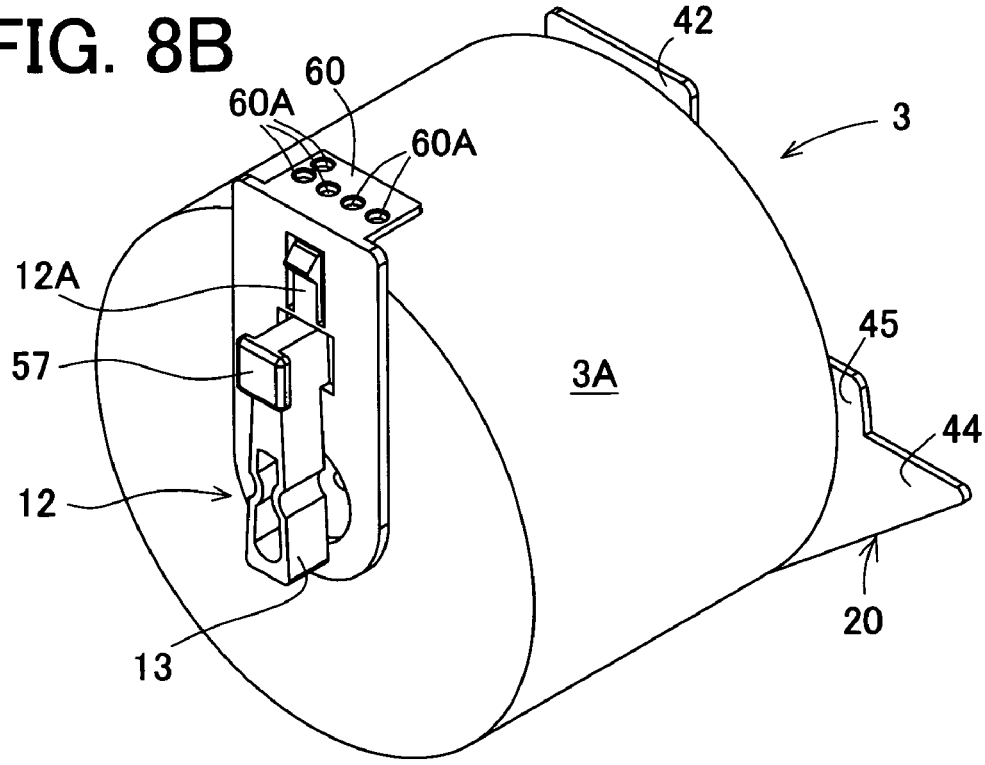
FIG. 8B is a perspective view of the roll sheet holder turned upside down, seen from an obliquely front direction.
Figure 9B:
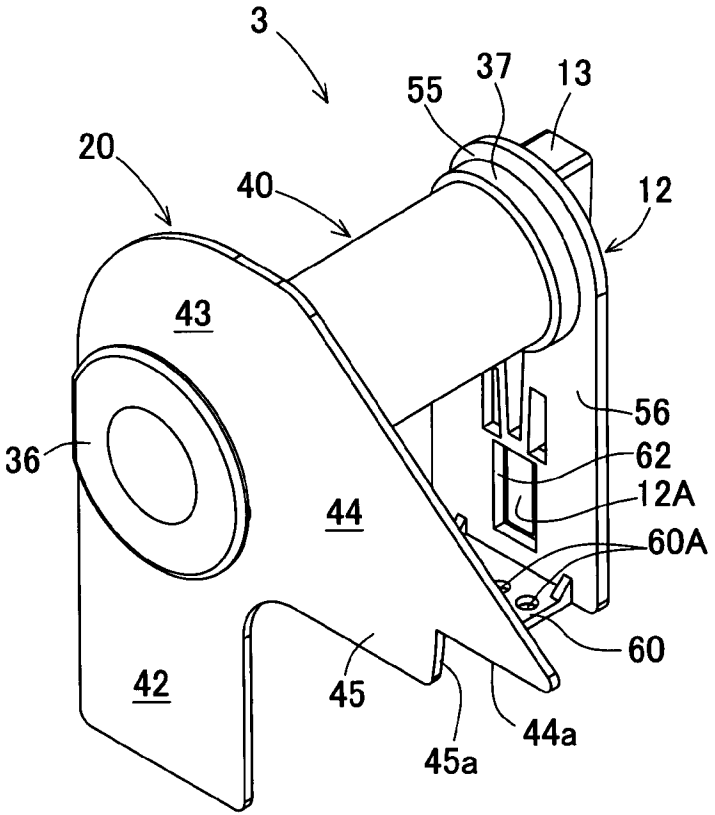
FIG. 9B is a perspective view of the roll sheet holder seen from an obliquely front direction.
Figure 9A:
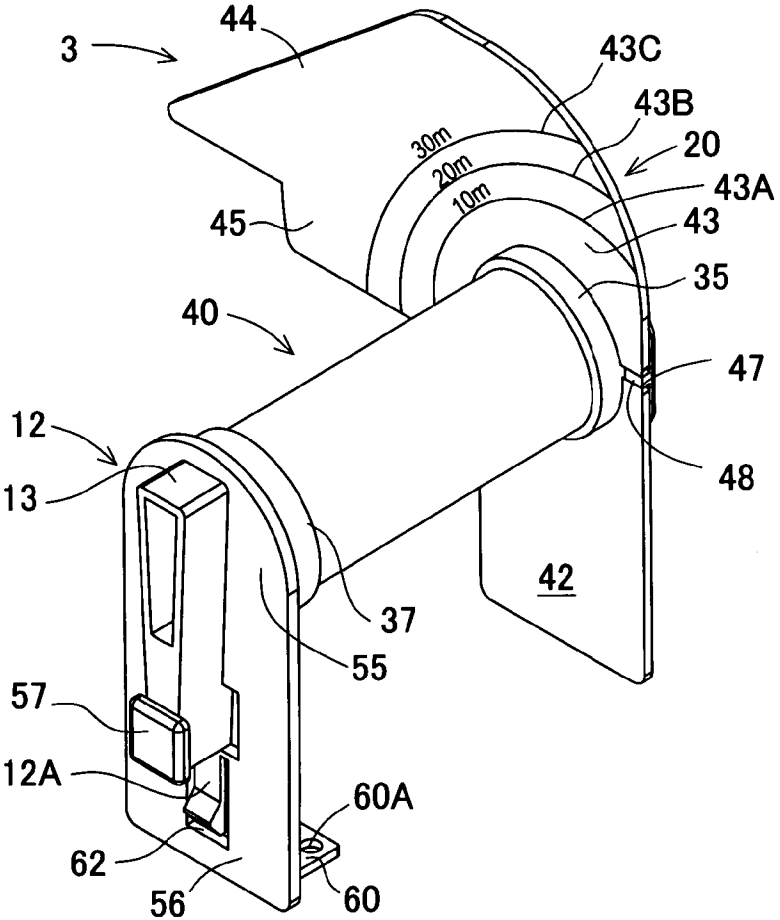
FIG. 9A is a perspective view of the roll sheet holder seen from an obliquely back direction.
Figures 10A, 10B, 10C:
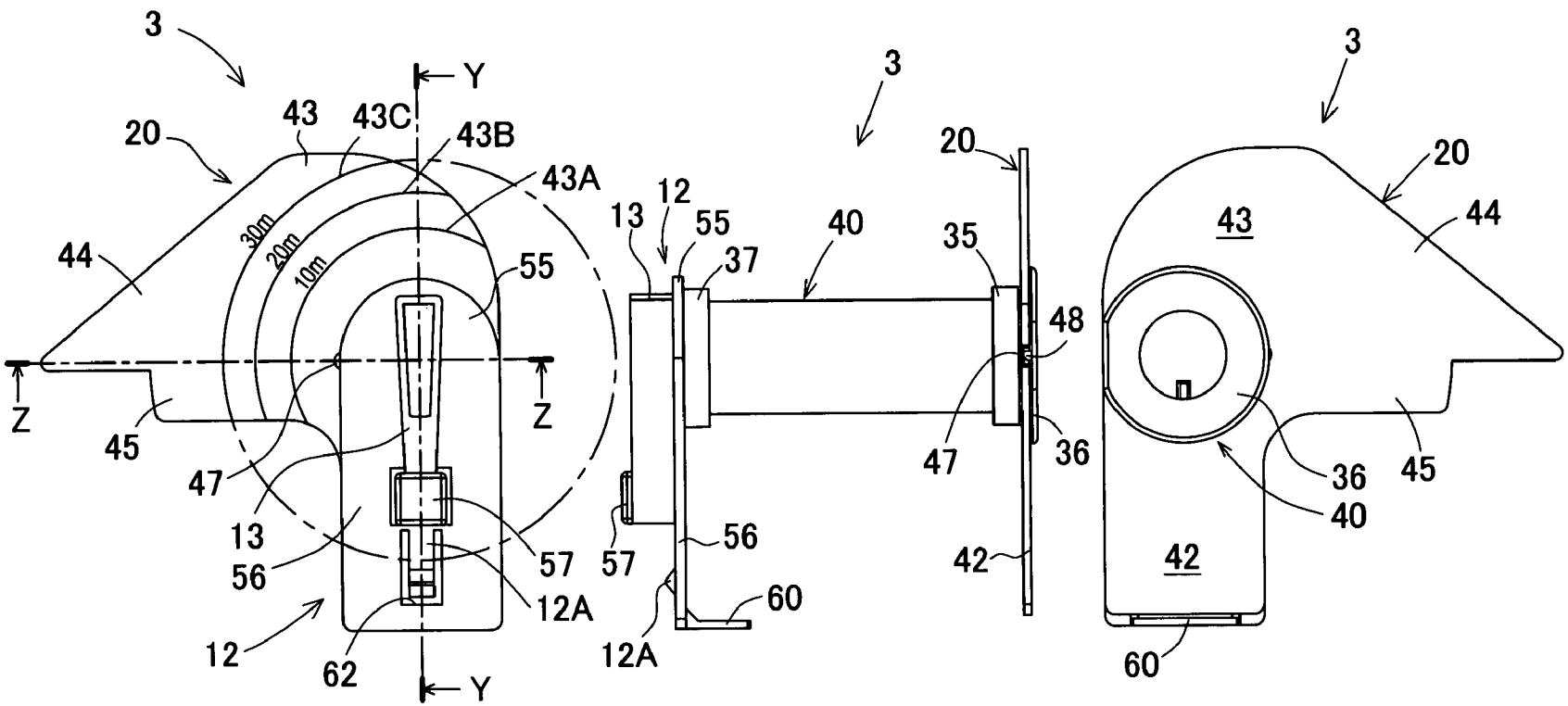
FIG. 10A is a side view of the roll sheet holder seen from left of the roll sheet holder in FIG. 10B.
FIG. 10B is a back view of the roll sheet holder.
FIG. 10C is a side view of the roll sheet holder seen from right of the roll sheet holder in FIG. 10B.
Figure 11:
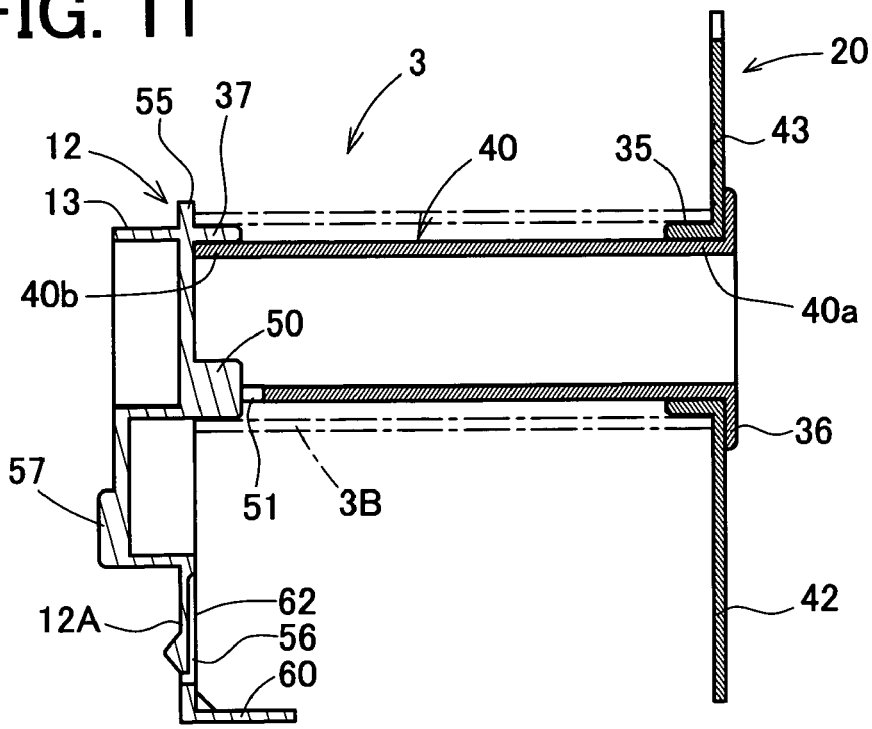
FIG. 11 is a sectional view of the roll sheet holder taken along a line Y-Y in FIG. 10A.
Figure 12:
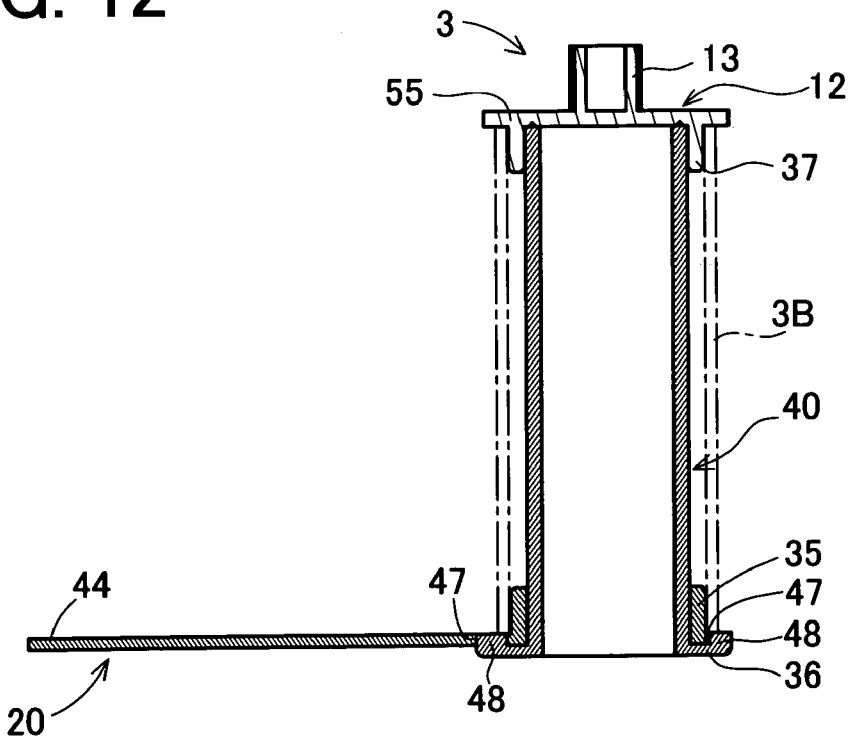
FIG. 12 is a sectional view of the roll sheet holder taken along a line Z-Z in FIG. 10A.

The positioning member 12 is designed to have the extended portion 56 extending downward longer by a predetermined length (about 1.0 mm to 2.5 mm in the present embodiment) than the lower end (the first extended portion 42) of the guide member 20. The positioning member 12 is also provided, at the lower end of the extended portion 56, with a sheet discrimination part 60 of a substantially rectangular shape extending inward by a predetermined length at almost right angle to the extended portion 56. As mentioned above, the sheet discrimination part 60 is formed with the sensor holes 60A arranged at predetermined positions corresponding to the sheet discrimination sensors S1 to S5 respectively. In FIG. 8B, five sensor holes 60A are arranged at predetermined positions for the kind of the roll sheet 3A set in the holder 3.

The positioning member 12 is further formed with a longitudinally rectangular through hole 62 in the extended portion 56 under the mounting piece 13. The elastic locking piece 12A is provided extending downward from the upper edge of the through hole 62 and formed with an outward protrusion at a lower end.

Figure 13B:
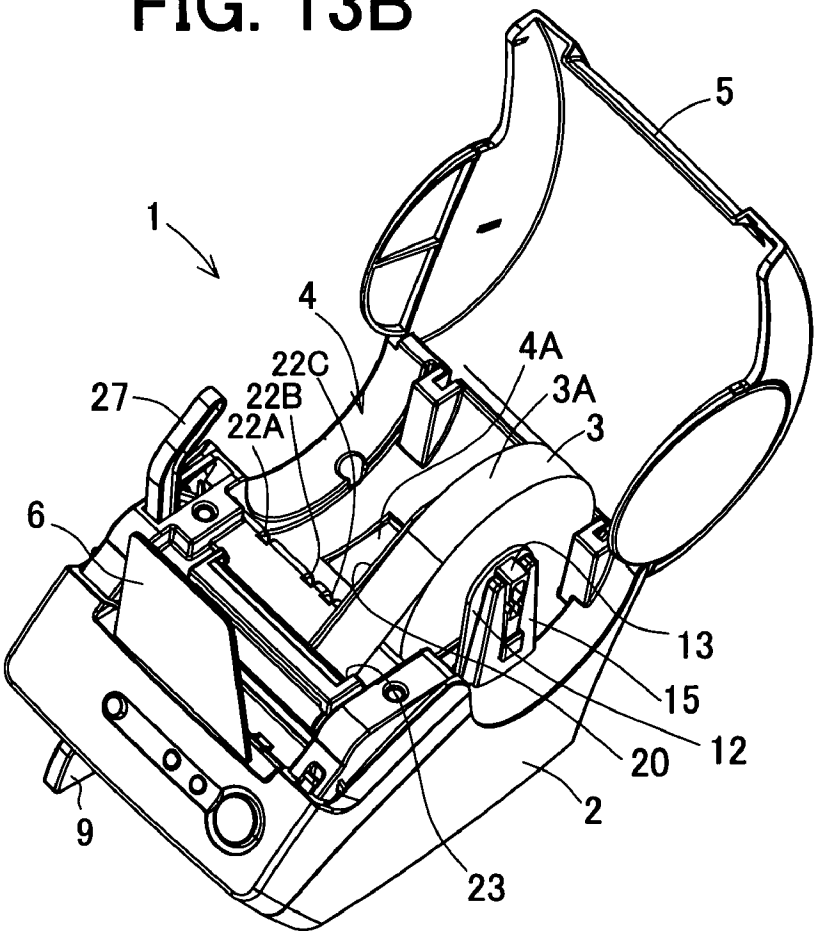
FIG. 13B is a perspective view of the label printer in which the roll sheet holder for a minimum roll sheet width is mounted.
Figure 13A:
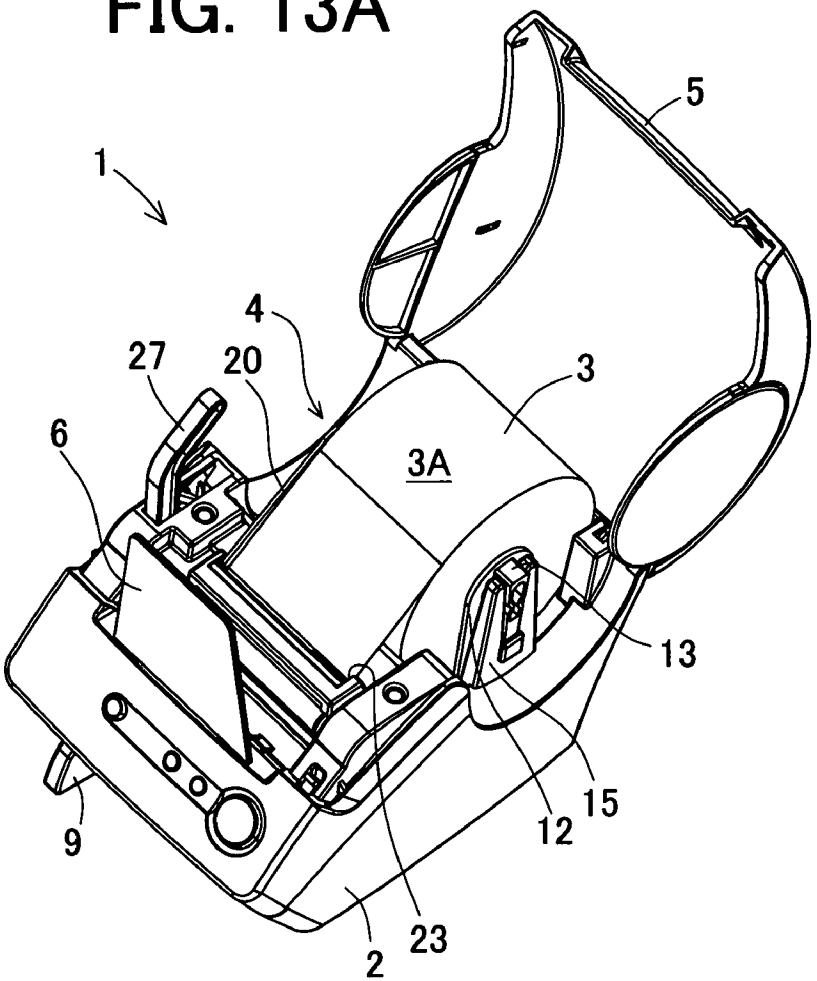
FIG. 13A is a perspective view of the label printer in which the roll sheet holder for a maximum roll sheet width is mounted.

An explanation is given to a mounting manner of the roll sheet holder 3 constructed as above in the label printer 1, referring to FIGS. 13A and 13B.

FIG. 13A shows the case where the roll sheet 3A holds a roll sheet 3A of a maximum width wound on a hollow cylindrical sheet core 3B. The mounting piece 13 of the holding member 12 of the holder 3 is first inserted from above into the positioning groove 16 of the holder support member 15. The holder 3 is put so that the lower edge 44*a* of the third extended portion 44 of the guide member 20 is brought into contact with the flat portion 21. The fourth extended portion 45 is engaged in the second positioning groove 22A formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess 4B formed at a position inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

Subsequently, the lever 27 is turned upward and then part of the roll sheet 3A is drawn (unwound) and the leading end of the unwound part of the roll sheet 3A is inserted into the insertion port 18 while one side edge of the unwound part of the roll sheet 3A is held in contact with the inner surface of the guide member 20 and the other side end is held in contact with the protruding guide rib 23 provided on the side end of the insertion port 18. Thereafter, the lever 27 is turned down. The inserted portion of the roll sheet 3A is thus pressed against the platen roller 26 by the thermal head 31, bringing the roll sheet 3A into a printable state.

FIG. 13B shows the case where the roll sheet holder 3 holds a roll sheet 3A of a minimum width wound on a hollow cylindrical sheet core 3B. The mounting piece 13 of the holding member 12 of the holder 3 is first inserted from above into the positioning groove 16 of the holder support member 15. The sheet holder 3 is put so that the lower edge 44*a* of the third extended portion 44 of the guide member 20 is brought into contact with the flat portion 21. The fourth extended portion 45 is engaged in the second positioning groove 22D formed at the rear corner of the flat portion 21 in the feeding direction. The first extended portion 42 of the guide member 20 is fitted in the positioning recess 4A of the holder storage part 4 so that the lower end face of the first extended portion 42 is brought into contact with the bottom surface of the positioning recess 4A. Simultaneously, the sheet discrimination part 60 is fitted in the discrimination recess inwardly adjacent to the base end of the holder support member 15 and the elastic locking piece 12A is engaged in the recess 15A formed in the base end of the holder support member 15. Thus, the roll sheet holder 3 is mounted in the holder storage part 4 to be freely removable therefrom.

Subsequently, the lever 27 is turned upward and then part of the roll sheet 3A is drawn (unwound) and the leading end of the unwound part of the roll sheet 3A is inserted into the insertion port 18 while one side edge (a first edge) of the unwound part of the roll sheet 3A is held in contact with the inner surface of the guide member 20 and the other side edge (a second edge) is held in contact with the protruding guide rib 23 provided on the side end of the insertion port 18. Thereafter, the lever 27 is turned down. The inserted portion of the roll sheet 3A is thus pressed against the platen roller 26 by the thermal head 31, bringing the roll sheet 3A into a printable state.

In both cases of the roll sheet 3A of the maximum width as shown in FIG. 13A and the other roll sheet 3A of the minimum width as shown in FIG. 13B, the second edge of the roll sheet 3A is brought into contact with the guide rib 23 on the side end of the insertion port 18. The same applies to the case of another roll sheet 3A of any intermediate width between the maximum width and the minimum width. In other words, when the roll sheet holder 3 is mounted in the holder storage part 4, the second edge of the roll sheet 3A contacts with the guide rib 23 without fail, regardless of the width of the roll sheet 3A set in the roll sheet holder 3. The position of the guide rib 23 provided in the housing 2 corresponds to a common reference 501 (see FIG. 32 and subsequent figures).

Next, a concrete embodiment of the label printer according to the present invention will be described with reference with the accompanied drawings.

Figure 14:
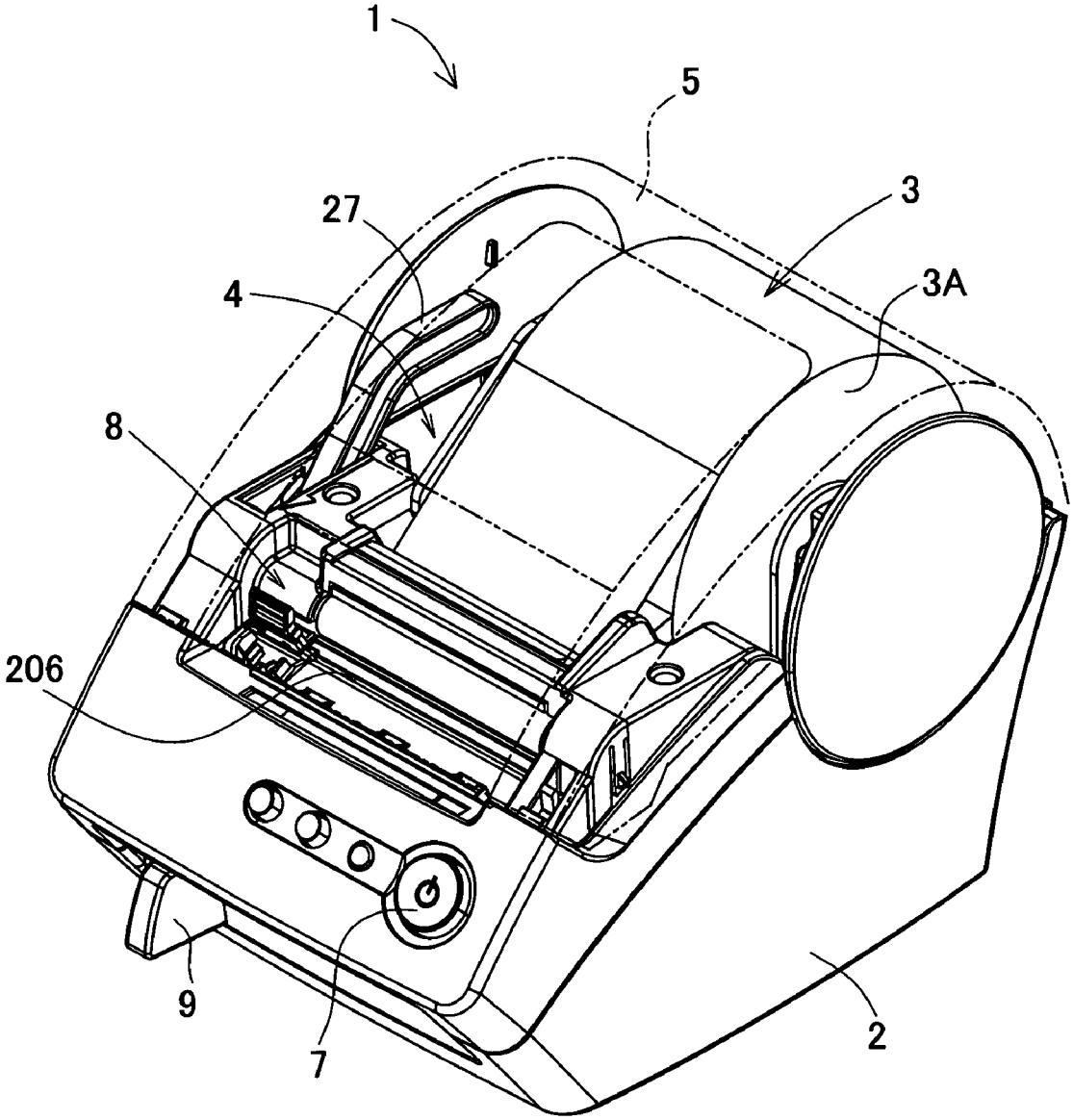
FIG. 14 is a schematic perspective view of the label printer in the embodiment.

FIG. 14 is a schematic perspective view of the label printer 1 in the present embodiment. As shown in FIG. 14, the label printer 1 includes the housing 2, the top cover 5 made of transparent resin attached to the housing 2 at a rear upper edge, the tray 6 made of transparent resin set in a vertical position to face a substantially front center of the top cover 5, the power button 7 placed in front of the cover 5, and others. The top cover 5 is freely opened and closed, thereby covering an upper part of the holder storage part 4 which is a space for receiving the roll sheet holder 3 holding the roll sheet 3A of a predetermined width.

In the label printer 1 shown in FIG. 14, the tray 6 (see FIG. 1) made of transparent resin set in a vertical position to face a substantially front center of the top cover 5 is removed.

Figure 15:
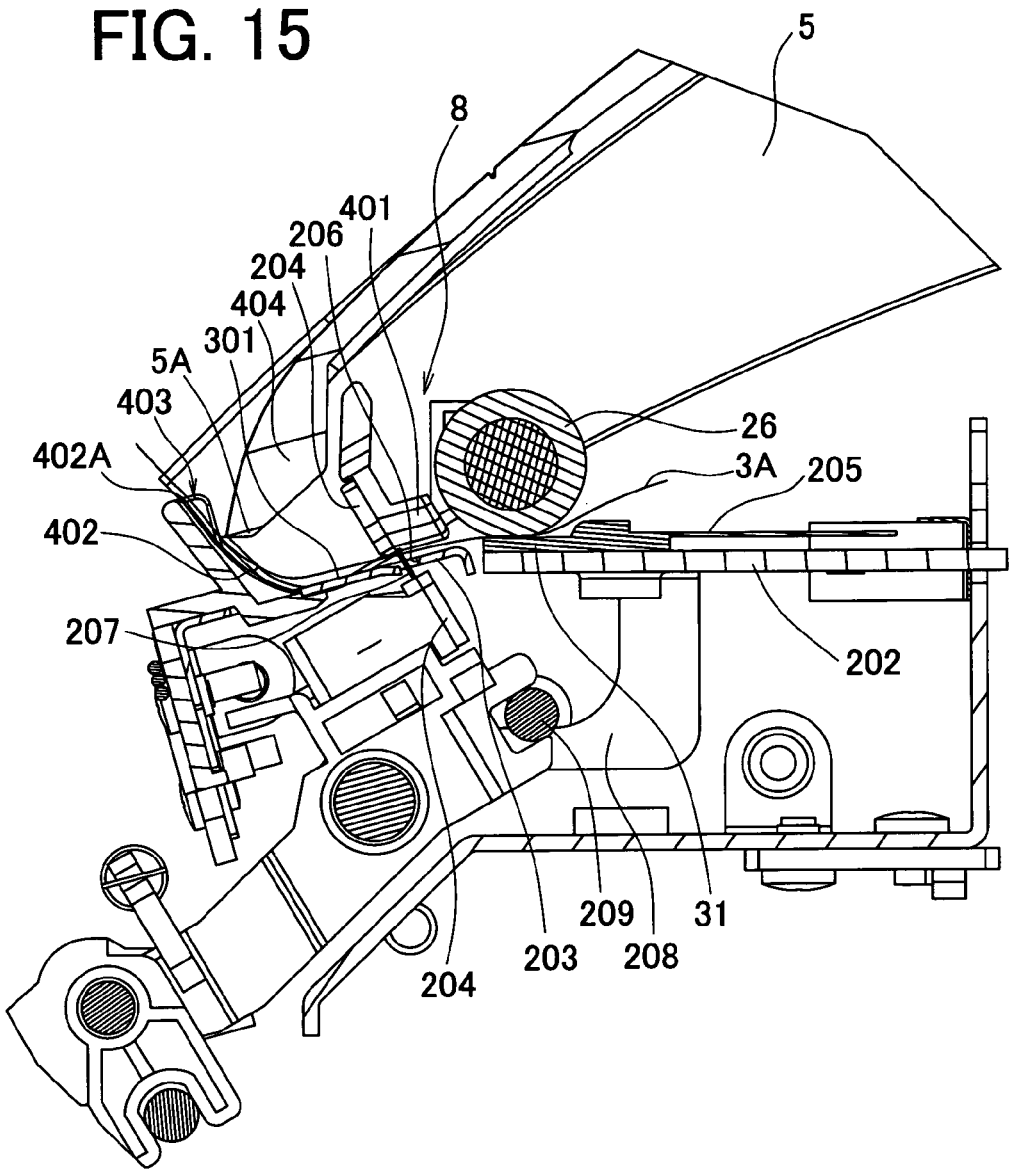
FIG. 15 is a sectional view of a cutter unit and its periphery in the label printer.

Next, schematic structures of the cutter unit 8 and its periphery will be described referring to the drawings. FIG. 15 is a sectional view of the cutter unit 8 and its periphery. As shown in FIG. 15, the cutter unit 8 includes a platen roller 26, a heatsink 202, a cutter plate 203, a pair of upper and lower cutter holders 204, and others.

The platen roller 26 is driven to rotate by an unillustrated stepping motor and the like. Further, on the upper surface of the heatsink 202 opposed to the platen roller 26, a thermal head 31 and a FPC substrate 205 of the thermal head 31 are fixed. Further, the upper surface of the cutter plate 203 that constitutes a feeding surface 301 on which the roll sheet 3A is slidable is formed with a passage groove 206 extending in parallel with the platen roller 26 in such a manner that the cutter holder 204 reciprocates along the passage groove 206. To the cutter holder 204, a movable blade 207 for cutting the roll sheet 3A is attached so as to penetrate the passage groove 206 in a vertical direction. Further, a rear rib 401 is provided to the upper cutter holder 204 so as to project toward the platen roller 26. A discharge guide 402 is provided successively to the cutter plate 203 at an opposite side of the platen roller 26 so as to curve upward from the level in flush with the feeding surface 301 of the cutter plate 203. Further, one end surface 402A of the discharge guide 402 projects upward from one end surface 5A of the top cover 5. A space created between the discharge guide 402 and the one end surface 5A of the top cover 5 opposed to each other forms a discharge port 403 for discharging the roll sheet 3A. Inside the top cover 5, a plurality of upper ribs 404 are provided in an upright posture. The plurality of upper ribs 404 are provided around the discharge port 403.

Further, FIG. 15 shows a state where the thermal head 31 is pressed to be urged against the platen roller 26, and shows the cutter plate 203 in section. In this state, the top end of the thermal head 31 is located slightly above the feeding surface 301 of the cutter plate 203. On the other hand, although not illustrated in the drawings, in the state where the thermal head 31 is distanced from the platen roller 26, the top end of the thermal head 31 is located below the feeding surface 301 of the cutter plate 203.

An urging force of the heatsink 202 is applied to the thermal head 31 fixed on the upper surface of the heatsink 202 by an unillustrated spring and the like. As a result of this, the thermal head 31 is pressed to be urged against the platen roller 26 as shown in FIG. 15. Then, when the lever 27 (see FIG. 14 and the like) is turned upward, the top ends of a pair of lower interfering members 208 provided at opposite ends of the heatsink 202 are interfered by a release shaft 209 which rotates in accordance with the movement of the lever 27 (see FIG. 14 and the like). Thus, the thermal head 31 is distanced from the platen roller 26. On the other hand, when the lever 27 (see FIG. 14 and the like) is turned downward, the top ends of the pair of lower interfering members 208 provided at opposite ends of the heatsink 202 by the release shaft 209 which turns in accordance with the movement of the lever 27 (see FIG. 14 and the like) are released from the interference. As a result, the thermal head 31 can be brought into a state where it is in press contact with the platen roller 26.

Figure 16:
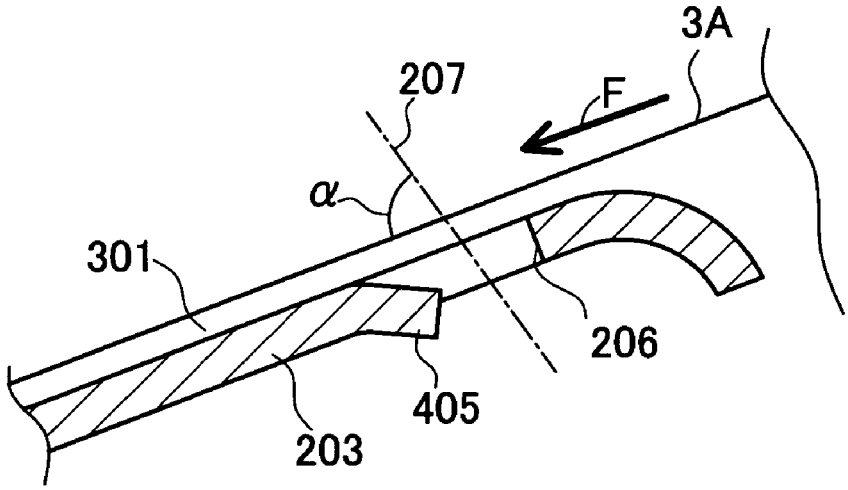
FIG. 16 is an enlarged view of a passage groove and its periphery in the cutter unit.

FIG. 16 shows the passage groove 206 formed on the cutter plate 203 and its periphery, and the cutter plate 203 and the like is shown in section. As shown in FIG. 16, the movable blade 207 for cutting the roll sheet 3A is inclined at an angle $\alpha$ of 15° with respect to the roll sheet 3A in the direction F of feeding the roll sheet 3A which is slid on the feeding surface 301 of the cutter plate 203, and is held at this state in the cutter holder 204 (see FIG. 15).

Further, in the passage groove 206 formed on the cutter plate 203, an end portion 405 at the downstream side along the direction of feeding the roll sheet 3A is inclined downward with respect to the feeding surface 301 of the cutter plate 203.

In the above-described arrangement, in the label printer 1 according to this embodiment, the roll sheet 3A is inserted into the space between the thermal head 31 and the platen roller 26, and from this state, the thermal head 31 is brought into a state where it is pressed to be urged against the platen roller 26. Then, the platen roller 26 is driven to rotate by an unillustrated stepping motor and the like. As a result, the roll sheet 3A is sent toward the feeding direction F while sliding on the feeding surface 301 of the cutter plate 203. At this time, images can be printed on heat-sensitive paper by driving the thermal head 31.

In fact, in the label printer 1 of this embodiment, the roll sheet 3A is wound into a roll in such a manner that its heat-sensitive surface becomes inside. Therefore, when unwound, the roll sheet 3A tends to round toward its heat sensitive surface. Further, as shown in FIG. 15, the thermal head 31 for printing on the heat-sensitive surface of the roll sheet 3A is located below the platen roller 26. Therefore, when the roll sheet 3A is sent out from the space between the thermal head 31 and the platen roller 26, this roll sheet 3A, due to its rounding tendency, slides on the feeding surface 301 of the cutter plate 203 while keeping a posture slightly curved downward. Thus, when this roll sheet 3A slides on the feeding surface 301 of the cutter plate 203, the roll sheet 3A will slide on the feeding surface 301 of the cutter plate 203 in a state where at least the top end of the roll sheet 3A slides on the feeding surface 301 of the cutter plate due to the rounding tendency imparted to the roll sheet 3A. In this movement of the roll sheet 3A, it is anticipated that the top end of the roll sheet 3A will snag on the passage groove 206.

In the label printer 1 of this embodiment, however, as shown in FIG. 16, in the passage groove 206 formed on the cutter plate 203, the end portion 405 at the downstream side along the direction of feeding the roll sheet 3A is inclined downward with respect to the feeding surface 301 of the cutter plate 203. Due to this arrangement, when the roll sheet 3A is sent out and the top end of the roll sheet 3A comes inside the passage groove 206, the top end or the top end portion of the roll sheet 3A is in contact with the end portion 405 and guided by the end portion 405 to reach the feeding surface 301 of the cutter plate 203. As a result, the top end of the roll sheet 3A never snags on the passage groove 206 and the occurrence of paper jam caused by the top end of the roll sheet 3A snagged on the passage groove 206 can be prevented.

Further, in the label printer 1 of this embodiment, when the roll sheet 3A is fed toward the feeding direction F while sliding on the feeding surface 301 of the cutter plate 203, the roll sheet 3A slides along the feeding surface of the cutter plate 203 to the discharge guide 402, and then is discharged from the discharge port 403. At this time, even if the top end of the roll sheet 3A starts to come away from the discharge guide 402 and does not move toward the discharge port 403, the top end or the top end portion of the roll sheet 3A is in contact with the plurality of upper ribs 404 provided in an upright posture around the discharge port 403 inside the top cover 5 and is guided by these ribs 404. Thus, the top end of the roll sheet 3A is introduced to reach the discharge port 403. In this manner, the top end of the roll sheet 3A never snags in the vicinity of the discharge port 403, and the occurrence of paper jam caused by the top end of the roll sheet 3A snagged in the vicinity of the discharge port 403 can be prevented.

Figure 18:
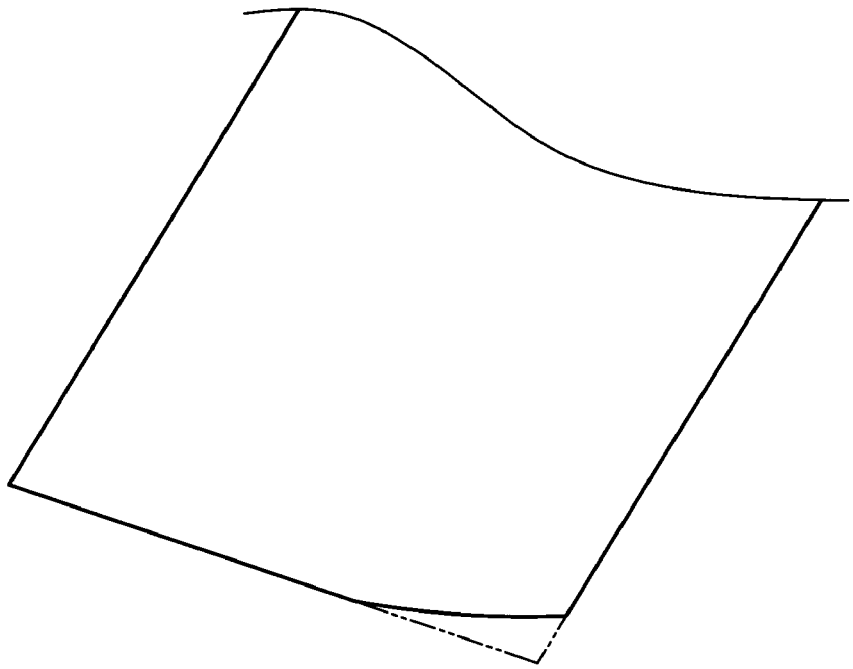
FIG. 18 is a view showing an example of a roll sheet with a curved cut end.
Figure 20:
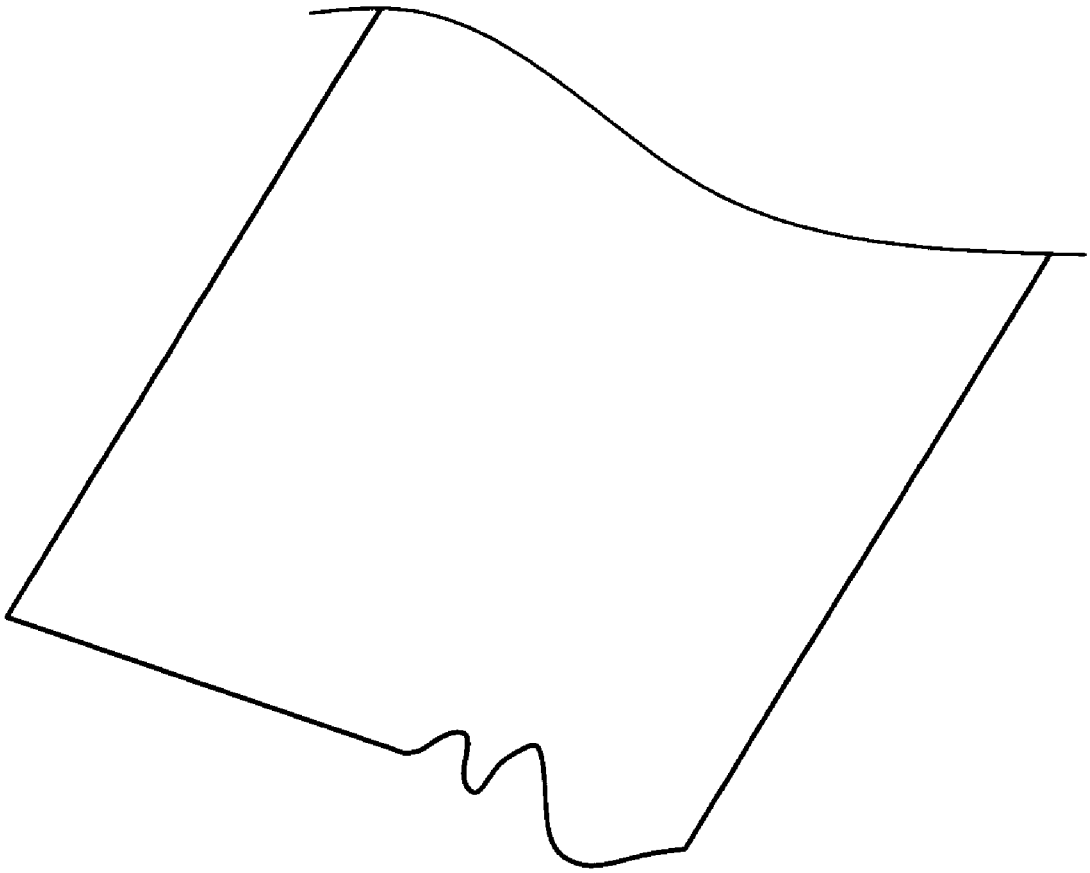
FIG. 20 is a view showing an example of a roll sheet with a cut end in a snake form.

Further, in the label printer 1 of this embodiment, as a result that the roll sheet 3A is sent out, the roll sheet 3A is fed in a state where it is placed on the feeding surface 301 of the cutter plate 203 and the discharge guide 402. On this regard, the discharge guide 402 curves upward from the level in flush with the feeding surface 301 of the cutter plate 203. Due to this structure, when the roll sheet 3A slides along the curved surface of the discharge guide 402 which rises obliquely upward, the roll sheet 3A also curves accordingly. Due to this curvature, a tension for allowing the roll sheet 3A to tightly adhere to the feeding surface 301 of the cutter plate 203 is exerted to the roll sheet 3A itself. After the top end portion of a predetermined length of the roll sheet 3A is discharged from the discharge port 403, the rotation of the platen roller 26 by an unillustrated stepping motor and the like is stopped to cut the roll sheet 3A into a print label. Even when this state is established, the roll sheet 3A curves. Due to this curvature, a tension for allowing the roll sheet 3A to tightly adhere to the feeding surface 301 of the cutter plate 203 is exerted to the roll sheet 3A itself. Therefore, after that, the movable blade 207 vertically penetrating the passage groove 206 formed on the feeding surface 301 of the cutter plate 203 is reciprocated so as to cut the roll sheet 3A into a print label. During this operation, since the roll sheet 3A is stable in a state where it is in tight contact with to the feeding surface 301 of the cutter plate 203, the roll sheet 3A never deviates when it is cut by the movable blade 207. Consequently, the occurrence of problems such as the cut end of the roll sheet 3A in a curved form (see FIG. 18) or in a snaked form (see FIG. 20) can be prevented.

Further, in the label printer 1 of this embodiment, when the top end portion of a predetermined length of the roll sheet 3A is discharged from the discharge port 403, the roll sheet 3A slides toward the one end surface 5A of the top cover 5 which forming the discharge port 403. This structure also allows the roll sheet 3A to curve. Due to this curvature, a tension for allowing the roll sheet 3A to tightly adhere to the feeding surface 301 of the cutter plate 203 is exerted to the roll sheet 3A itself. Therefore, after that, the movable blade 207 vertically penetrating the passage groove 206 formed on the feeding surface 301 of the cutter plate 203 is reciprocated so as to cut the roll sheet 3A into a print label. During this operation, since the roll sheet 3A is stable in a state where it is in tight contact with the feeding surface 301 of the cutter plate 203, the roll sheet 3A never deviates when it is cut by the movable blade 207. Consequently, the occurrence of problems such as the cut end of the roll sheet 3A in a curved form (see FIG. 18) or in a snaked form (see FIG. 20) can be prevented.

Further, in the label printer 1 of this embodiment, as described above, when the movable blade 207 vertically penetrating the passage groove 206 formed on the feeding surface 301 of the cutter plate 203 is reciprocated, the roll sheet 3A placed on the feeding surface 301 of the cutter plate 203 will be cut. At this time, it is conceivable that the roll sheet 3A located closer to the platen roller 26 than the movable blade 207 is apart from the feeding surface 301 of the cutter plate 203. However, in the label printer 1 of this embodiment, when the movable blade 207 is reciprocated, the rear rib 401 provided so as to project from the cutter holder 204 located above the movable blade 207 for holding the movable blade 207 is also reciprocated accordingly. In this structure, the rear rib 401 prevents the roll sheet 3A located closer to the platen roller 26 than the movable blade 207 from being apart from the feeding surface 301 of the cutter plate 203. Since the roll sheet 3A is cut in a stable state, the occurrence of a problem such as the cut end of the roll sheet 3A in a snaked form (see FIG. 18) can be prevented.

Figure 19:
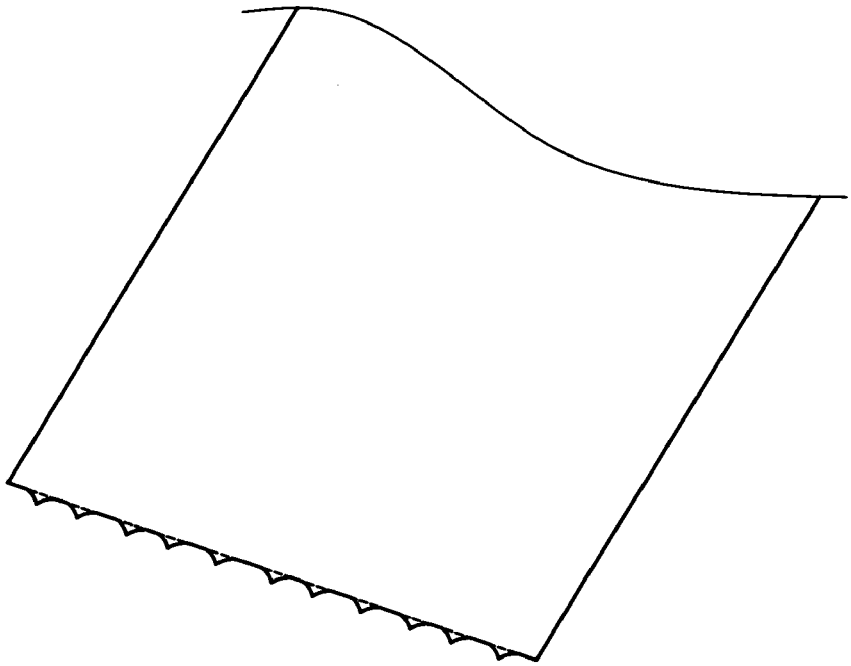
FIG. 19 is a view showing an example of a roll sheet with a cut end with naps.

Further, in the label printer 1 of this embodiment, the movable blade 207 for cutting the roll sheet 3A is inclined at an angle $\alpha$ of 75° with respect to the roll sheet 3A in the direction F of feeding the roll sheet 3A which is slid on the feeding surface 301 of the cutter plate 203, and is held at this state in the cutter holder 204 (see FIG. 15). When the movable blade 207 vertically penetrating the passage groove 206 formed on the feeding surface 301 of the cutter plate 203 is reciprocated, the movable blade 207 and the roll sheet 3A intersects at an angle of 75° with respect to the feeding direction F. In this arrangement, at the time of cutting the roll sheet 3A placed on the feeding surface 301 of the cutter plate 203, a shearing force is exerted to the roll sheet 3A during the cutting operation. Consequently, the occurrence of a problem such as the cut end of the roll sheet 3A in a napped state (see FIG. 19) can be prevented.

Figure 17:
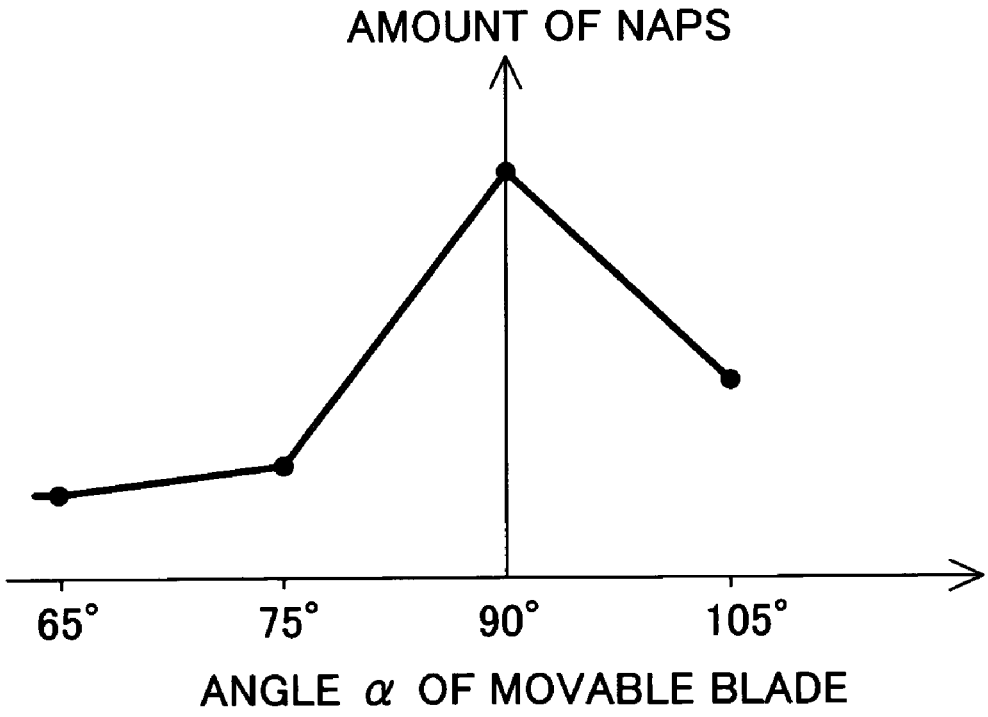
FIG. 17 is a graph showing experimental data on a relationship between an angle of a movable blade of the cutter unit and naps in the label printer.

FIG. 17 is a graph showing experimental data on the relationship between the angle $\alpha$ of the movable blade 207 and the naps formed at the cut end. FIG. 17 shows data obtained from an experiment in which: a roll sheet 3A was cut by movable blades 207 each after being subjected to thirty thousand times of durability test and arranged at angles $\alpha$ of 65°, 75°, 90°, and 105°, respectively; and the amount of naps formed at the cut surface of the roll sheet 3A at each angle $\alpha$ was evaluated relative to the amount of naps formed at the angle $\alpha$ of 90°. From FIG. 17, it is understood that the amount of naps formed at the cut surface of the roll sheet 3A can be relatively suppressed at the angle $\alpha$ within a range between 75° and 105°.

Figure 21:
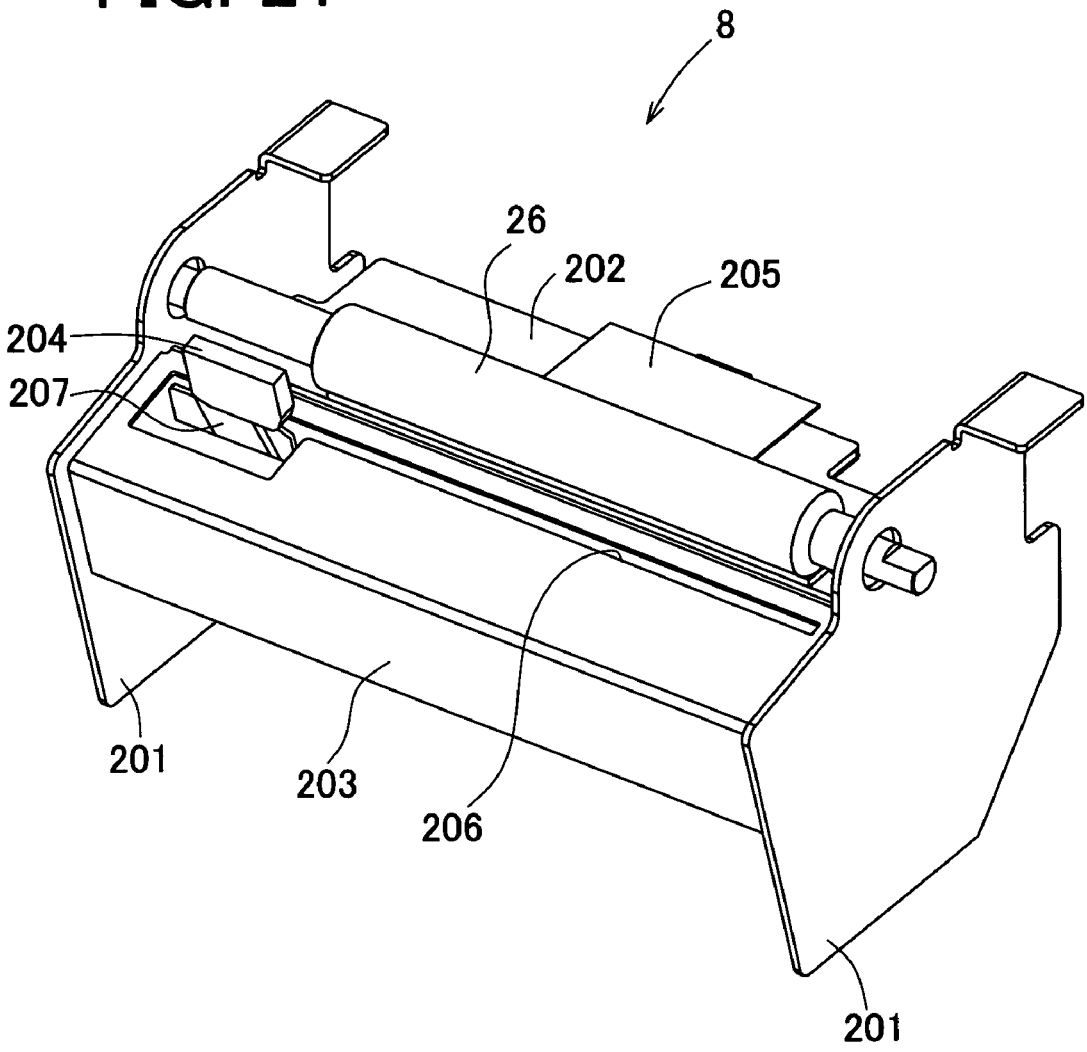
FIG. 21 is a perspective view showing schematic structures of the cutter unit and its periphery.

Next, schematic structures of the cutter unit 8 and its periphery will be described based on the drawings. FIG. 21 is a perspective view showing the schematic structures of the cutter unit 8 and its periphery. As shown in FIG. 21, the cutter unit 8 includes a pair of side plates 201. Between the pair of side plates, provided are a platen roller 26, a heatsink 202, a cutter plate 203, a pair of upper and lower cutter holders 204, and the like.

On this regard, the platen roller 26 is rotatably supported by the pair of side plates 201, and as described above, is driven to rotate by an unillustrated stepping motor and the like. Further, on the upper surface of the heatsink 202 opposed to the platen roller 26, a thermal head 31 (see FIG. 7) and a FPC substrate 205 of the thermal head 31 (see FIG. 7) are fixed. On the upper surface of the cutter plate 203, the roll sheet 3A is slidable. The upper surface of the cutter plate 203 is formed with a passage groove 206 extending in parallel with the platen roller 26 in such a manner that the cutter holder 204 reciprocates along the passage groove 206. The top end of the cutter plate 203 at the side of the thermal head 31 is folded downward. Further, to the cutter holder 204, a movable blade 207 for cutting the roll sheet 3A is attached so as to penetrate the passage groove 206 in a vertical direction.

Figure 22:
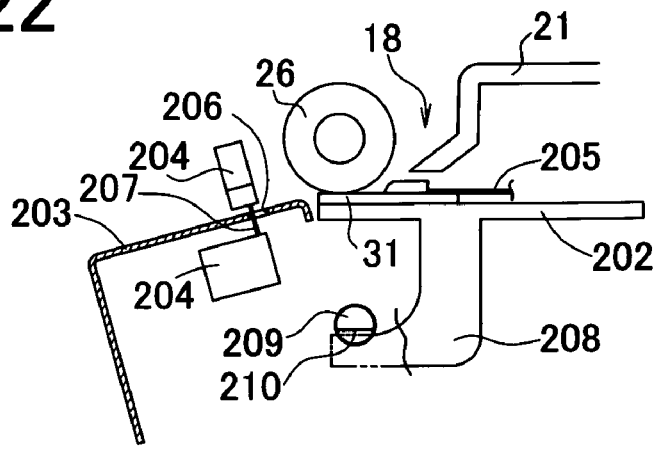
FIG. 22 is a side view of the cutter unit and its periphery in FIG. 21, from which both side plates are removed, including a cutter plate shown in section and showing a state where a thermal head is pressed to be urged against a platen roller.
Figure 23:
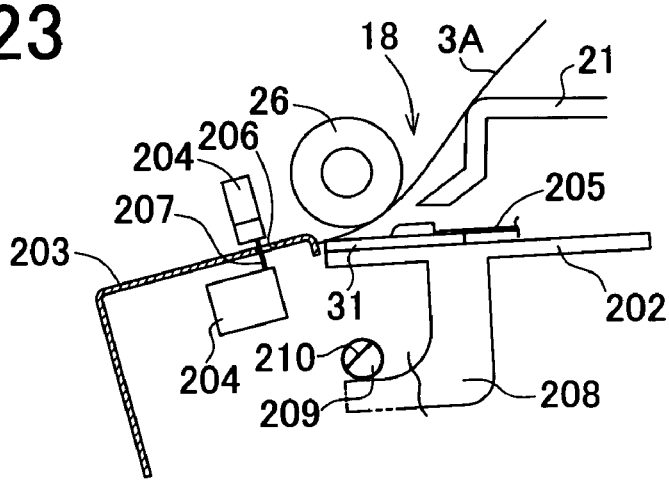
FIG. 23 is a side view of the cutter unit and its periphery in FIG. 21, from which both side plates are removed, including a cutter plate shown in section and showing a state where the thermal head comes away from the platen roller.

FIG. 22 shows a state where the thermal head 31 is pressed to be urged against the platen roller 26. The same state is shown in FIG. 21 as a side view except that both of the side plates 201 are removed, and only the cutter plate 203 is shown in section. In this state, the top end of the thermal head 31 is located slightly above the cutter plate 203. Further, FIG. 23 shows a state where the thermal head 31 comes away from the platen roller 26. The same state is shown in FIG. 21 as a side view except that both of the side plates 201 are removed, and only the cutter plate 203 is shown in section. In this state, the top end of the thermal head 31 is located at a position lower than the upper surface of the cutter plate 203, and faces the folded end surface of the cutter plate 203.

On this regard, an urging force of the heatsink 202 is applied to the thermal head 31 fixed on the upper surface of the heatsink 202 by an unillustrated spring and the like. Thus, the thermal head 31 is pressed to be urged against the platen roller 26 as shown in FIG. 22. In this state, the top ends of a pair of lower interfering members 208 provided at opposite ends of the heatsink 202 are located below a cutaway surface 210 (see FIGS. 30, 31 described later) of the release shaft 209 interposed between a pair of side plates 201 (see FIG. 21). At the right side of the thermal head 31 in FIG. 22, a placing portion 21 is located. Between the platen roller 26 and they placing section 21, an insertion port 18 into which a roll sheet 3A (see FIG. 13 and the like) is inserted is formed. At the left side of the thermal head 31 in FIG. 22, that is, at the downstream side along the direction of feeding the roll sheet 3A, a cutter plate 203 and a cutter holder 204 are located.

A release shaft 209 interposed between the pair of side plates 201 (see FIG. 21) is rotatably supported, and can be rotated by means of the lever 27 (see FIG. 2 and the like). Specifically, as described above, when the lever 27 (see FIG. 2 and the like) is turned upward, the release shaft 209 also rotates accordingly. As a result of this rotation, as shown in FIG. 23, the top end of the lower interfering member 208 provided on the heatsink 202 is pushed to advance downward by the cylindrical side surface of the release shaft 209 which is rotating. Thus, the thermal head 31 fixed on the heatsink 202 comes to a state apart from the platen roller 26. In this state, if the roll sheet 3A is inserted through the insertion port 18, the roll sheet 3A can be located between the thermal head 31 and the platen roller 26. At this time, the top end of the thermal head 31 is located at a position lower than the upper surface of the cutter plate 203 and faces the folded end surface of the cutter plate 203. Therefore, the top end of the roll sheet 3A inserted along the thermal head 31 is brought into contact with the end surface of the cutter plate 203.

Figure 24:
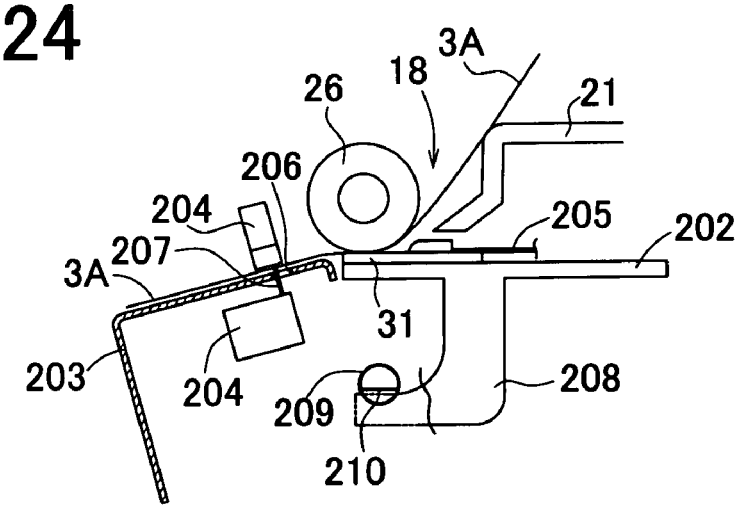
FIG. 24 is a side view of the cutter unit and its periphery in FIG. 21, from which both side plates are removed, including a cutter plate shown in section and showing a state where the thermal head is pressed to be urged against the platen roller with a roll sheet sandwiched therebetween.

On the other hand, in this state, when the lever 27 (see FIG. 2 and the like) is turned downward, a state shown in FIG. 24 is established. FIG. 24 shows a state where the thermal head 31 is pressed to be urged against the platen roller 26. The same state is shown in FIG. 21 as a side view except that both of the side plates 201 are removed, and only the cutter plate 203 is shown in section. Specifically, as shown in FIG. 24, when the lever 27 (see FIG. 2 and the like) is turned downward, the top end of the lower interfering member 208 provided on the heatsink 202 comes to located below the cutaway surface 210 of the release shaft 209, and is released from the downward pushing action for advancement performed by the cylindrical side surface of the release shaft 209. In accordance with the application of force from heatsink 202 by an unillustrated spring and the like, the thermal head 31 fixed to the heatsink 202 is moved toward the platen roller 26 and returns to a state where it is pressed to be urged. At this time, the roll sheet 3A is sandwiched between the thermal head 31 and the platen roller 26, and the roll sheet 3A is urged to be pressed against the platen roller 26 by the thermal head 31. In accordance with the movement of the thermal head 31, the top end of the roll sheet 3A comes away from the end surface of the cutter plate 203 and is located above the upper surface of the cutter plate 203. Therefore, in this state, the thermal head 31 is controlled to be driven while driving the platen roller 26 to rotate by an unillustrated stepping motor and the like, image data is sequentially printed on the printing surface of the roll sheet 3A while the roll sheet 3A is fed. Then, the roll sheet 3A after the printing operation is fed while sliding on the upper surface of the cutter plate 203. Therefore, the left side of the thermal head 31 in the drawing corresponds to "a downstream side along the feeding direction", whereas the right side of the thermal head 31 in the drawing corresponds to "an upstream side along the feeding direction".

After that, the movable blade 207 of the cutter holder 204 is reciprocated in the passage groove 206 of the cutter late 203, the roll sheet 3A placed on the upper surface of the cutter plate 203 is cut along its width direction into print labels.

Figure 25:
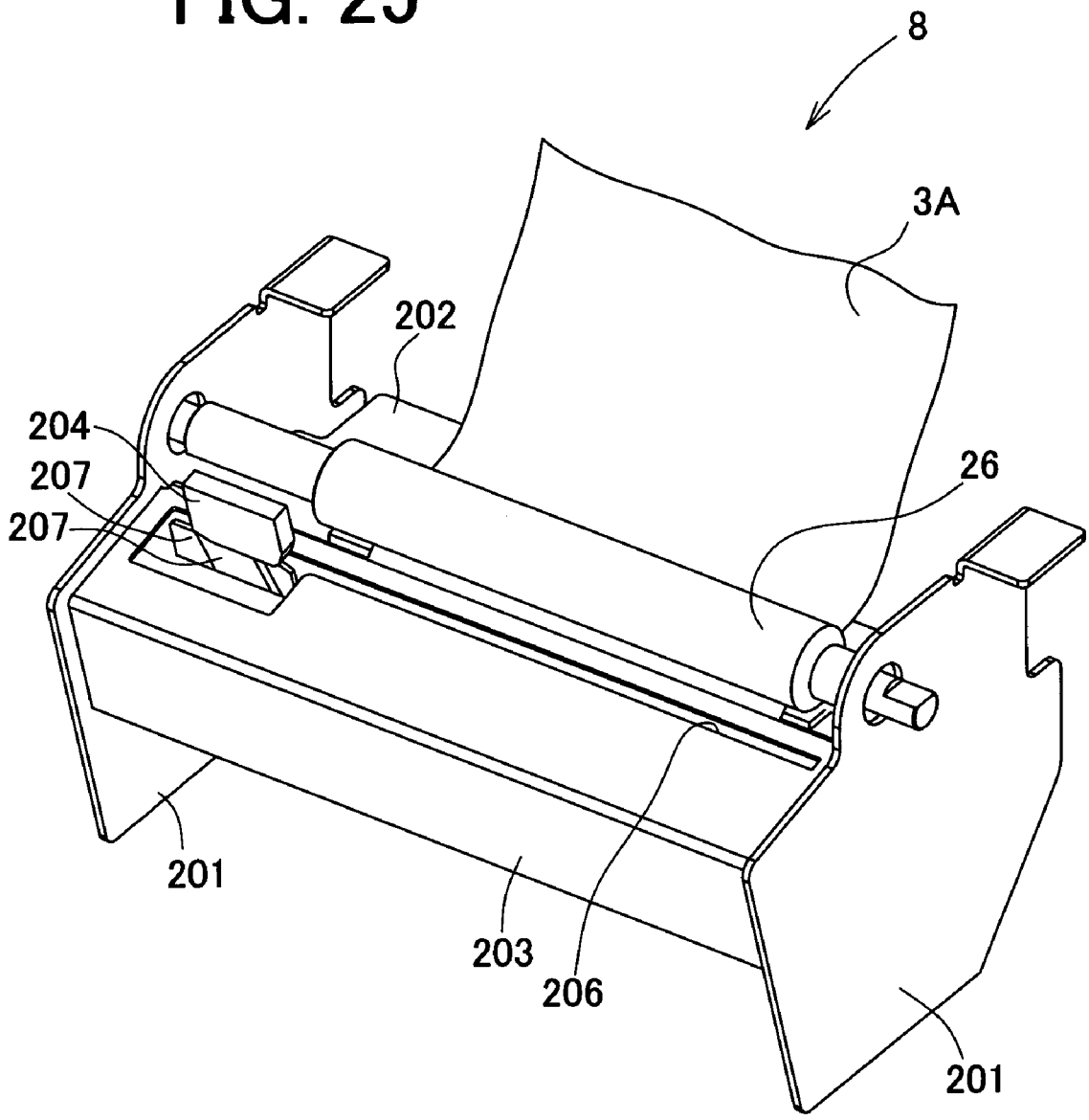
FIG. 25 is a perspective view showing schematic structures of the cutter unit and its periphery when the roll sheet is inserted through an insertion port with the thermal head apart from the platen roller.

FIG. 25 is a perspective view showing the schematic structures of the cutter unit 8 and its periphery when the roll sheet 3A is inserted through the insertion port 18 with the thermal head 31 apart from the platen roller 26.

Figure 26:
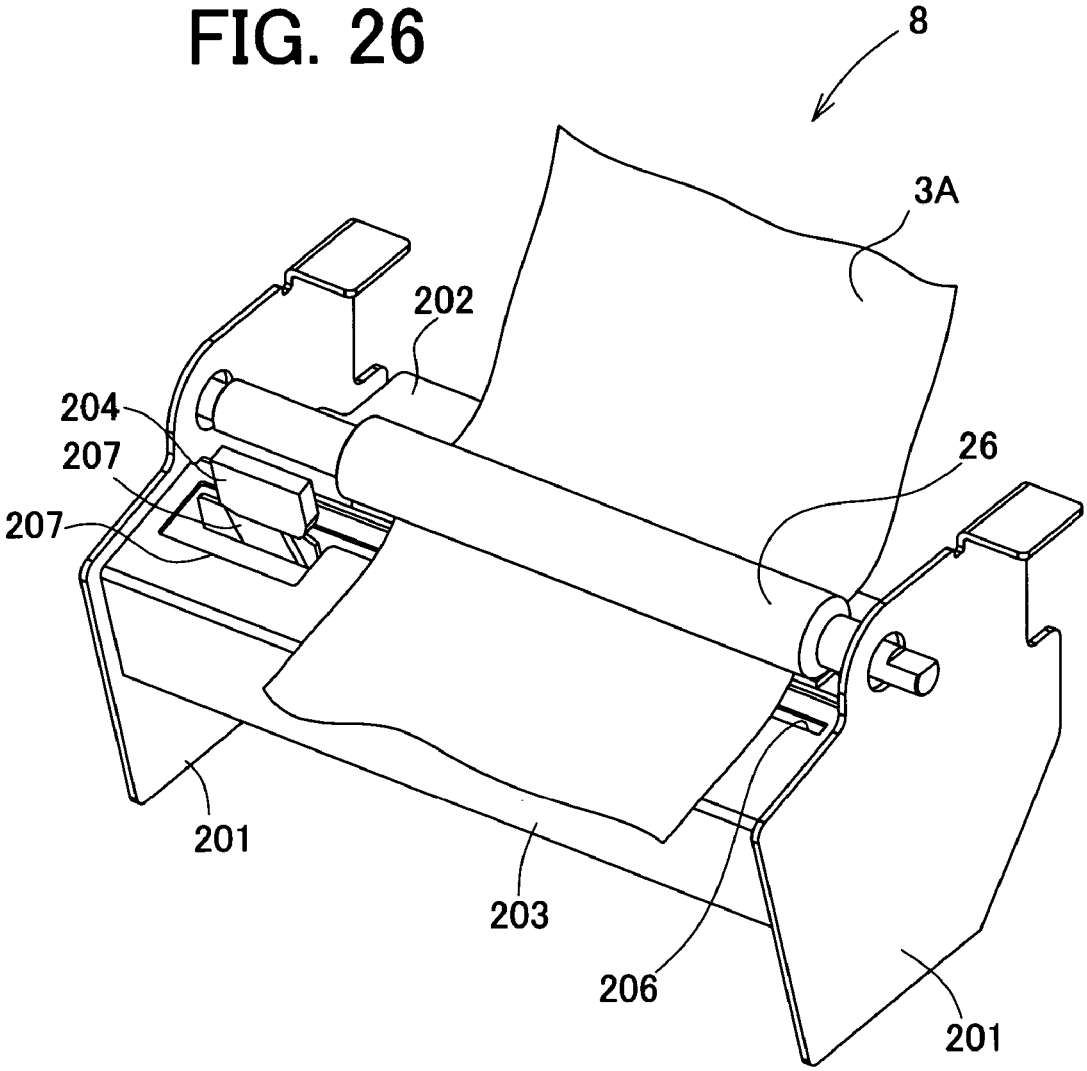
FIG. 26 is a perspective view showing schematic structures of the cutter unit and its periphery when feeding and printing for the roll sheet is performed by driving the platen roller to rotate or by controlling the thermal head to be driven in a state where the thermal head is pressed to be urged against the platen roller with the roll sheet sandwiched therebetween.

FIG. 26 is a perspective view showing the schematic structures of the cutter unit 8 and its periphery when the feeding and printing for the roll sheet 3A is performed by driving the platen roller 26 to rotate or by controlling the thermal head 31 to be driven in a state where the thermal head 31 is pressed to be urged against the platen roller 26 with the roll sheet 3A sandwiched therebetween.

Figure 27:
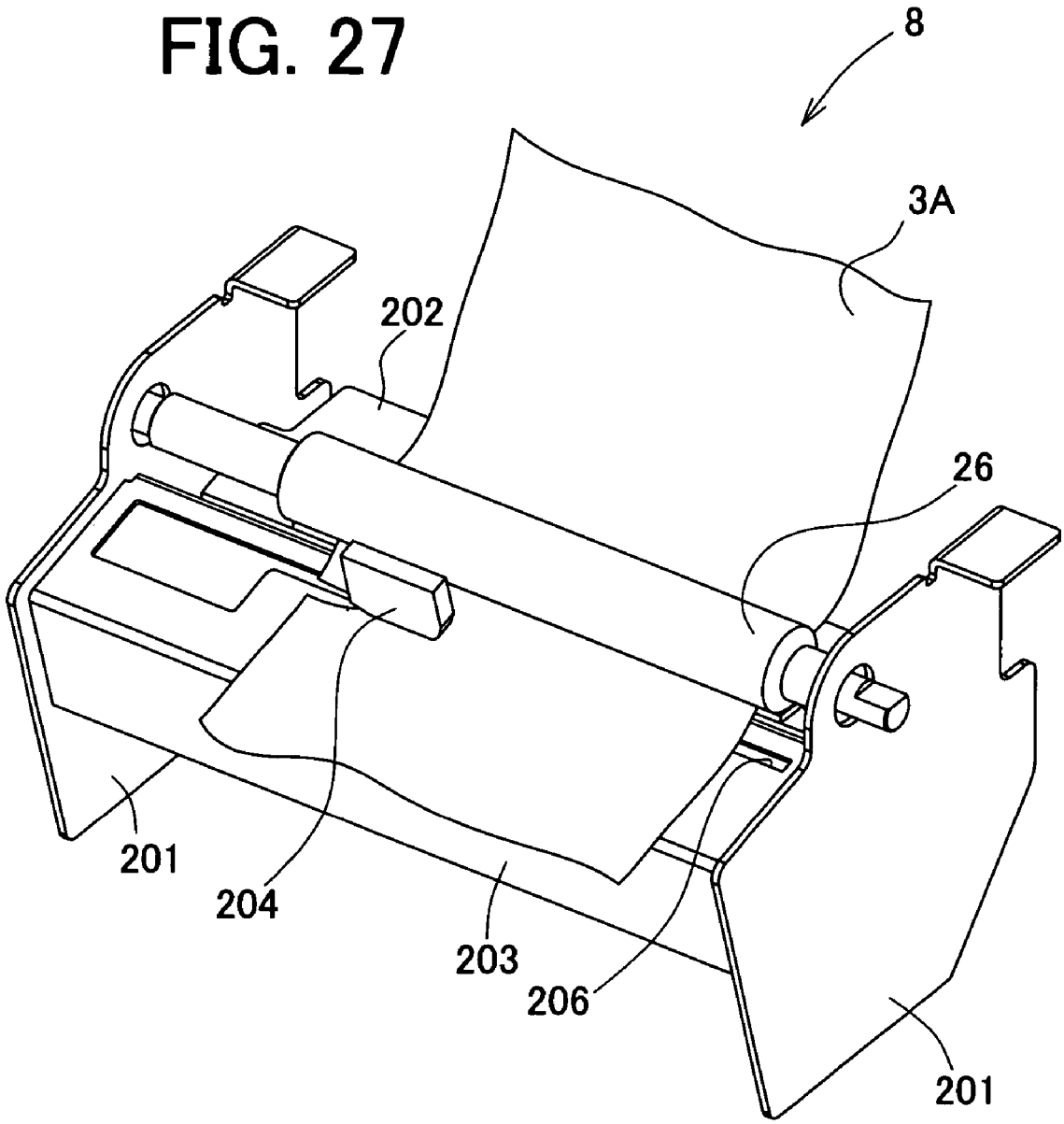
FIG. 27 is a perspective view showing schematic structures of the cutter unit and its periphery when the roll sheet placed on an upper surface of the cutter plate is cut along its width direction into print labels by reciprocating a cutter holder in a passage groove of the cutter plate.

FIG. 27 is a perspective view showing the schematic structures of the cutter unit 8 and its periphery when the roll sheet 3A placed on the upper surface of the cutter plate 203 is cut along its width direction into print labels by reciprocating the cutter holder 204 in the passage groove 206 of the cutter plate 203.

Figure 28:
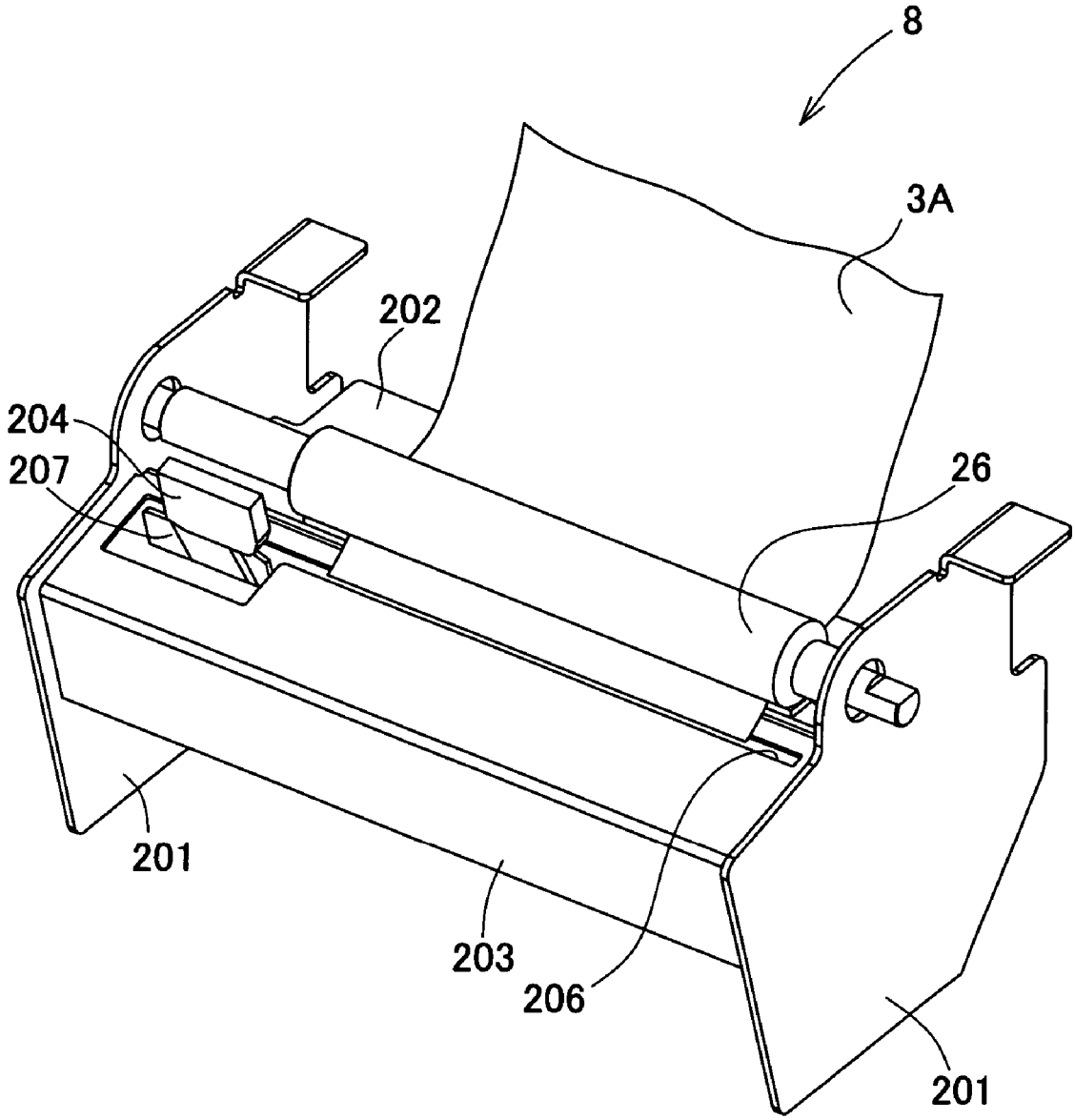
FIG. 28 is a perspective view showing schematic structures of the cutter unit and its periphery after the roll sheet placed on the upper surface of the cutter plate is cut along its width direction into print labels by reciprocating the cutter holder in the passage groove of the cutter plate.

FIG. 28 is a perspective view showing the schematic structures of the cutter unit 8 and its periphery after the roll sheet 3A placed on the upper surface of the cutter plate 203 is cut along its width direction into print labels by reciprocating the cutter holder 204 in the passage groove 206 of the cutter plate 203.

Figure 29:
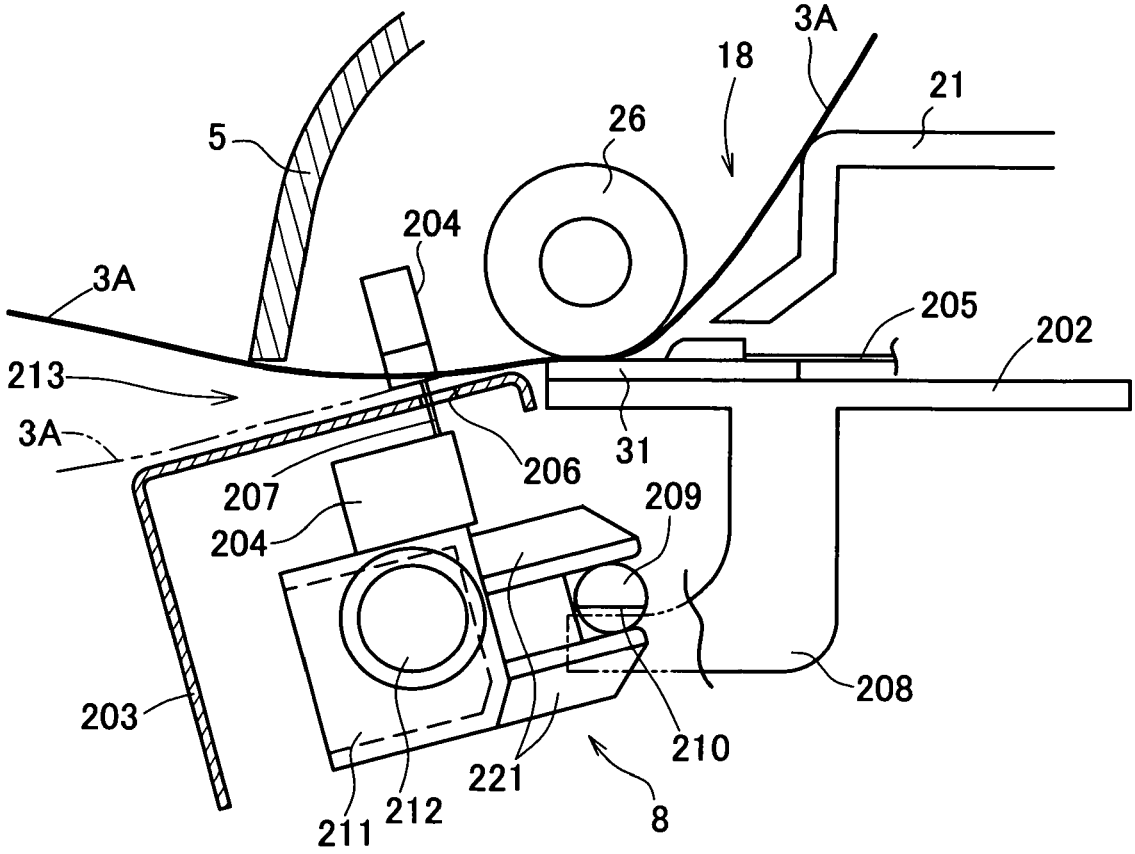
FIG. 29 is a side view of the cutter unit and its periphery of FIG. 21, from which both side plates are removed, showing a state where the roll sheet placed on the upper surface of the cutter plate is cut along its width direction into print labels by reciprocating the cutter holder in the passage groove of the cutter plate.

Next, schematic structures of the cutter unit 8 and its periphery will be described based on FIG. 29 when the roll sheet 3A placed on the upper surface of the cutter plate 203 is cut along its width direction into print labels by reciprocating the cutter holder 204 in the passage groove 206 of the cutter plate 203. FIG. 29 is a side view obtained by removing both the side plates 201 from FIG. 21, and showing the state when the roll sheet 3A placed on the upper surface of the cutter plate 203 is cut along its width direction into print labels by reciprocating the cutter holder 204 in the passage groove 206 of the cutter plate 203. In FIG. 29, only the cutter plate 203 is shown in section.

As shown in FIG. 29, when the cutter holder 204 is reciprocated in the passage groove 206 of the cutter plate 203, the roll sheet 3A placed on the cutter plate 203 can be cut along the width direction by the movable blade 207 attached to the cutter holder 204. On this regard, below the cutter plate 203, a cutter carriage 211 is fixedly provided to the cutter holder 204 including the movable blade 207 attached thereto. A guide shaft 212 fixedly interposed between the opposite side plates 201 (see FIG. 21) is penetrated through the cutter carriage 211. The movement path of the cutter carriage 211 is restricted by the guide shaft 212. Further, the cutter carriage 211 is in cooperation with the cutter lever 9 (see FIG. 1 and the like). Therefore, when the cutter lever 9 (see FIG. 1 and the like) is operated to move toward a right direction, the cutter carriage 211 is slid toward the right direction along the guide shaft. Accordingly, the movable blade 207 attached to the cutter holder 204 is also slid in the passage groove 206 of the cutter plate 203 so as to come across the roll sheet 3A in its width direction. As a result, the roll sheet 3A placed on the upper surface of the cutter plate 203 can be cut.

At this time, the roll sheet 3A placed between the thermal head 31 and the platen roller 26 is securely held because the thermal head 31 is pressed to be urged against the platen roller 26.

On the other hand, the cutter plate 203 never applies an upward pressing force to the roll sheet 3A placed on the cutter plate 203. The roll sheet 3A is fed as the platen roller 26 is driven to rotate, and is sent out onto the tray 6 (se FIG. 1 and the like) through a discharge port 213 formed between the top end of the top cover 5 attached to the housing 2 (see FIG. 1 and the like) and the upper surface of the cutter plate 203. After the top end portion of the roll sheet 3A placed on the upper surface of the cutter plate 203 is sent out through the discharge port 213, the movement of the roll sheet 3A in the direction perpendicular to the discharge port 213, that is, in the direction intersecting the lower surface of the roll sheet 3A onto which printing is to be made is merely restricted within the vertical dimension of the discharge port 213, in other words, within a space created between the top end of the top cover 5 and the upper surface of the cutter plate 203. Thus, when the movable blade 207 attached to the cutter holder 204 comes across the roll sheet 3A in its width direction, the roll sheet 3A is permitted to move upward and downward in the direction perpendicular to the discharge port 213. Accordingly, the cut point of the movable blade 207 which will cut the roll sheet 3A in its width direction also moves in accordance with the movement of the movable blade 207. Naturally, since the movement of the roll sheet 3A is restricted within the vertical dimension of the discharge port 213, a tension required to cut the roll sheet 3A in its width direction can be ensured.

Further, the cutter carriage 211 is formed with a pair of guide members 221 projecting therefrom. As shown in perspective views of FIGS. 30 and 31, the pair of guide members 221 is structured so as to slide over the cylindrical side surface of the release shaft 209 while gripping the cylindrical side surface. In this structure, when the cutter carriage 211 is moved along the guide shaft 212, the pair of guide member 221 slides over the cylindrical side surface of the release shaft 209 while gripping the cylindrical side surface. This arrangement makes it possible to prevent the rotation of the cutter carriage 211 as well as the rotation of the movable blade 207 provided successive to the cutter carriage 211 via the cutter holder 204.

Figure 30:
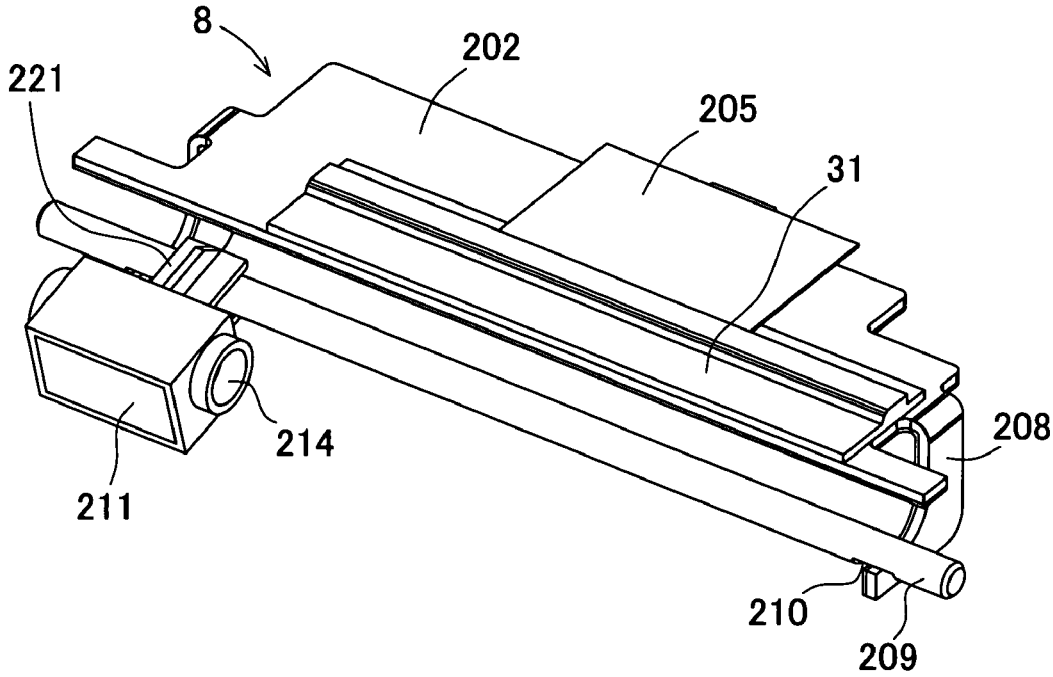
FIG. 30 is a perspective view showing schematic structures of the cutter unit and its periphery when a cutter carriage is in its home position.
Figure 31:
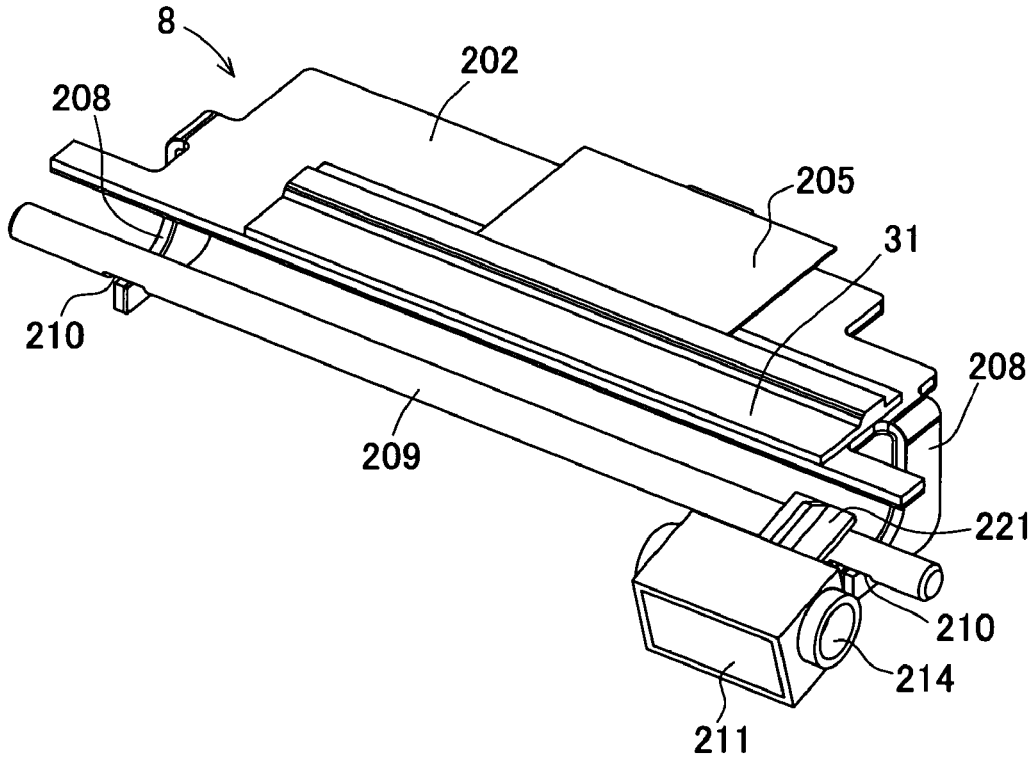
FIG. 31 is a perspective view showing schematic structures of the cutter unit and its periphery when the cutter carriage is at a turning point in its reciprocal movement.

FIG. 30 is a perspective view showing schematic structures of the cutter unit 8 and its periphery when the cutter carriage 211 is in its home position 502 (see FIG. 32 and the like). FIG. 31 is a perspective view showing schematic structures of the cutter unit 8 and its periphery when the cutter carriage 211 is at a turning point in its reciprocal movement. In FIGS. 30 and 31, a reference numeral "214" assigned to the cutter carriage 211 denotes a through hole through which the guide shaft 212 is to be penetrated.

Figure 32A:
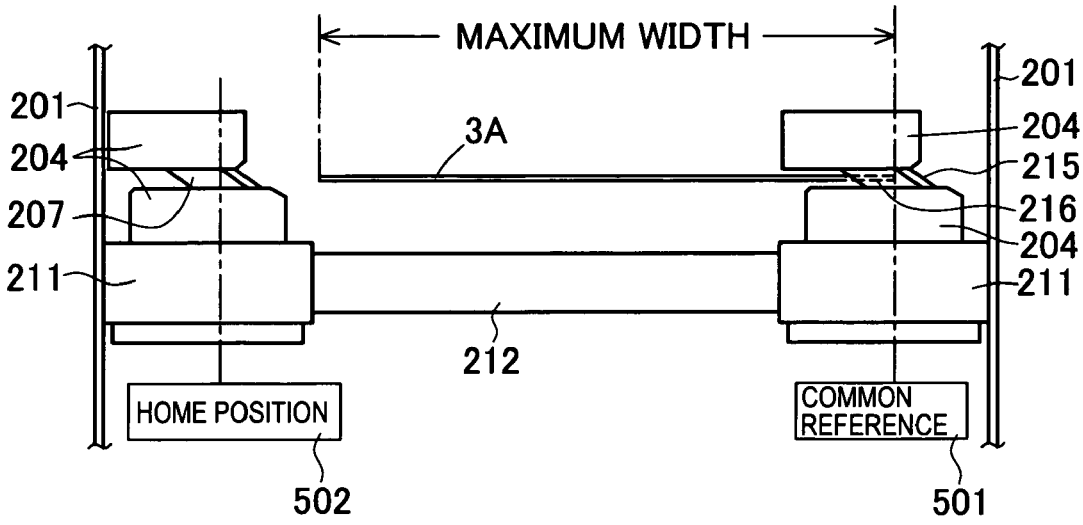
FIG. 32A is a conceptual diagram showing the home position and the turning point of the movable blade of the cutter holder, showing a relationship with a roll sheet having a maximum width.
Figure 32B:
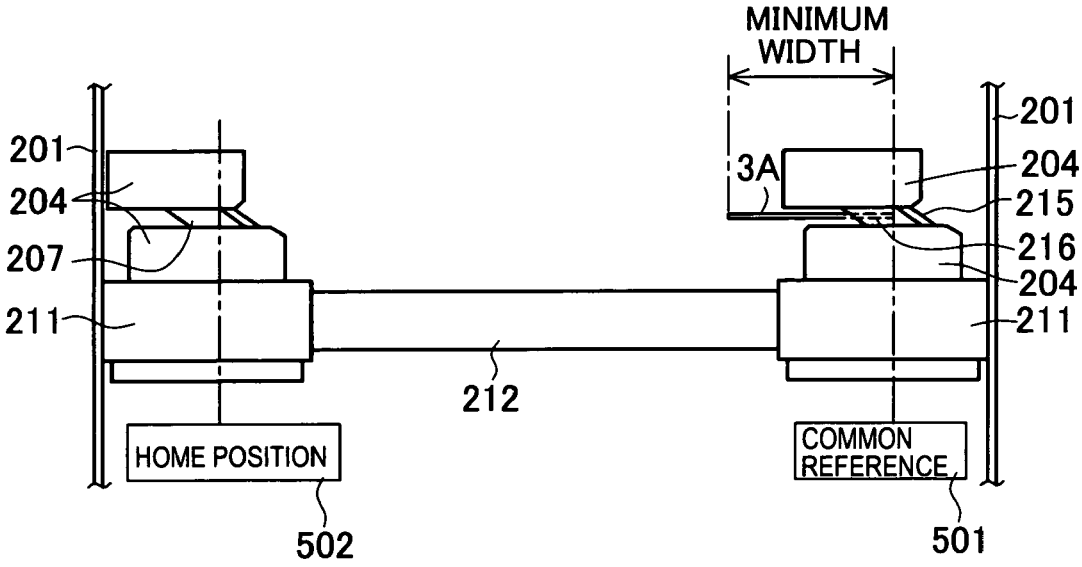
FIG. 32B is a conceptual diagram showing the home position and the turning point of the movable blade of the cutter holder, showing a relationship with a roll sheet having a minimum width.

Next, a reciprocal movement of the movable blade 207 of the cutter holder 204 to be made in the passage groove 206 of the cutter plate 203 will be described. FIG. 32 is a conceptual diagram showing a home position and a turning point of the movable blade 207 of the cutter holder 204, where (a) shows a relationship with a roll sheet 3A having a maximum width and (b) shows a relationship with a roll sheet 3A having a minimum width. For convenience of description, FIGS. 32A and 32B respectively show the states where the pair of upper and lower cutter holders 204 including the movable blade 207 attached thereto is at its home position 502 and at the turning point. In the actual structure, the pair of upper and cutter holder 204 includes only one piece of movable blade 207 (see FIGS. 25 to 28). It is needles to say that, when the movable blade 207 is at the home position 502, no movable blade 207 is present at the turning point, and when the movable blade 207 is at the turning point, no movable blade 207 is present in the home position 502.

As shown in FIGS. 32A and 32B, when the cutter carriage 211 is brought into contact with the inside of the side plate 201 located at the left side in the drawings, the cutter carriage 211 as well as the movable blade 207 provided successively to the cutter carriage 211 via the cutter holder 204 are in their home positions 502. At this time, the movable blade 207 is located outside one of the opposite side edge portions of the roll sheet 3A in both cases where the roll sheet 3A has the maximum width and where the roll sheet 3A has the minimum width. Therefore, as far as the movable blade 207 is in its home position 502, the movable blade 207 is always located outside one of the opposite side edge portions of the roll sheet 3A without exception regardless of the width dimension of the roll sheet 3A. Thus, when the cutter carriage 211 is moved toward the side plate 201 located at the right side in the drawings to allow the movable blade 207 to reciprocate, the movable blade 207 can start to cut the roll sheet 3A from the one side edge portion for any roll sheet 3A of any width dimension.

Further, as shown in FIGS. 32A and 32B, when the cutter carriage 211 is brought into contact with the inside of the side plate 201 at the right side in the drawings, the cutter carriage 211 as well as the movable blade 207 provided successive to the cutter carriage 211 via the cutter holder 204 comes to reach the turning point of its reciprocal movement. At this time, a cutting edge 215 located at the right side of the movable blade 207 in the drawings passes the above-described common reference 501. Specifically, the cutting edge 215 of the movable blade 207 is located outside the other side edge portion of the roll sheet 3A in both the cases where the roll sheet 3A has the maximum width and where the roll sheet 3A has the minimum width. On this regard, when the roll sheet holder 3 is mounted to the roll sheet holder storage section 4 as described above, the other side edge portion of the roll sheet 3A is always located at the common reference 501 without exception regardless of the width dimension of the roll sheet 3A wrapped around the roll sheet holder 3. Accordingly, then the movable blade 207 is located at the position of the turning point of its reciprocal movement, the cutting edge 215 of the movable blade 207 is always located outside the other side edge portion of the roll sheet 3A without exception regardless of the width dimension of the roll sheet 3A. Therefore, when the cutter carriage 211 is moved to reach the side plate 201 located at the left side in the drawings, the cutting edge 215 of the movable blade 207 passes through the other side edge portion for any roll sheet 3A of any size. Thus, the movable blade 207 can cut the roll sheet 3A.

After that, in order to bring the cutting edge 215 located at the right side of the movable blade 207 in the drawings into a state ready for cutting the roll sheet 3A again, the cutter carriage 211 brought into contact with the inside of the side plate 201 located at the right side in the drawings is moved toward the side plate 201 located at the left side in the drawings. Specifically, the movable blade 207 is reciprocated. On this regard, when the movable blade 207 is located at the turning point before it stars to return toward the home position, as shown in FIGS. 32A and 32B, an end portion 216 at the ridge side having no cutting edge 215 never goes beyond the above-described common reference 501. In other words, the end portion 216 at the ridge side of the movable blade 207 having no cutting edge 215 is always located inside the other side edge portion of the roll sheet 3A both in the case where the roll sheet 3A has the maximum width and where the roll sheet 3A has the minimum width, and always stays within the width of the roll sheet 3A. On this regard, when the roll sheet holder 3 is mounted to the roll sheet holder storage section 4 as described above, the other side edge portion of the roll sheet 3A is always located at the common reference 501 without exception regardless of the width dimension of the roll sheet 3A wrapped around the roll sheet holder 3. Therefore, as far as the movable blade 207 is located at the turning point of its reciprocal movement, the end portion 216 at the ridge side of the movable blade 207 having no cutting edge 215 is always located within the width of the roll sheet 3A inside the other side edge portion of the roll sheet 3A, regardless of the width dimension of the roll sheet 3A. Thus, when the movement of the cutter carriage 211 is started from the side plate 201 at the right side in the drawings to the side plate 201 at the left side in the drawings, the end portion 216 of the ridge side of the movable blade3 207 having no cutting edge 215 always stays on the cut surface of the roll sheet 3A for any roll sheet 3A of any width. As a result, there arises no trouble that the movable blade 207 is snapped on the cut surface of the roll sheet 3A.

Figures 33, 34:
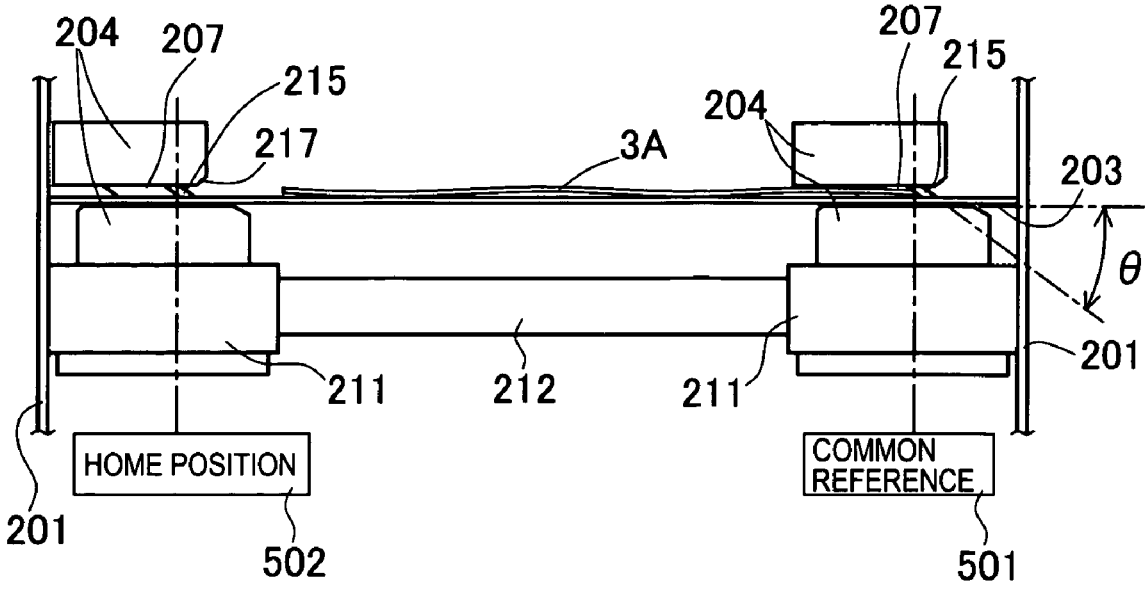
FIG. 33 is a conceptual diagram showing the home position and the turning point of the movable blade of the cutter holder, showing an oblique cross angle of a cutting edge of the movable blade.
FIG. 34 is a table showing a relationship between the number of cutting by the cutting edge of the movable blade and the oblique cross angle of the cutting edge.

Further, as shown in FIG. 33, a tapered portion 217 is formed on the upper portion of the cutter holder 204 including the movable blade 207 attached thereto, in order to induce one of the opposite side edge portions of the roll sheet 3A placed on the cutter plate 203 to the cutting edge 215 of the movable blade 207 when the movable blade 207 is moved toward the turning point, that is, when the cutter carriage 211 brought into contact with the inside of the side plate 201 located at the left side in the drawings is moved toward the side plate 201 located at the right side in the drawings so as to allow the movable blade 207 to advance from its home position 502 toward the turning point along the cutting direction. Further, the cutting edge 215 of the movable blade 207 mounted to the cutter holder 204 is inclined at an oblique cross angle θ. Due to the inclination at the oblique cross angle θ, the cutting edge 215 of the movable blade 207 obliquely intersects the roll sheet 3A placed on the cutter plate 203 in the cutting direction, thereby ensuring that the cutting edge 215 of the movable blade 207 cuts sharply. On this regard, as shown in the table of FIG. 34, the oblique cross angle θ has an influence on the number of times that the cutting edge 215 of the movable blade 207 is capable of cutting. Assuming the minimum number of cutting-capable times required to be ensured as a product as ten thousand, an adequate oblique cross angle θ falls within a range between 24° and 34°. To be more accurate, the oblique cross angle θ is an angle formed between the upper surface of the cutter plate 203 and the cutting edge 215 in the cutting direction of the movable blade 207. The material of the roll sheet 3A is resin film or paper.

As described above, the label printer 1 of this embodiment includes a cutter unit 8. The movable blade 207 is moved in a direction of cutting the roll sheet 3A mounted in the housing 2 and in a direction reverse to the cutting direction, so that a part of the roll sheet 3A is cut into a print label. Therefore, the label printer 1 employs the movable edge 207 of the sliding type. On this regard, when the movable blade 207 attached to the cutter holder 204 is located at the turning point of the movement of the movable blade 207, as shown in FIGS. 32A, 32B, the cutting edge 215 of the movable blade 207 goes beyond the other side edge portion of the roll sheet 3A located at the side of the common reference 501. Simultaneously, on the other hand, the end portion 216 at the ridge side of the movable blade 207 having no cutting edge 215 stays without going beyond the other side edge portion of the roll sheet 3A located at the side of the common reference 501.

Therefore, as shown in FIGS. 32A and 32B, when the movable blade 207 attached to the cutter holder 204 advances along the cutting direction to reach the turning point from which the movable blade 207 will start to return along the direction reverse to the cutting direction, the cutting edge 215 of the movable blade 207 has completed to pass across the roll sheet 3A mounted in the housing 2. As a result, a part of the roll sheet 3A can be cut away from the roll sheet 3A. On the other hand, the end portion 216 at the ridge side of the movable blade 207 having no cutting edge 215 remains on the cut surface of the roll sheet 3A. Therefore, when the cutter carriage 211 brought into contact with the inside of the side plate 201 at the right side in FIG. 32 is moved toward the side plate 201 at the left side in FIG. 32 so as to start the movement of the movable blade 207 toward its home position, the movable blade 207 attached to the cutter holder 204 never snags on the cut surface of the roll sheet 3A. Thus, since the movable blade 207 of a sliding type can be slid smoothly in a reverse direction along the cut surface of the roll sheet 3A, paper jam of the roll sheet 3A can be prevented.

Especially, when the roll sheet holder 3 is mounted to the roll sheet holder storage section 4 as described above, the other side edge portion of the roll sheet 3A is always located at the common reference 501 without exception regardless of the width dimension of the roll sheet 3A wrapped around the roll sheet holder 3. In this structure, paper jam of the roll sheet 3A can be prevented for any long-length roll sheet 3A of any width mounted to the housing 2.

Further, in the label printer 1 of this embodiment, as shown in FIG. 26, printing is performed by the thermal head 31 onto the roll sheet 3A mounted to the housing 2 while the roll sheet 3A is being fed. After that, as shown in FIG. 29, the movable blade 207 attached to the cutter holder 204 is reciprocated over the roll sheet 3A placed on the cutter plate 203 along the width direction. In this reciprocal movement, a free end portion of the roll sheet 3A permitted to move upward and downward along the direction perpendicular to the discharge port 213 is cut away from the roll sheet 3A into a print label. Therefore, it can be said that the label printer 1 includes a cutter unit of the sliding type.

At this time, the roll sheet 3A at the "upstream of the feeding direction" which coincides to the right side of the thermal head 31 in FIG. 29 is in press contact with the thermal head 31 and is in a firmly held state by the thermal head 31. On the other hand, the roll sheet 3A at the "downstream along the feeding direction" which coincides to the left side of the thermal head 31 in FIG. 29 is a free end portion of the roll sheet 3A permitted to move upward and downward along the direction perpendicular to the discharge port 213, and therefore, is in a lightly held state. Thus, a tension required for the movable blade 207 attached to the cutter holder 204 to cut the free end portion of the roll sheet 3A away from the roll sheet 3A can be ensured. Further, the free end portion at the "downstream side along the feeding direction" of the roll sheet 3A moves as the movable blade 207 attached to the cutter holder 204 moves along the cutting direction. In accordance with the movement of the free end portion, the cut point of the movable blade 207 attached to the cutter holder 204 also moves. As a result, durability of the cutter unit of the sliding type is enhanced, and the enhanced durability eliminates the need for providing a mechanism for tightly holding the "downstream side along the feeding direction" of the roll sheet 3A.

On this regard, in the label printer 1 of this embodiment, as is shown in FIG. 29, the roll sheet 3A at the "downstream side of the feeding direction" which coincides to the left side of the thermal head 31 in FIG. 29 is discharged through the discharge port 213 formed by the housing 2 and the top cover 5 mounted in the housing 2. Due to this arrangement, creation of a free end portion of the roll sheet 3A is easily achieved.

Further, in the label printer 1 of this embodiment, as shown in FIGS. 32A and 32B, the cutter unit 8 includes the movable blade 207 having a specified width and formed with the cutting edge 215 at the side of common reference 501. The movable blade 207 is moved over the roll sheet 3A placed on the upper surface of the cutter plate 203 mounted to the housing 2 along the cutting direction from the home position 502 located opposite to the common reference 501 toward the common reference 501. Then, the cutting edge 215 of the movable blade 207 is stopped at the turning point where the cutting edge 215 of the movable blade 207 goes beyond the other side edge portion of the roll sheet 3A located at the side of the common reference 501 whereas the end portion 216 at the ridge side of the movable blade 207 having no cutting edge 215 does not go beyond the other side edge portion of the roll sheet 3A located at the side of the common reference 501. Subsequently, the movable blade 207 is moved from the turning point in a direction reverse to the cutting direction. As a result, a part of the roll sheet 3A is cut into a print label.

Therefore, it can be said that the cutter unit 8 employs a cutter unit of the sliding type. On this regard, if the roll sheet 3A is firmly held at its "downstream side of the feeding direction" which coincides to the right side of the thermal head 31 in FIG. 29 and its "downstream side of the feeding direction" which coincides to the left side of the thermal head 31 in FIG. 29, as has been described in the section of "Background Art", the cutting point at which the cutting edge 215 of the movable blade 207 attached to the cutter holder 204 cuts the roll sheet 3A concentrates on one point.

To avoid this problem, the label printer 1 of this embodiment employs a structure where the roll sheet 3A located at the "downstream side in the feeding direction" which coincides to the left side of the thermal head 31 in FIG. 29 is made to be a free end portion of the roll sheet 3A permitted to move upward and downward in a direction perpendicular to the discharge port 213. In this structure, the cutting point at which the cutting edge 215 of the movable blade 207 attached to the cutter holder 204 cuts the roll sheet 3A moves in accordance with the movement of the movable blade 207. As a result, it is expected that the durability of the cutting edge 215 of the movable blade 207 attached to the cutter holder 204 is enhanced.

In the label printer 1 of this embodiment, as shown in FIG. 29, the roll sheet 3A interposed between the thermal head 31 and the platen roller 26 is firmly pressed by the thermal head 31 pressed to be urged against the platen roller 26. Consequently, a structure for firmly holding the roll sheet 3A at its "upstream side in the feeding direction" which coincides to the right side of the thermal head 31 in FIG. 29 is achieved by a simple structure in which the roll sheet 3A is held by the thermal head 31 and the platen roller 26 therebetween.

Further, in the label printer 1 of this embodiment, the roll sheet 3A is fed as shown in FIG. 26 by driving the platen roller 26 to rotate by an unillustrated stepping motor and the like. Consequently, "feeding means" is achieved by a simple structure in which the platen roller 26 is driven to rotate.

Further, in the label printer 1 of this embodiment, as shown in FIG. 33, the cutting edge 215 of the movable blade 207 attached to the cutter holder 204 is inclined at the oblique cross angle θ. The structure in which the cutting edge 215 of the movable blade 207 is obliquely intersected the roll sheet 3A placed on the cutter plate 203 ensures the performance of cutting the roll sheet 3A in its width direction.

On this regard, in the label printer 1 of this embodiment, as is shown in the table of FIG. 34, the cutting edge 215 of the movable blade 207 attached to the cutter holder 204 is set at an oblique cross angle θ within a range between 24° and 34°. At thus-set oblique cross angle θ, the performance of cutting the roll sheet 3A in its width direction is ensured, and at the same time, the number of times that the cutting edge 215 of the movable blade 207 is capable of cutting exceeds ten thousand, thereby remarkably enhancing the durability of the movable blade 207 attached to the cutter holder 204.

Further, as shown in FIGS. 22 to 24, the label printer 1 of this embodiment includes a release shaft 209 for bringing the thermal head 31 fixed to the heatsink 202 into a state where the thermal head 31 is pressed to be urged against the platen roller 26 and a state where the thermal head 31 is apart from the platen roller 26. On this regard, the release shaft 209 also serves to prevent the cutter carriage 211 from rotating via a pair of guide members 221 provided to the cutter carriage 211 in an upright posture, and as well as to prevent the movable blade 207 provided successively to the cutter carriage 211 via the cutter holder 204 from rotating. The purpose of preventing the cutter carriage 211 and the movable blade 207 from rotating is to eliminate a support shaft for stabilizing the reciprocal movement of the movable blade 207.

Next, the structure of the cutter unit 8 will be further described.

Figure 35A:
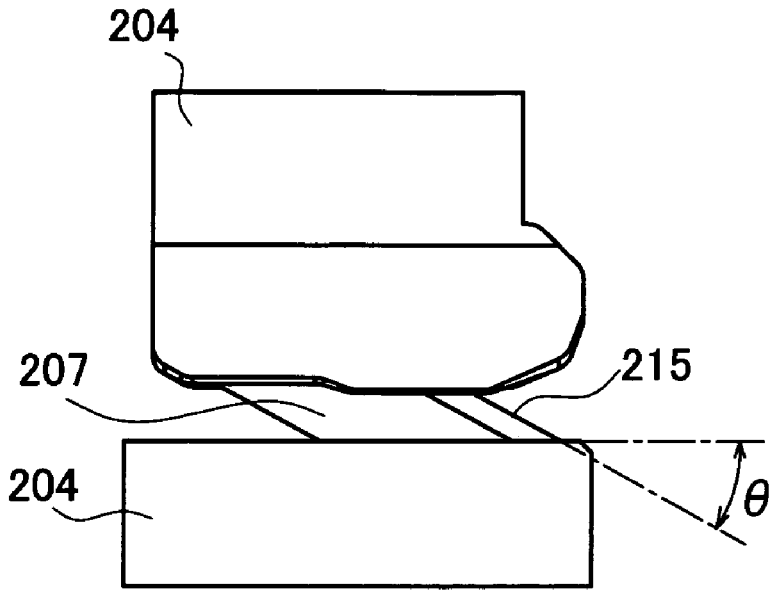
FIG. 35A is a front view of the cutter holder and the movable blade.

FIG. 35A is a front view of the cutter holder 204 and the movable blade 207.

Figure 35B:
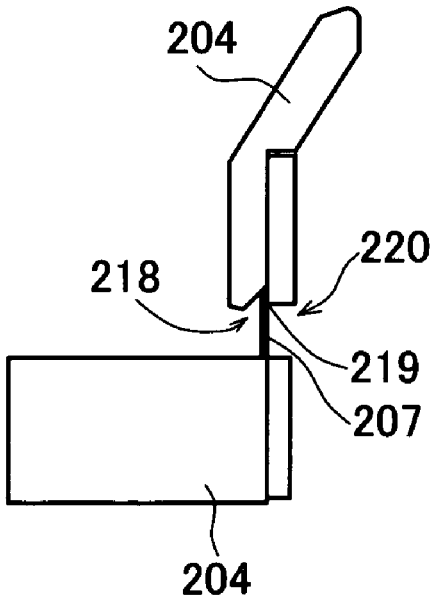
FIG. 35B is a side view of the cutter holder and the movable blade.

FIG. 35B is a side view of the cutter holder 204 and the movable blade 207.

As described above, in the label printer 1 of this embodiment, the roll sheet 3A is constituted by a heat-sensitive sheet 14 onto which printing is made by the thermal head 31, and a release sheet 14A attached to the heat-sensitive sheet 14 via an adhesive agent 14B. Since printing is made onto the heat-sensitive sheet 14 by the thermal head 31, the heat-sensitive sheet 14 is placed face down so that the heat-sensitive sheet 14 is brought into contact with the thermal head 31. In this state, the roll sheet 3A is fed from the roll sheet holder 3 toward the outside of the label printer 1.

As shown in FIG. 35A, the cutting edge 215 is attached to the movable blade 207 in such a manner that the upper portion of the cutting edge 215 is inclined rearward with respect to the moving direction of the movable blade 207, that is, the direction of cutting the roll sheet 3A. The inclination angle at this time is referred to as an oblique cross angle θ. The cutting edge 215 of the movable blade 207 penetrates the passage groove 206 of the cutter plate 203 so as to reach the cutter holder 204 located above and below the cutter plate 203. At this time, in order to ensure the cutting performance of the cutting edge 215, the oblique cross angle θ is set to fall within a range between 24° and 34° with respect to the cutting direction based on the data shown in FIG. 34.

A support portion 219 of the cutter holder 204 located above the cutter plate 203 for supporting the movable blade 207 is formed with an adhesive-receiving portion 218 which is cut away toward a bottom of the movable blade 207 into a tapered shape at the downstream side (left side in FIG. 35B) along the feeding direction of the roll sheet 3A. When the roll sheet 3A is cut by the movable blade 207, the roll sheet 3A is introduced to pass through a medium passage port 220 formed between the upper surface of the cutter plate 203 and the lower surface of the cutter holder 204 located above the cutter plate 203.

Figure 36:
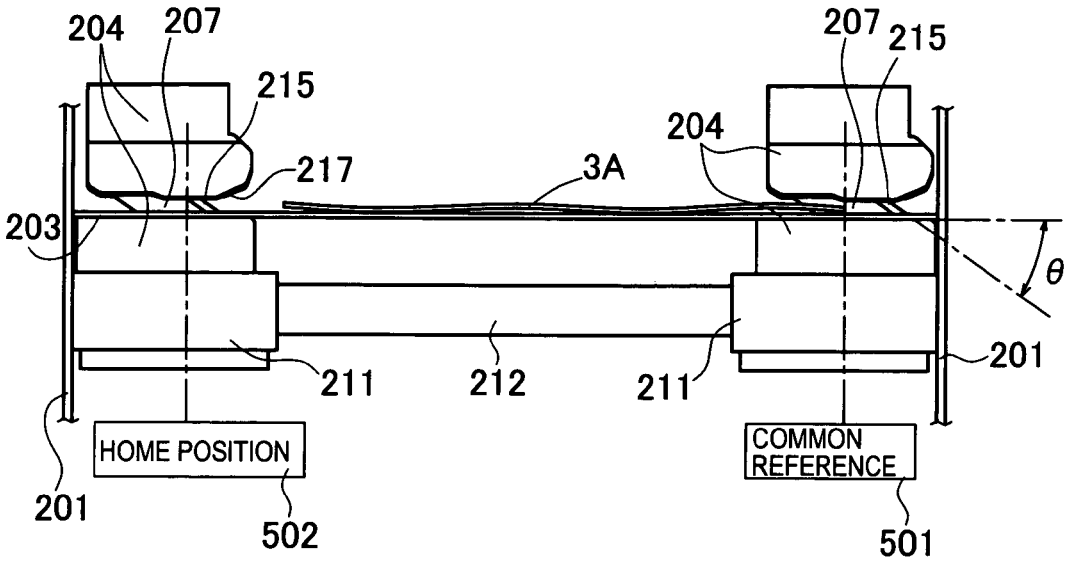
FIG. 36 is a conceptual diagram showing the home position and the turning point of the movable blade of the cutter holder, showing a concept of the oblique cross angle of the cutting edge of the movable blade.

As shown in FIG. 36, the cutter holder 204 and the movable blade 207 are attached to the upper surface of the cutter carriage 211 by the cutter holder 204 located below the cutter plate 203, and is reciprocated along the guide shaft 212 in accordance with the movement of the cutter lever 9. As the cutter carriage 211 moves toward the turning point, the roll sheet 3A is cut in its width direction.

Figure 37B:
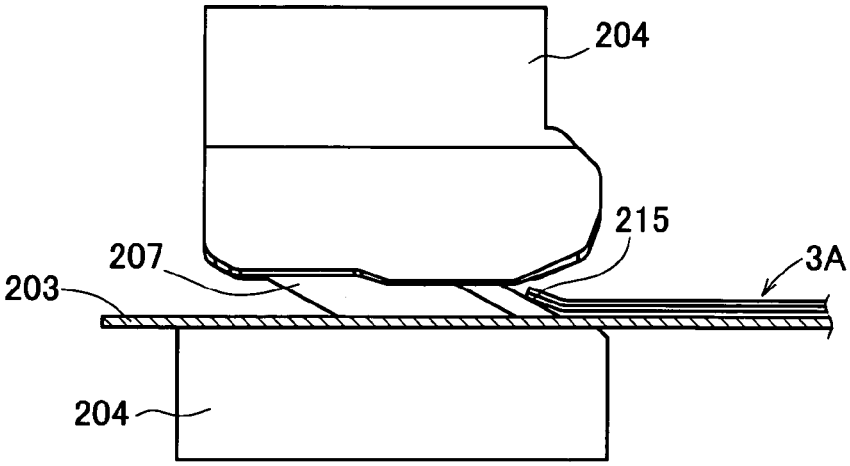

Next, a movement of the end portion of the roll sheet 3A at the time of cutting the roll sheet 3A by the cutting edge 215 will be described in detail with reference to the drawings. FIG. 36 is a vertical cross-sectional view of the cutter unit including a roll sheet attached thereto seen from front. FIG. 37 is a diagram for illustrating the relationship between the cutting edge and the end portion of the roll sheet at the time of cutting the roll sheet.

As described above, by manipulating the cutter lever 9 toward the right direction seen from front in a state where the printing onto the roll sheet 3A by the thermal head 31 is completed, the cutter carriage 211 moves from the home position 502 (at the left side in FIG. 36) toward the common reference 501 (at the right side in FIG. 36). Since the cutter carriage 211 includes the cutter holder 204 and the movable blade 207, the movable blade 207 results in traversing the roll sheet 3A in its width direction. As a result, a label printed with the user's desiring data is produced from the roll sheet 3A.

Figure 37C:
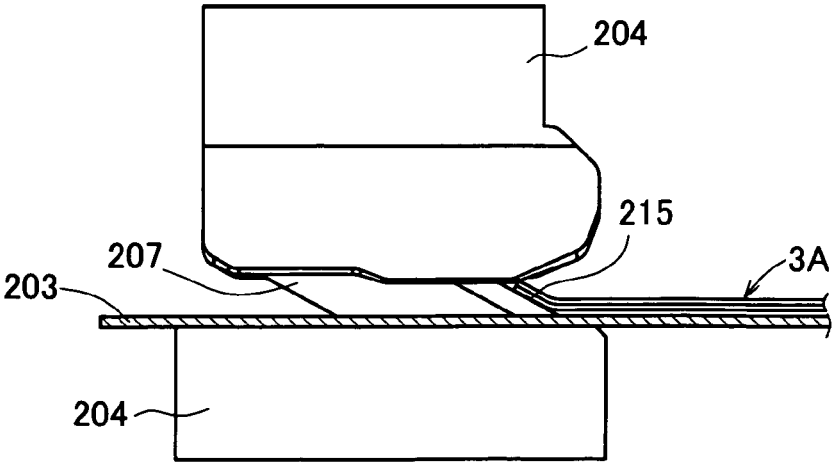

When the cutter lever 9 is manipulated after the roll sheet 3A is fed on the cutter plate 203 toward the outside of the label printer 1, first of all, the movable blade 207 moves along the passage groove 206 toward the end portion of the roll sheet 3A at the side of the home position 502 which has been fed along the upper surface of the cutter plate 203. FIG. 37A is a diagram showing a state where the cutting edge 215 of the movable blade 207 is brought into contact with the end portion of the roll sheet 3A at the side of home position 502. As shown in FIG. 37A, the cutting edge 215 is provided in such a manner that it inclines rearward along the cutting direction so as to obliquely cross the cutting direction at an oblique cross angle θ. In this structure, first of all, the cutting edge 215 is brought into contact with the heat-sensitive sheet 14 located at a lower surface of the roll sheet 3A. After that, the cutter lever 9 is manipulated to be moved in a right direction, so that the end portion of the roll sheet 3A is moved upward along the cutting edge 215 (FIG. 37B), and is further moved until it comes into contact with the lower surface of the cutter holder 204 located above the cutter plate 203 (FIG. 37C).

As described above, the label printer 1 according to this embodiment includes the cutter unit 8 in which the cutting edge 215 is provided in such a manner that it inclines downward along the cutting direction so as to obliquely cross the cutting direction at an oblique cross angle θ. In this structure, at the time of cutting the roll sheet 3A, the cutting edge 215 comes into contact with the heat-sensitive sheet first. In other words, the roll sheet 3A is cut by the cutting edge 215 in the order from the heat-sensitive sheet 14, the adhesive agent 14B, to the release sheet 14A.

After the cutting operation for the roll sheet 3A is repeated many times to produce the labels, there may arises a case the cutting edge 215 does not cut well any more. The cutting edge 215 cuts the roll sheet 3A as if it tears the roll sheet 3A instead of cutting it, and creates naps on the finally-cut surface. In this case, when the roll sheet 3A is fed with the heat sensitive sheet 14 located at its lower side, the heat sensitive sheet 14 carrying the user's desiring printing has naps, resulting in a problem that labels with poor quality are provided to the user.

In order to avoid such a problem, in this embodiment, the cutting edge 215 is provided in such a manner that it inclines rearward along the cutting direction so as to obliquely cross the cutting direction at an oblique cross angle θ. With this arrangement, even when the cutting edge 215 does not cut well any more and naps are produced on the cut surface, such naps are created on the release sheet 14A which will be disposed at the time when the label is used, and the heat-sensitive sheet 14 that the user needs can be cut into a beautiful state.

Further, in this embodiment, the cutting edge 215 of the movable blade 207 attached to the cutter holder 204 is set at an oblique cross angle θ within a range between 24° and 34°. At thus-set oblique cross angle θ, the performance of cutting the roll sheet 3A in its width direction is ensured and the durability of the movable blade 207 attached to the cutter holder 204 can be remarkably enhanced.

Hereinafter, a medium passage port 200 created by the upper surface of the cutter plate 203 and the lower surface of the cutter holder 204 located above the cutter plate 203 therebetween will be described in detail with reference to FIGS. 38 and 39.

Figure 38:
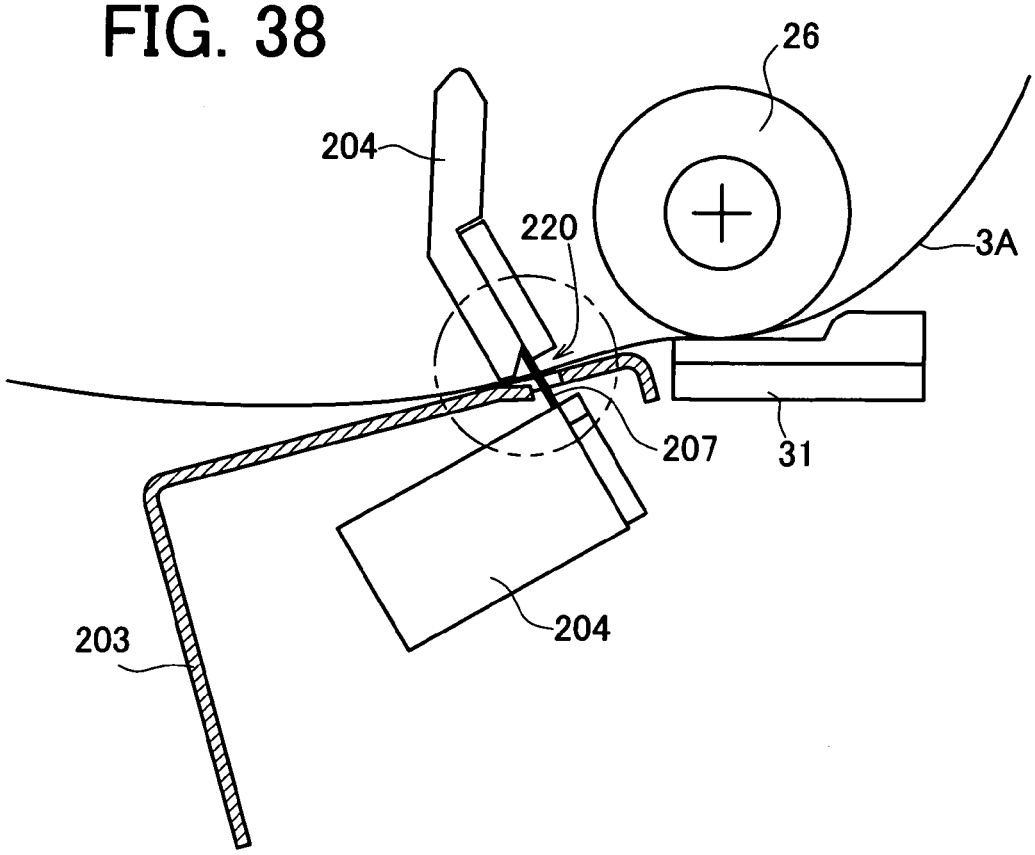
FIG. 38 is a side view of part of the label printer in which the thermal head is pressed to be urged against the platen roller with the roll sheet sandwiched therebetween, including a cutter plate shown in section.
Figure 39:
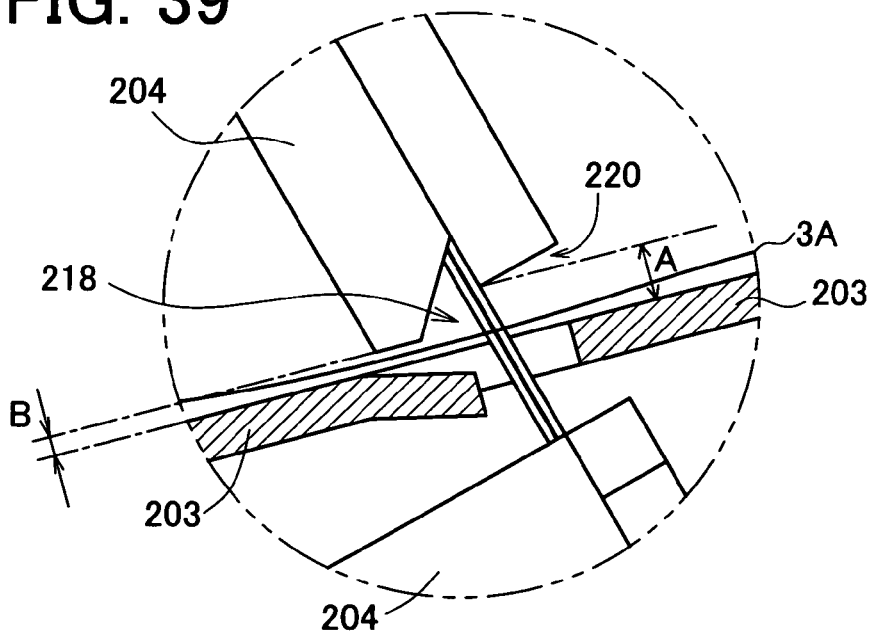
FIG. 39 is an enlarged side view of the movable blade and its periphery in a state shown in FIG. 38.

As shown in FIGS. 38 and 39, the roll sheet 3A is pressed to be urged against the thermal head 31 by the platen roller 26, so that the user's desiring print data is printed onto the heat-sensitive sheet 14. The roll sheet 3A after being subjected to the printing by the thermal head 31 is fed over the cutter plate 203, and is passed through the medium passage port 220 constituted by the lower surface of the upper cutter holder 204 and the upper surface of the cutter plate 203 therebetween and then is discharged outside the label printer 1. The roll sheet 3A after the printing operation is cut by the movable blade 207 as the cutter lever 9 is manipulated in the manner described above. During this cutting operation, the movement of the roll sheet 3A is restricted by the upper portion of the medium passage port 220 (i.e. the lower surface of the cutter holder 204).

The medium passage port 220 is constituted by the upper surface of the cutter plate 203 and the lower surface of the cutter holder 204 located above the cutter plate 203 therebetween. The medium passage port 220 has a structure in which the space created between the upper surface of the cutter plate 203 and the lower surface of the cutter holder 204 located above the cutter plate 203 (hereinafter, referred to as a medium passage port space) differs between the upstream side of the direction of feeding the roll sheet 3A (at the right sides in FIGS. 38 and 39) and the downstream side of the direction of feeding the roll sheet 3A (at the left sides in FIGS. 38 and 39).

As shown in FIG. 39, a second medium passage port space B at the downstream side of the direction of feeding the roll sheet 3A (at the left sides in FIGS. 38 and 39) is formed into a size smaller than a first medium passage port space A at the upstream side of the direction of feeding the roll sheet 3A (at the right sides in FIGS. 38 and 39). In this embodiment, the first medium passage port space A is formed into a size within a range between 1.2 mm to 1.8 mm, whereas the second medium passage port space B is formed into a size within a range between 0.2 mm to 0.8 mm.

As described above, the second medium passage port space B has a size smaller than the first medium passage port space A, and is formed into a size within a range between 0.2 mm to 0.8 mm. In this structure, at the time of starting the cutting operation for the roll sheet 3A, when the end portion of the roll sheet 3A moves upward along the cutting edge 215 to come into contact with the upper portion of the medium passage port 220 at the downstream of the feeding direction of the roll sheet 3A (see FIG. 37C), the movement of the end portion of the roll sheet 3A is restricted. As a result of this restriction, the cut surface is restricted accordingly without dispersing the force applied from the cutting edge 215 at the time of starting the cutting operation for the roll sheet 3A, thereby smoothly cutting the roll sheet 3A. Further, since the force applied from the cutting edge 215 is never dispersed, it is possible to prevent the cut surface from being formed into a tapered or waved shape and from being contorted.

On the other hand, when the roll sheet 3A constituted by the heat-sensitive sheet 14, the release sheet 14A and the adhesive agent 14B is cut, the adhesive agent 14B adheres onto the cutting edge 215. With the increase in the number of times of the cutting operation for the roll sheet 3A, the adhesive agent 14B adheres onto the surface of the cutting edge 215 and the adhesive agent 14B also adheres onto the portion of the movable blade 207 at which the movable blade 207 comes into contact with the roll sheet 3A. As a result, at the time of cutting the roll sheet 3A, the adhered adhesive agent 14B creates resistance against the movement of the movable blade 207. In this case, it becomes possible to maintain cutting performance for the roll sheet 3A with good efficiency over a long period of time. Further, the adhesive agent 14B accumulated onto the movable blade 207 adheres onto the label produced by cutting the roll sheet 3A, and the resultant label has bad appearance.

In this embodiment, as described above, the cutter holder 204 located above the cutter plate 203 is formed with an adhesive-receiving portion 218 at the support portion 219 for supporting the movable blade 207 at the downstream in the direction of feeding the roll sheet 3A (at the left side in FIG. 35B). The adhesive-receiving portion 218 is cut away toward a bottom of the movable blade 207 into a tapered shape. In this structure, the adhesive agent 14B which will adheres onto the cutting edge 215 so as to create resistance against the roll sheet 3A at the time of cutting the roll sheet 3A and then will adheres onto the produced label so as to degrade the appearance of the produced label will be received only in the adhesive-receiving portion 218. As a result, in the label printer 1 according to this embodiment, the cutting performance for the roll sheet 3A with good efficiency can be maintained over a long period of time, and it is possible to eliminate a problem that a label with a bad appearance due to the attached adhesive agent 14B thereto is provided to the user.

As described above, in the label printer 1 according to this embodiment, the cutting edge 215 is provided in such a manner that the upper portion of the cutting edge inclines rearward along the cutting direction so as to obliquely cross the cutting direction. In addition, the oblique cross angle created between the cutting edge 215 and the cutting direction is set to fall within a range between 24° and 34°. As a result, when the roll sheet 3A fed with its heat-sensitive sheet 14 located at its lower side is cut, the cutting edge 215 comes into contact with the heat-sensitive sheet 14 first. With this arrangement, even when the cutting edge 215 does not cut well any more after the repletion of cutting operation for the roll sheet 3A and naps are produced on the cut surface, such naps are created on the release sheet 14A which will be disposed at the time when the label is used, and a label with a beautiful cut surface can be provided to the user.

Further, in the label printer 1 according to this embodiment, the second medium passage port space B is formed into a range between 0.2 mm to 0.8 mm. With this arrangement, at the time of cutting the roll sheet 3A, the movement of the roll sheet 3A is restricted and the force to be applied from the cutting edge 215 can be transferred to the roll sheet 3A without dispersing. Specifically, during the cutting operation for the roll sheet 3A, the position at which the cutting edge 215 comes into contact with the roll sheet 3A is restricted. Therefore, it is possible to create a straight cut surface of the roll sheet 3A without being formed into a tapered or waved shape and from being contorted, thereby providing a label with good quality.

Further, in the label printer 1 according to this embodiment, the cutter holder 204 is formed with an adhesive-receiving portion 218 at the support portion 219 for supporting the movable blade 207 at the downstream in the direction of feeding the roll sheet 3A (at the left side in FIG. 35B). In this structure, the adhesive agent 14B which will adheres onto the cutting edge 215 so as to create resistance against the roll sheet 3A at the time of cutting the roll sheet 3A will be received only in the adhesive-receiving portion 218. Otherwise, the adhesive agent 14B may adhere again onto the label in some cases so as to degrade the appearance of the produced label.

In the label printer 1 according to this embodiment, as described above, the adhesive agent 14B adhered on the cutting edge 215 is received in the adhesive-receiving portion 218. With this arrangement, the resistance against the movement of the movable blade 207 never increases and the cutting performance for the roll sheet 3A with good efficiency can be maintained over a long period of time. Further, since the adhesive agent 14B received in the adhesive-receiving portion 218 never comes into contact with the roll sheet 3A, there never arises a problem that a label with bad appearance caused by the adhesive agent 14B attached thereto is provided to the user.

Hereinafter, another label printer 100 different from the label printer 1 according to this embodiment will be described.

The label printer 100 has a structure identical to the label printer 1 according to this embodiment except for the following portions described in detail below. Therefore, identical constituent elements will be denoted by the same reference numerals and their descriptions will be omitted unless otherwise specified, and the different portions will be mainly described.

Figure 45:
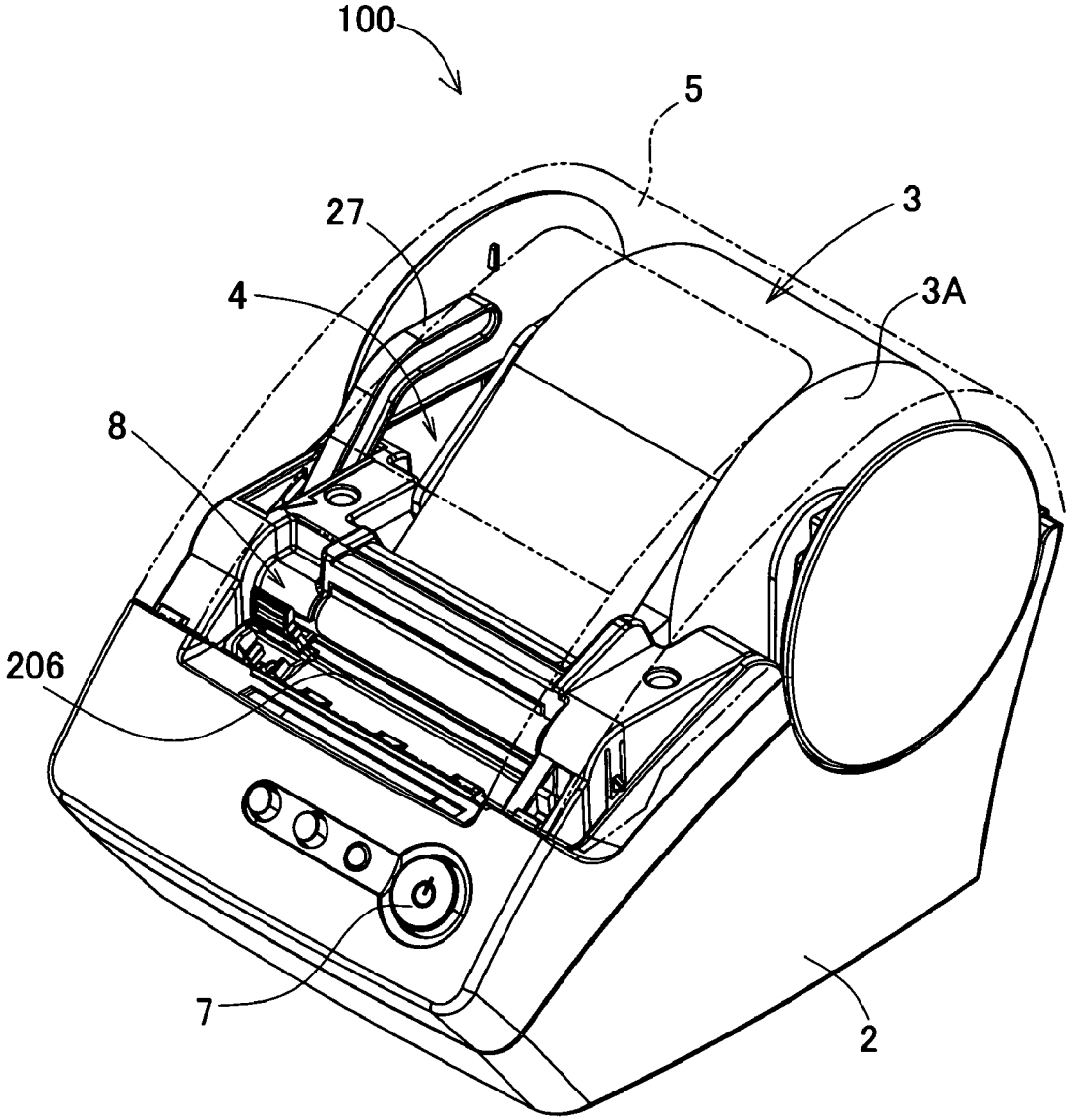
FIG. 45 is a schematic perspective view of the label printer.

FIG. 45 is a schematic perspective view of the label printer 100 according to this embodiment. As shown in FIG. 45, the label printer 100 includes, as in the label printer 1 according to the foregoing embodiment, a housing (a main body) 2, an top cover 5 made of transparent resin and attached at the upper edge portion at the rear side in a freely opened and closed state in such a manner as to cover the upper side of the roll sheet holder storage section 4 for holding the roll sheet holder 3 around which a roll sheet 3A in a specified width is wrapped, and a power source button located on the front side of the top cover 5.

However, as shown in FIG. 45, the label printer 100 differs from the label printer 1 according to the foregoing embodiment in that the tray 6 made of transparent resin (see FIG. 1) provided in an upright posture at the substantially middle portion at the front side so as to be opposed to the top cover 5 is eliminated. In addition, since the cutter unit 8 provided to the side surface at the front side and laterally movable is automatically controlled, the cutter lever 9 (see FIG. 1) for laterally moving the cutter unit 8 is also eliminated from the label printer 100.

Figure 41:
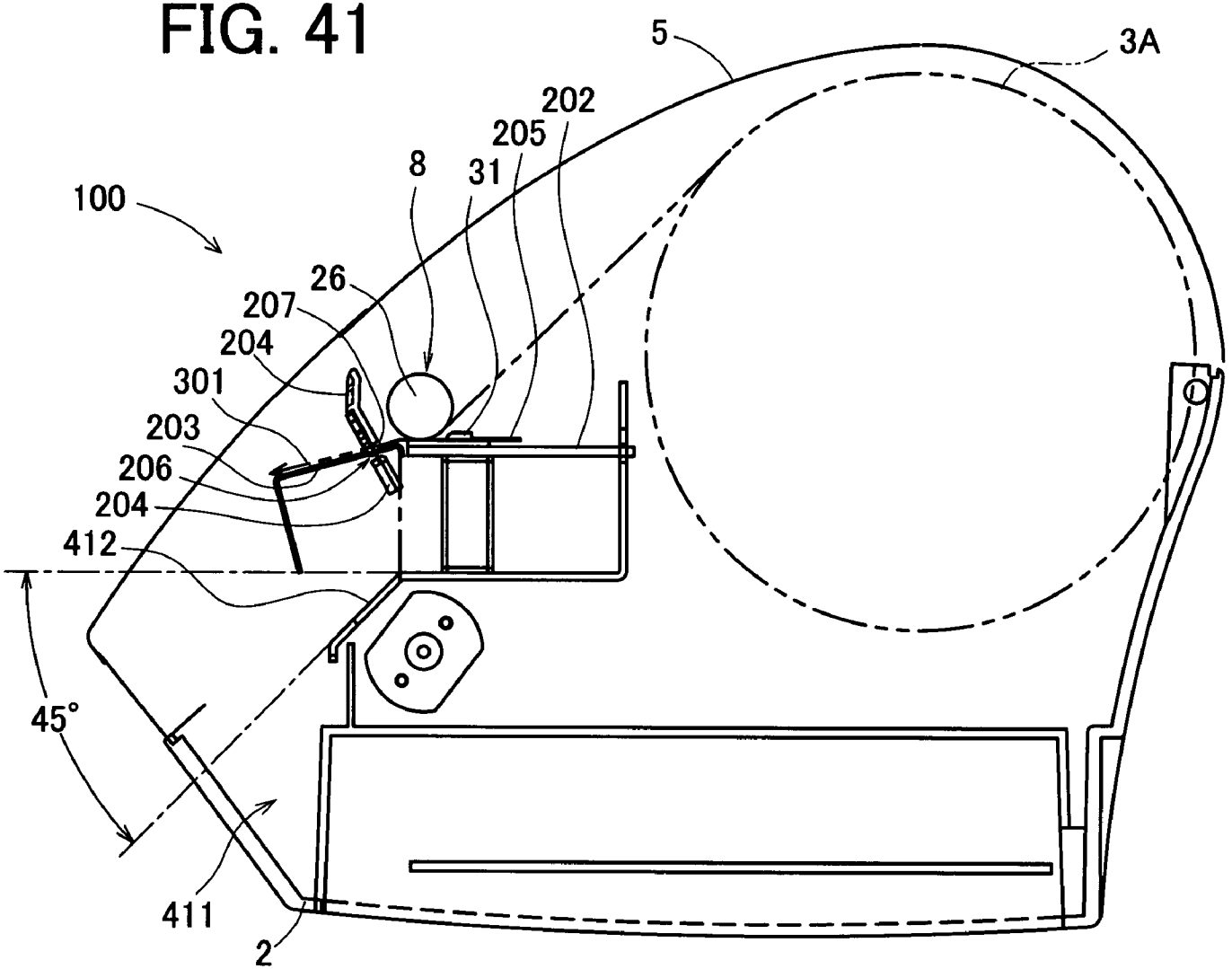
FIG. 41 is a perspective view of the cutter unit and its periphery in the label printer.
Figure 42:
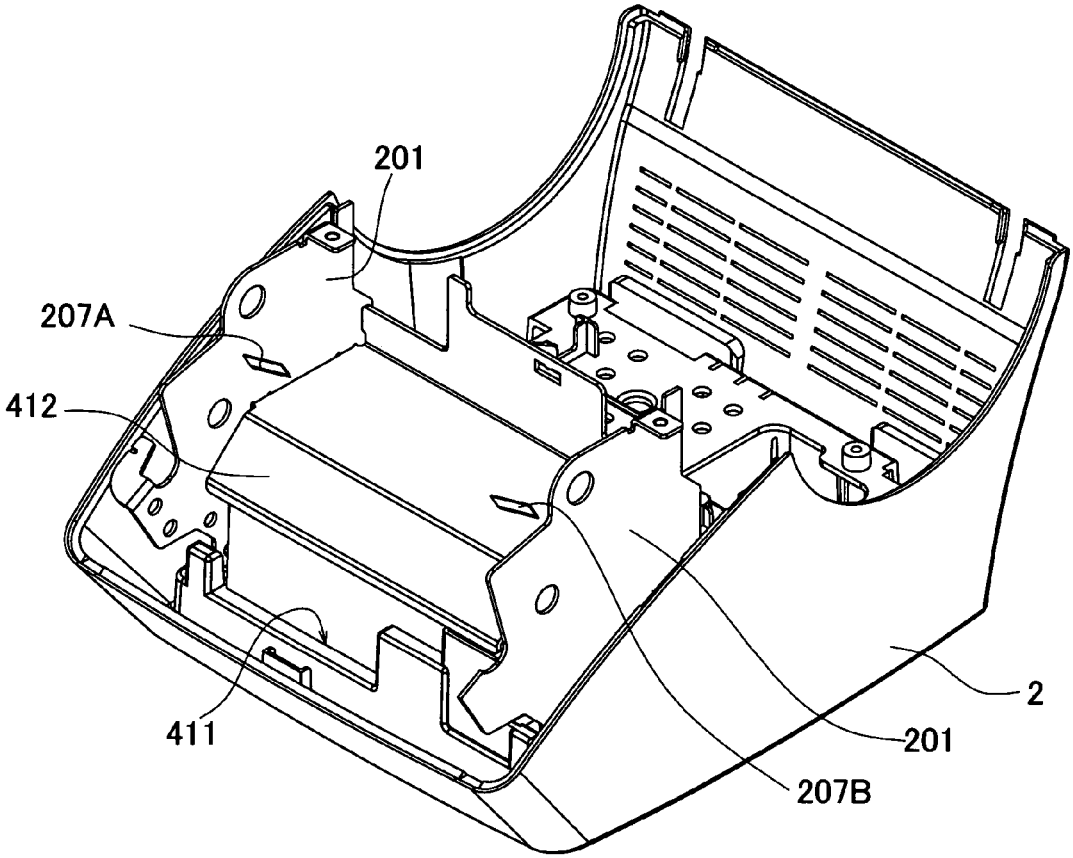
FIG. 42 is a perspective view of a housing of the label printer.
Figure 43:
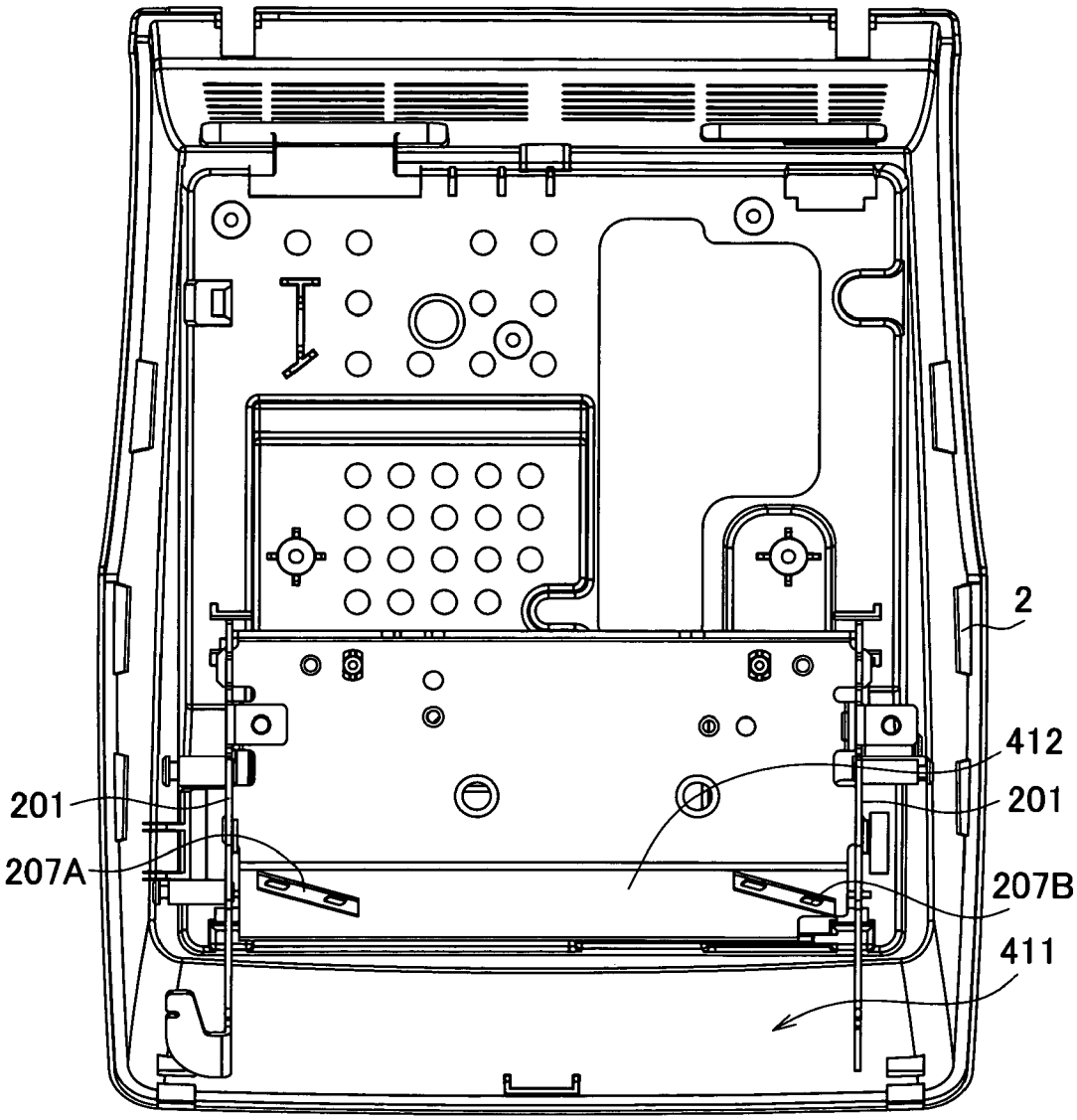
FIG. 43 is a plan view of the housing.
Figure 44:
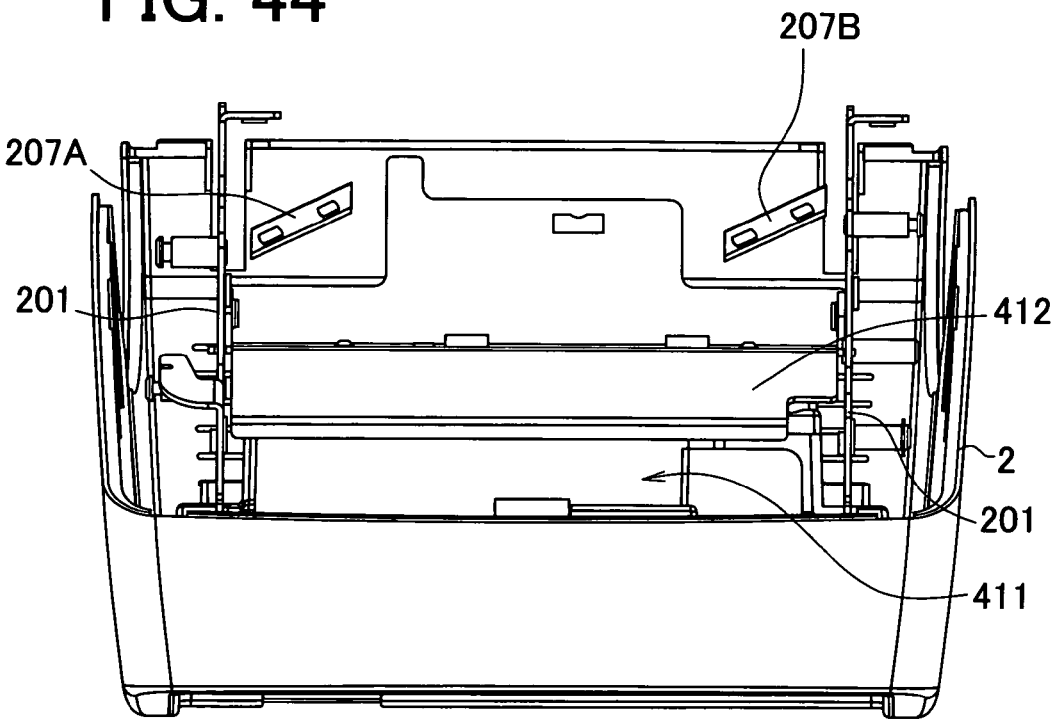
FIG. 44 is a front view of the housing.

In the label printer 100, as shown in FIG. 41, a paper powder guide portion 412 inclined at 45° is provided below the cutter plate 203. In addition, a paper powder storage section 411 is formed inside the housing 2 at a position residing on the extension line from the paper powder guide portion 412. Hereinafter, in order to describe schematic structures of the paper powder guide portion 412 and the paper powder storage section 411, a perspective view of the housing 2 is shown in FIG. 42, a plan view of the housing 2 is shown in FIG. 43, and a front view of the housing 2 is shown in FIG. 44. In FIGS. 41 to 44, a movable blade located at a home position 502 is shown by a reference numeral 207A, whereas the movable blade at the turning point of the reciprocal movement is denoted by a reference numeral 207B.

As shown in FIGS. 41 to 44, the paper powder guide portion 412 is provided between a pair of side plates for rotatably supporting the platen roller 26 (see FIG. 41) and the like. Further, as shown in FIGS. 43 and 44, the paper powder guide portion 412 covers the movable blade 207A located at the home position 502 and the movable blade 207B located at the turning point of the reciprocal movement. In other words, the paper powder guide portion 412 has a width larger than the movement range of the movable blade 207 (see FIG. 41). Further as shown in FIG. 43, the inclined surface of the paper powder guide portion 412 is located immediately below the movable blades 207A, 207B.

Specifically, in the label printer 100 of this embodiment, when the movable blade 207 vertically penetrating the passage groove 206 formed on the feeding surface 301 of the cutter plate 203 is reciprocated, the roll sheet 3A placed on the feeding surface 301 of the cutter plate 203 is cut and paper powder is generated from the roll sheet 3A. The paper powder drops from the passage groove 207 in which the movable blade 207 reciprocates onto the inclined surface of the paper powder guide portion 412 by its own weight and slides over the inclined surface of the paper powder guide portion 412, and is collected in the paper powder storage portion 411. At this time, the paper powder guide portion 412 for introducing the paper powder into the paper powder storage portion 411 has a width larger than the movement range of the movable blade 207 (see FIG. 41) and is provided at an inclination angle of 45°. Since thus-structured paper powder guide portion 412 is capable of securely collect the powder into the paper powder storage portion 411, dispersion of the paper powder is prevented, thereby suppressing the occurrence of paper jam of the roll sheet 3A and improper cut state of the roll sheet 3A caused by the paper powder.

Further, the paper powder guide portion 412 also serves to prevent the paper powder from entering a mechanical portion provided inside the housing 2. Further, the paper powder guide portion 412 can securely collect paper powder into the paper powder storage portion 411 even when the inclined surface of the paper guide portion is set at an inclination angle larger than 45°.

As described above, the invention introduced from the label printer 100 of this embodiment includes: a housing to which a roll-shaped printing medium is mounted; a platen roller provided to the housing; a thermal head movable into a state in press contact with the platen roller or into a state apart from the platen roller; a feeing plate provided at a downstream in a feeding direction of the printing medium with respect to the thermal head; a feeding surface which constitutes a surface of the feeding plate, and on which the printing medium sent out from a clearance between the thermal head and the platen roller is placed and slides thereon when the thermal head is in a state in press contact with the platen roller; cut means for reciprocating the movable blade against the printing medium which is placed on the feeding surface of the feeding plate and is slid thereon so as to cut the printing medium into a print label; a paper powder collecting portion located below the cut means; and a paper powder guide portion provided over the cut means to the paper powder collecting portion, wherein the paper guide section has a width larger than the reciprocal movement range of the movable blade of the cut means, and the paper guide portion is inclined at an angle of 45° or larger.

Then, in this invention, a roll-shaped printing medium is sent out from the clearance between the thermal head and the platen roller, and the printing medium is placed on the feeding plate and slides thereon. After that, the printing medium is cut by the cutting means of the sliding type, and at this time, paper powder is generated and drops. On this regard, the paper powder guide portion for introducing the paper powder into the paper powder portion located below the cutting means has a width direction larger than the reciprocal movement range of the movable blade of the cutting means, and has an inclination angle of 45° or larger. With this arrangement, the paper powder can be securely collected into the paper powder collecting section. As a result, dispersion of paper powder is prevented, thereby suppressing the occurrence of paper jam of the roll sheet and improper cut state of the medium caused by the paper powder.

The present invention may be embodied in other specific forms without departing from the spirit or essential characteristics thereof.

For example, in the label printer 1 of this embodiment, the discharge guide 402, the sliding movement of the roll sheet 3A over one end surface 5A of the top cover 5, and the rear rib 401 operate simultaneously. This structure serves to further prevent the cut surface of the roll sheet 3A from being cut into a snake form. Alternatively, if only one of the discharge guide 402, the sliding movement of the roll sheet 3A over one end surface 5A of the top cover 5, or the rear rib 401 is provided, it is possible to prevent the cut surface of the roll sheet 3A from being cut into a curved form (see FIG. 18).

Further, in the label printer 1 of this embodiment, the discharge guide 402, the sliding movement of the roll sheet 3A over one end surface 5A of the top cover 5, and the rear rib 402 work simultaneously. This structure serves to further prevent the cut surface of the roll sheet 3A from being cut into a snake form. Alternatively, if only one of the discharge guide 402, the sliding movement of the roll sheet 3A over one end surface 5A of the top cover 5, and the rear rib 402 is provided, it is also possible to prevent the cut surface of the roll sheet 3A from being cut into a snake form (see FIG. 20).

Further, in the label printer 1 of this embodiment, the movable blade 207 attached to the cutter holder 204 is reciprocated by hand in the passage groove 206 formed on the cutter plate 203 by manipulating the cutter level 9 (see FIG. 1 and the like) to move in a lateral direction. Alternatively, a screw shaft which can be driven to rotate may be used as the guide shaft 212 penetrated through the cutter carriage 211, and the movable blade 207 attached to the cutter holder 204 may be reciprocated in the passage groove 206 formed on the cutter plate 203 by an automatic control.

Further, in the label printer 1 of this embodiment, the thermal head 31 is moved vertically into a state where the thermal head 31 is pressed to be urged against the platen roller 26 and into a state where the thermal head 31 is apart from the platen roller 26. Alternatively, the platen roller 26 may be moved vertically between a state where the platen roller 26 is pressed to be urged against the thermal head 31 and a state where the platen roller 26 is apart from the thermal head 31. Still alternatively, the thermal head 31 and the platen roller 26 are moved vertically in directions opposite form each other so that the thermal head 31 and the platen roller 26 may be brought into a state where they are pressed to be urged against each other or into a state where they are apart from each other.

Further in the label printer 1 of this embodiment, the adhesive-receiving portion 218 is formed to be tapered toward the bottom of the movable blade 207. However, the adhesive-receiving portion 218 is not limited to the tapered form, but may be any shape as far as it is capable of storing the adhesive agent 14B attached onto the cutting edge 215.

Figure 40:
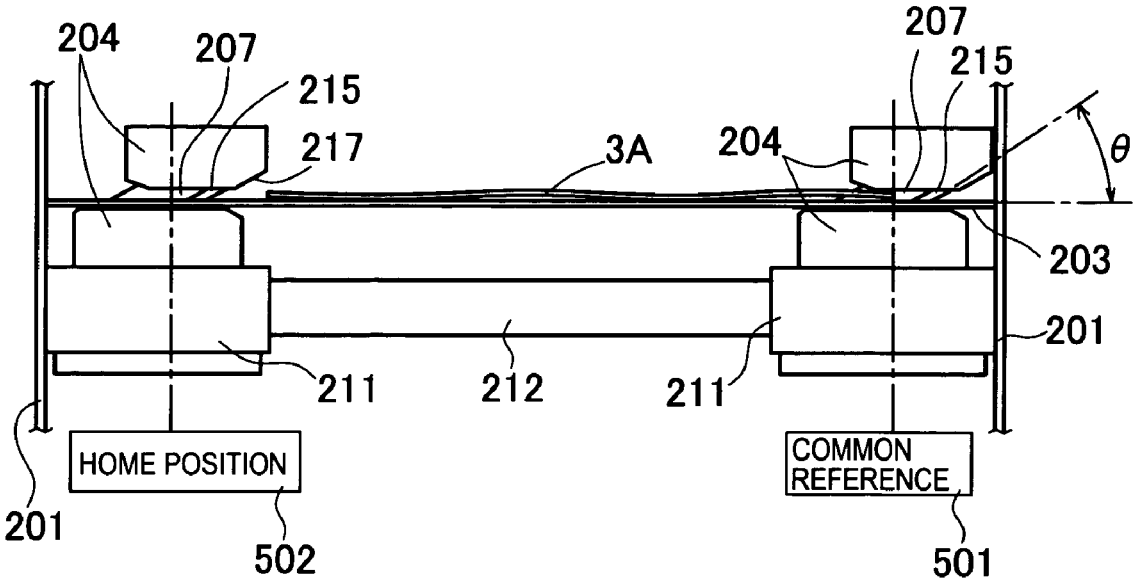
FIG. 40 is a conceptual diagram showing the home position and the turning point of the movable blade of the cutter holder, showing another concept of the oblique cross angle of the cutting edge of the movable blade, different from that in FIG. 33.

Further, in the label printer 1 of this embodiment, as shown in FIG. 33, the cutting edge 215 is attached to the movable blade 207 in a state where the upper portion of the cutting edge 215 is inclined rearward in the direction of moving the movable blade 207, that is, in the cutting direction of the roll sheet 3A. Alternatively, as shown in FIG. 40, the cutting edge 215 may be attached to the movable blade 207 in a state where the upper portion of the cutting edge 215 is inclined forward in the direction of moving the movable blade 207, that is, in the cutting direction of the roll sheet 3A. At this time as well, in order to ensure the cutting performance of the cutting edge 215, as is the case described above, the oblique cross angle θ is set to fall within a range between 24° and 34° with respect to the cutting direction, based on the data shown in FIG. 34. The oblique cross angle θ at this time is shown in FIG. 40.

The label printer 1 of this embodiment is a thermal printer using the thermal head 31 and the platen roller 26. Alternatively, the label printer 1 may be a printer in a printing system other than a thermal printing system.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A label printer comprising:

a housing into which a rolled printing medium is to be mounted;

a feeding device which feeds the printing medium mounted in the housing;

a printing device which makes prints on the printing medium;

a cutter unit including a movable blade that is located at a downstream side of a feeding direction of the printing medium with respect to the feeding device of the printing device, and is reciprocated in a width direction of the printing medium so as to cut a free end portion of the printing medium located at a downstream side of the feeding direction with respect to the printing device into a print label;

a feeding plate located at the downstream side of the feeding direction of the printing medium with respect to the printing device;

a curved discharge guide provided in a state of rising obliquely upward and successive to a feeding surface of the feeding plate; and a top cover to be placed on the housing, wherein a cutting edge of the movable blade is provided so as to obliquely cross with a direction along which the printing medium is cut, wherein a plurality of long printing medium of different widths is mountable in the housing, wherein any one of the plurality of long printing medium of different widths is mountable in a state where its side end at a specific side is aligned at a common reference, wherein the movable blade has a specific width and the cutting edge is formed at the side of the common reference, wherein the cutter unit includes a ridge side, which is opposite to the side that includes the cutting edge, wherein the movable blade is moved with respect to the printing medium mounted in the housing in the cutting direction from one end opposite to the common reference toward the common reference, and is stopped at a turning point at which the cutting edge of the movable blade goes beyond the side edge of the printing medium located at the side of the common reference, whereas the end portion of the cutting edge of the movable blade at the ridge side does not go beyond the side edge of the printing medium at the side of the common reference, and then is moved from the turning point in a direction reverse to the cutting direction, so that a part of the printing medium is cut into a print label, wherein one end side of a discharge port for discharging the printing medium, the discharge port being located at a downstream side of the feeding direction of the printing medium with respect to the feeding plate, is constituted by an end surface of the top cover, and wherein the printing medium passing through the discharge port slides on the end surface of the top cover which constitutes one end side of the discharge port.

2. The label printer according to claim 1, wherein an oblique cross angle formed between the printing medium and the cutting edge with respect to the direction along which the cutting edge cuts the printing medium falls within a range between 24° and 34°.

3. The label printer according to claim 2, wherein the movable blade is reciprocated in a state of obliquely crossing the feeding direction of the printing medium.

4. The label printer according to claim 2, wherein at least one rib is provided on an end surface inside the top cover, and wherein the discharge port for the printing medium is formed by allowing the rib of the top cover to face the discharge guide.

5. The label printer according to claim 4, wherein a passage groove through which the movable blade of the cutter unit vertically penetrates is formed on the feeding surface of the feeding plate, and wherein the entire or a part of the feeding surface of the feeding plate is inclined downward with respect to the passage groove to reach the inside of the passage groove.

6. The label printer according to claim 1, wherein at least one rib is provided on an end surface inside the top cover, and wherein the discharge port for the printing medium is formed by allowing the rib of the top cover to face the discharge guide.

7. The label printer according to claim 6, wherein a passage groove through which the movable blade of the cutter unit vertically penetrates is formed on the feeding surface of the feeding plate, and wherein the entire or a part of the feeding surface of the feeding plate is inclined downward with respect to the passage groove to reach the inside of the passage groove.

8. The label printer according to claim 1, wherein a passage groove through which the movable blade of the cutter unit vertically penetrates is formed on the feeding surface of the feeding plate, and wherein the entire or a part of the feeding surface of the feeding plate is inclined downward with respect to the passage groove to reach the inside of the passage groove.

9. The label printer according to claim 1, wherein the movable blade is reciprocated in a state of obliquely crossing the feeding direction of the printing medium.

10. The label printer according to claim 1, further comprising:

a preventing device attached to the cutter unit for preventing the printing medium from being apart from the feeding surface of the feeding plate.

11. The label printer according to claim 1, wherein:

the printing medium includes an image receiving sheet onto which printing is to be made, and a release sheet attached to the image receiving sheet via an adhesive agent, an oblique cross angle of the cutting edge falls within a range between 24° and 34°, and when the cutting edge cuts the printing medium fed with the image receiving sheet face down, the cutting edge reaches the image receiving sheet before it reaches the release sheet.

12. The label printer according to claim 11, wherein the cutter unit includes:

a cutter plate for guiding the printing medium to the outside of the housing; and a cutter holder for holding the movable blade at a position above the cutter plate, and wherein medium passage port spaces formed by an upper surface of the cutter plate and a lower surface of the cutter holder at a medium passage port through which the printing medium passes is formed in such a manner that a second medium passage port space located at a downstream side of the feeding direction of the printing medium with respect to the movable blade is smaller than a first medium passage port space located at a upstream side of the feeding direction of the printing medium with respect to the movable blade.

13. The label printer according to claim 12, wherein the second passage port space falls within a range between 0.2 mm and 0.8 mm.

14. The label printer according to claim 13, wherein the cutter holder is formed with an adhesive-receiving portion at a support portion for supporting the movable blade.

15. A label printer comprising:

a housing into which a rolled printing medium is to be mounted;

a platen roller provided to the housing;

a thermal head relatively movable into a state in press contact with the platen roller and into a state apart from the platen roller;

a feeding plate provided at a downstream side of the feeding direction of the printing medium with respect to the thermal head;

a feeding surface which constitutes a surface of the feeding plate, and on which a printing medium sent out from a clearance between the thermal head and the platen roller is placed and slid when the thermal head is in press contact state;

a cutter unit including a movable blade that is located at the downstream side of a feeding direction of the printing medium with respect to the thermal head, and is reciprocated in a width direction of the printing medium so as to cut a free end portion of the printing medium located at the downstream side of the feeding direction with respect to the thermal head into a print label;

a curved discharge guide provided in a state of rising obliquely upward and successive to a feeding surface of the feeding plate; and a top cover placed on the housing, wherein the printing medium includes an image receiving sheet onto which printing is to be made, and a release sheet attached to the image receiving sheet via an adhesive agent, wherein a plurality of long printing medium of different widths are mountable in the housing, wherein any one of the plurality of long printing medium of different widths is mountable in a state where its side end at a specific side is aligned at a common reference, wherein the movable blade has a specific width, the movable blade including a cutting edge that is formed at the side of the common reference, wherein the cutter unit includes a ridge side, which is opposite to the side that includes the cutting edge, wherein the movable blade is moved with respect to the printing medium mounted in the housing in a cutting direction from one end opposite to the common reference toward the common reference, and is stopped at a turning point at which the cutting edge of the movable blade goes beyond the side edge of the printing medium located at the side of the common reference, whereas the end portion of the cutting edge of the movable blade at the ridge side does not go beyond the side edge of the printing medium at the side of the common reference, and then is moved from the turning point in a direction reverse to the cutting direction, so that a part of the printing medium is cut into a print label, wherein the movable blade obliquely crosses the cutting direction with an upper portion of the cutting edge inclined rearward with respect to the cutting direction, wherein the cutting edge obliquely crosses the feeding direction of the printing medium with an upper portion of the cutting edge inclined downward in the cutting direction, wherein when the cutting edge cuts the printing medium fed with the image receiving sheet face down, the cutting edge reaches the image receiving sheet before it reaches the release sheet, and wherein one end side of a discharge port for discharging the printing medium, the discharge port being located at a downstream side of the feeding direction of the printing medium with respect to the feeding plate, is constituted by an end surface of the top cover, so that the printing medium passing through the discharge port slides on the end surface of the top cover which constitutes one end side of the discharge port.

* * * * *